US011717762B2

(12) United States Patent
Baker

(10) Patent No.: US 11,717,762 B2
(45) Date of Patent: Aug. 8, 2023

(54) ANIMATION PUPPET

(71) Applicant: StickyBones Inc., San Jose, CA (US)

(72) Inventor: Erik J. Baker, Vista, CA (US)

(73) Assignee: StickyBones Inc., Vista, CA (US)

( * ) Notice: Subject to any disclaimer, the term of this patent is extended or adjusted under 35 U.S.C. 154(b) by 54 days.

(21) Appl. No.: 17/183,196

(22) Filed: Feb. 23, 2021

(65) Prior Publication Data

US 2021/0170291 A1 Jun. 10, 2021

Related U.S. Application Data

(62) Division of application No. 15/848,845, filed on Dec. 20, 2017, now Pat. No. 10,933,340, which is a division of application No. 15/237,392, filed on Aug. 15, 2016, now Pat. No. 10,500,514.

(60) Provisional application No. 62/294,165, filed on Feb. 11, 2016, provisional application No. 62/205,559, filed on Aug. 14, 2015.

(51) Int. Cl.

| | |
|---|---|
| ***A63H 3/48*** | (2006.01) |
| ***A63H 3/46*** | (2006.01) |
| ***A63H 3/00*** | (2006.01) |
| ***A63H 33/26*** | (2006.01) |

(52) U.S. Cl.

CPC ..... *A63H 3/48* (2013.01); *A63H 3/003* (2013.01); *A63H 3/46* (2013.01); *A63H 33/26* (2013.01)

(58) Field of Classification Search

CPC . A63H 3/003; A63H 3/46; A63H 3/48; A63H 3/50; A63H 33/26

USPC ... 446/92, 97, 139, 308, 314, 325, 330, 359, 446/360, 365, 366

See application file for complete search history.

(56) References Cited

U.S. PATENT DOCUMENTS

| | | | | | |
|---|---|---|---|---|---|
| 1,848,257 | A | * | 3/1932 | Lewis | A63H 13/12 446/322 |
| 3,068,615 | A | * | 12/1962 | Nassour | A63J 25/00 446/139 |
| 3,701,215 | A | * | 10/1972 | Marason, Jr. | A63H 13/12 446/322 |
| 3,742,644 | A | * | 7/1973 | Williams | A63J 19/00 24/442 |

(Continued)

FOREIGN PATENT DOCUMENTS

| | | |
|---|---|---|
| JP | 1995-027683 U | 5/1995 |
| JP | 2007-111344 A | 5/2007 |

*Primary Examiner* — Joseph B Baldori

(74) *Attorney, Agent, or Firm* — Lowry Blixseth APC; Scott M. Lowry

(57) ABSTRACT

The animation puppet includes a body core, a head configured for friction-fit engagement with the body core and forming a head joint therebetween, a pair of upper limbs configured for friction-fit engagement with the body core and forming a respective pair of upper limb joints therebetween, and a pair of legs configured for friction-fit engagement with the body core and forming a respective pair of leg joints therebetween. Each of the joints include a pair of articulable surfaces in said friction-fit engagement by way of a surface interface pre-tension having a coefficient of friction relatively greater than the weight of the animation puppet such that each joint independently supports the weight of the animation puppet while simultaneously permitting relative independent position posing of one or more of the head, the pair of arms, and/or the pair of limbs relative to the body core for stop-motion animation.

9 Claims, 79 Drawing Sheets

(56) References Cited

U.S. PATENT DOCUMENTS 3,854,239 A * 12/1974 Williams ..... A63J 19/00 273/DIG. 30
4,186,518 A * 2/1980 Luke ..... A63F 7/2472 446/268
4,211,408 A * 7/1980 Tickle ..... A63F 7/2436 273/291
4,559,021 A * 12/1985 Wittenberg ..... A63H 3/48 446/359
4,979,921 A * 12/1990 Cardillo ..... A63H 33/00 428/3
4,992,070 A * 2/1991 Mullen ..... A63H 3/14 446/367
5,024,611 A * 6/1991 Eckerle ..... A63H 3/50 446/139
5,033,528 A * 7/1991 Volcani ..... F16M 11/40 403/56
5,083,732 A * 1/1992 Akamine ..... A61J 9/0607 248/104
5,209,694 A * 5/1993 Utt, Jr. ..... A63H 3/50 248/176.1
5,769,681 A * 6/1998 Greenwood, Sr. ... A63H 33/101 446/120
6,554,680 B2 * 4/2003 Abbondandolo .... H01H 35/186 446/28
6,607,684 B1 * 8/2003 Lee ..... B29C 45/14467 264/250
6,749,166 B2 * 6/2004 Valentine ..... F16M 13/022 362/191
6,776,682 B2 * 8/2004 Engel ..... A63H 33/40 446/101
6,827,626 B1 * 12/2004 Feeney ..... A63H 3/16 446/361
7,854,643 B2 * 12/2010 Kane ..... A63H 3/20 446/330
7,862,399 B1 * 1/2011 Culpepper ..... A63H 33/12 446/374
8,408,962 B2 * 4/2013 Sambenedetto ..... A63H 33/107 446/85
9,113,663 B2 * 8/2015 Stern ..... B25J 18/06
9,395,217 B1 * 7/2016 Gaor ..... G09F 17/00
10,342,366 B2 * 7/2019 Hatamian ..... F21V 33/0032
11,116,597 B2 * 9/2021 Lampropoulos ..... F16M 11/40
11,221,038 B1 * 1/2022 Simmons, Sr. ..... F16C 11/04
2004/0248499 A1 * 12/2004 Costa ..... A63H 3/50 446/376
2008/0017764 A1 * 1/2008 Nan ..... F16M 13/02 601/127
2009/0170396 A1 * 7/2009 Tardif ..... A63H 33/046 446/92
2010/0041300 A1 * 2/2010 Bevirt ..... F16M 11/14 446/97
2011/0028797 A1 * 2/2011 Yee ..... A61B 17/0293 600/231
2013/0210314 A1 * 8/2013 Rottjer ..... A63H 33/062 446/124
2018/0363837 A1 * 12/2018 Roberts ..... F16M 11/38

* cited by examiner

ANIMATION PUPPET

BACKGROUND OF THE INVENTION

The present invention generally relates to an animation puppet for use in art, education, animation and toys. More specifically, the present invention relates to an animation puppet having a highly articulable, free-standing and precision-posable skeletal frame for creating stop-motion armatures that can be positioned into a wide range of expressive and gravity defying poses.

Puppets are generally well known in the art and are used as inanimate objects animated or manipulated by a puppeteer. Some of the first known uses date back to 5th century Greece where the Greeks controlled such inanimate objects with draw-strings or pull-strings. Puppetry was also popularized in other areas of Europe and Asia as part of ancient forms of theater. Over the years, many different types of puppets have been developed, including fairly simple finger puppets, sock puppets, hand or glove puppets, Marottes, and more complex puppets, such as the Bunraku puppet (Japan), Marionette pull string puppets, etc. The more complex versions may require training to learn how to manipulate strings, poles, pulleys or the like. Alternative puppets may include carnival or body puppets worn and shown off as part of larger festivals or gatherings, such as parades or sporting events. In this respect, there are many different types and varieties of puppets, which, of course, are made from a wide range of materials, depending on the form and intended use. Obviously the complexity of the puppet can range from being simple to extremely complex—such design impacts the construction and the feasibility of operation once constructed.

Of the variety of puppets, stop-motion animation puppets may be used in television, the movies, and related entertainment as an animation technique to make a physically manipulated object or persona appear to move on its own. The animation is created by moving the object in small increments between individually photographed frames. When the photographed frames are played back as a continuous sequence, it creates the illusion that the puppet is moving. Dolls with movable joints or clay and cast foam figures (e.g., "clay-mations") are often used in stop motion animation. Unfortunately, stop-motion animation puppets known in the art are not suitable for use "right out of the box". For example, creating a doll with joints capable of being used for stop-motion animation requires formation of an underlying skeleton/armature, additional fabrication, sculpting, casting, tooling, adjustments, labor, etc. Clay figures, in particular, must be carefully designed and formed by a skilled artist.

Obviously, the problem with these known prior art puppets used for high-quality stop-motion animation is that they are complex, labor intensive to make, and require specialized designs and equipment to fabricate. Accordingly, specialized technicians and artists skilled in making puppets are often required, and the resultant designs are not easy to reproduce or mass manufacture. These individually produced puppets must then be fine tuned to operate as a positionable-ready animation puppet. Of course, the process and nature of the work required to create a highly functioning positionable-ready animation puppet makes them less suitable for mass production. The high cost, time, skill, resources, and materials required to make quality animation puppets reduces the affordability of quality animation puppets.

Typically, the labor intensive process for making a stop-motion animation puppet is to first design a metal skeleton/armature, e.g., with computer aided design ("CAD") software. Then, a highly skilled engineer or machinist fabricates the skeleton/armature out of metal rods and/or bearings based on the CAD design. Next, to turn the machine-finished metal skeleton/armature into a positionable animation puppet, a highly skilled artist sculpts clay and/or casts rubber foam around the metal skeleton/armature. Once the sculpting and casting has been completed, finishing details are applied, such as removing flash (i.e., excess material at the seams, resulting from molding processes), adding paint, color, etc. Even at this point, the stop-motion animation puppet still requires a great deal of tweaking or "tensioning" by a specialist (e.g., an animator) before the puppet is ready for production. "Tensioning" is the tedious process of loosening and/or tightening screws in the joints of the underlying skeleton/armature with a screwdriver, to achieve the tension necessary for the puppet to be positioned and animated correctly. This can be a labor intensive process itself as it is desired only to move the skeletal/armature structure of the puppet in small increments to obtain the desired sequencing movement when played back as a continuous stream. Traditional stop-motion puppets require tensioning before animating, so the joints are strong enough to hold the weight of the puppet, yet not tensioned or tightened to the degree the animator is unable to move the joints. As such, depending how well the stop-motion animation puppet is designed, each puppet may vary in quality and performance. Variances in the design and construction of the puppet greatly influence the level of precision and functionality, especially since the puppets are typically built one-off and by hand. This, accordingly, decreases the anticipated quality and repeatability from one puppet to the next. Afterward, this type of puppet requires a great deal of upkeep and tweaking to ensure the various controls keep working.

Other drawbacks known in the art of such stop-motion animation puppets is that they have a limited range of motion, may have inconsistent articulation and functionality (e.g., unable to hold poses after repeated use because the joints give out too quickly for use in animation), lack precision (e.g., animation puppets known in the art do not have the level of articulation in the foot required by an animator to achieve quality animation, such as by way of an articulating toe), are typically not free-standing (rather require additional support equipment or tools to hold the puppet upright), and may have inconsistent joint performance requiring additional tweaking to maintain proper functionality, especially after prolonged use. Such drawbacks can affect the overall quality of the animation because the animator is unable to achieve the degree of precision and range of motion desired.

Some toy manufacturers mass produce action figurines that have somewhat movable joints. Such action figures known in the art may include the Stikfas manufactured by Stikfas Pte Ltd of 39 Ean Kiam Place, Singapore, Singapore 429124 or the G.I. Joe manufactured by Hasbro, Inc. of 1027 Newport Avenue, Pawtucket, R.I. 02862. Notably, these action figures were not designed for stop-motion animation. For example, the Stikfas were designed as a 3.5 inch posable toy figure, not an animation tool or animation puppet. These products simply do not have the degree of functionality or precision required by an animator, for the purpose of animation. Similarly, while it may be possible to selectively position a G.I. Joe as part of a stop-action filming process, there is no real way to ensure precision-based adjustments, balance, etc. Toys like Stikfas, G.I. Joe, Modibots, manufactured by Go Go Dynamo of Providence, R.I., and Bionicles, manufactured by LEGO, Juris A/S Corporation of Koldingvej 2 Billund DK-7190, Denmark, are too limited in supination or pronation rotation of the joints (e.g., ankles, shoulders, etc.), do not have double jointed shoulders, do not have double jointed head/neck joints, lack the natural range of motion in the shoulders and head/neck, and do not have the capability to be position onto the toes without the use of an additional support system (namely because the toe joint is non-existent) to hold the figure upright.

Thus, there exists a significant need in the art for an animation puppet for use in stop-motion animation that can be mass manufactured, is precision-positionable for a high degree of repeat positioning over and extended time, and that is relatively inexpensive to manufacture, e.g., by way of precision injection molding. The present invention fulfills these needs and provides further related advantages.

SUMMARY OF THE INVENTION

An animation puppet as disclosed here may include a body core (e.g., inclusive of one or more of a chest, an abdomen, and/or a pelvis) connectible with a variety of components, such as a head, a pair of upper limbs or arms, and a pair of legs in a manner that allows a user to pose the animation puppet in a number of different positions for purposes of, e.g., stop motion animation. In one embodiment, the head may be configured for friction-fit engagement with the body core, thereby forming a head joint therebetween, the pair of upper limbs may be configured for friction-fit engagement with the body core, thereby forming a respective pair of upper limb joints therebetween, and the pair of legs may be configured for friction-fit engagement with the body core, thereby forming a respective pair of leg joints therebetween. Each of the joints may include a pair of articulable surfaces in said friction-fit engagement by way of a surface interface pre-tension having a coefficient of friction relatively greater than the weight of the animation puppet such that each joint independently supports the weight of the animation puppet while simultaneously permitting relative independent position posing of one or more of the head, the pair of arms, and/or the pair of limbs relative to the body core for stop-motion animation.

In one embodiment, the head joint may include a double joint having a head ball grip in friction-fit engagement with a head socket in the head and a chest ball grip in friction-fit engagement with a chest socket in the body core. Here, the head joint may include a flexion of approximately 70 to 90 degrees, an extension up to approximately 55 degrees, a lateral bend up to approximately 35 degrees, and a shoulder rotation up to approximately 70 degrees.

In a similar embodiment, each of the upper limb joints may include a double joint having a shoulder ball grip in friction-fit engagement with a shoulder socket in the body core and an arm ball grip in friction-fit engagement with an arm socket in the upper limb. Each leg joint may include a hip ball grip extending outwardly from a respective leg in friction-fit engagement with a respective hip socket in the body core. Here, the upper limb joints may include an abduction up to approximately 180 degrees, an adduction up to approximately 45 degrees, a horizontal extension up to approximately 45 degrees, a horizontal flexion up to approximately 130 degrees, a vertical extension up to approximately 60 degrees, and a vertical flexion up to approximately 180 degrees.

In another embodiment, the head and the pair of upper limbs may couple to the chest and the pair of legs may couple to the pelvis portion of the body core. The pelvis may include a respective pair of angled hip sockets that include a wedge-shape cut-out and a rear supportive flange to permit maximum rotation and support thereof. The pelvis may include a pelvis ball grip that selectively couples in friction-fit engagement to a pelvis socket in the abdomen, wherein engagement of the pelvis ball grip in the pelvis socket forms a pelvis joint having a flexion up to approximately 75 degrees, an extension up to approximately 30 degrees, and a lateral bend up to approximately 35 degrees.

The pair of legs may include a thigh and a shin, wherein the shin selectively couples to a foot that generally includes a heel that can articulate relative to a toe. More specifically, the toe may include a chamber having a size and shape for select reception and pull-out removal of a magnet that may attach the animation puppet to various metal or magnetized surfaces. A cap having a keyed extension for one-way engagement with a keyed recess in the magnet receiving chamber may seal the magnet therein. In one embodiment, the chamber may include an upwardly facing magnet receiving chamber. More specifically, the chamber may include a top accessible bore and a bottom accessible bore, wherein the top accessible bore includes a width relatively wider than a width of the bottom accessible bore. In this embodiment, the width of the top accessible bore may be of a size and shape to selectively receive and retain a magnet or a screw head and the width of the bottom accessible bore may be of a size and shape relatively smaller than the magnet and relatively larger than a screw shank. This permits the chamber to selectively receive and retain the aforementioned magnet, for magnetized engagement of the animation puppet to a metal or magnetized surface, while also allowing the animation puppet to be tied-down using a screw or the like. Here, the magnet may include a magnetic force sufficient to lock the animation puppet to a metal base for stop-motion animation.

More specifically with respect to the heel, the heel may include a bottom-mounted or bottom-accessible magnet receiving recess. Additionally, the heel may include an ankle socket that includes a bore having a partial cut-out opening and an upwardly extending support cuff. Here, the shin may include a lower extension having an eccentric ankle ball grip axially misaligned with the length of the shin and configured for friction-fit engagement with the ankle socket. Such axial misalignment is configured to clear the lower extension of the partial cut-out opening of the upwardly extending support cuff. Additionally, an ankle joint formed by friction-fit engagement of the ankle ball grip with the ankle socket may include a flexion of up to approximately 45 degrees, an extension up to approximately 20 degrees, a pronation up to approximately 30 degrees, and a supination up to approximately 20 degrees.

In another aspect of the embodiments disclosed herein, the foot may further include a pair of toe ball grips extending outwardly from the heel for friction-fit engagement with a pair of respective toe sockets in the toe. Here, the heel may flex relative to the toe about a toe joint formed by friction-fit engagement of the toe ball grips with the toe sockets.

In another feature of the animation puppet disclosed herein, the thigh and the shin may interconnect about a knee joint that includes a ball-and-socket joint or a hinge joint. In this respect, the knee joint may include a flexion up to approximately 130 degrees, an extension up to approximately 15 degrees, and an internal rotation up to approximately 10 degrees. Each of the thighs may also include an eccentrically extending hip ball grip axially misaligned with the length of the thigh and configured for friction-fit engagement with a hip socket of the body core, wherein engagement of the eccentrically extending ball grip in the hip socket forms a hip joint having a flexion between approximately 110 and 130 degrees, an extension up to approximately 30 degrees, an abduction between approximately 45 to 30 degrees, an adduction between approximately 20 to 30 degrees, an internal rotation up to approximately 40 degrees, and an external rotation up to approximately 45 degrees.

In another embodiment of the animation puppet disclosed herein, each of the pair of upper limbs may include an arm, a forearm, and a hand with a set of fingers. The arm and the forearm may interconnect about an elbow joint that includes a flexion up to approximately 150 degrees, an extension up to approximately 180 degrees, a supination up to approximately 90 degrees, and a pronation up to 90 degrees. In one embodiment, the elbow joint may include a ball-and-socket joint or a hinge joint. Additionally, the forearm and the hand may connect about a wrist joint, wherein the wrist joint includes a flexion between approximately 80 to 90 degrees, an extension up to approximately 70 degrees, a radial deviation up to approximately 20 degrees, and an ulnar deviation between approximately 30 and 50 degrees. The hand may further include a palm having a housing configured to selectively receive and retain a magnet, wherein the magnetic force of the magnet is strong enough to support the weight of the animation puppet.

In another aspect of the embodiments disclosed herein, each of the joints may include plastic injection molded joints and one of the pair of articulable surfaces may include a ball grip and the other of the pair of articulable surfaces may include a socket. Here, the ball grip may include a solid plastic core having a relatively softer abrasion resistant over mold that includes a rubber material. Additionally, the animation puppet may include an extension rig configured for friction-fit engagement with the body core.

In another embodiment, the animation puppet disclosed herein may include an extension rig that includes a base having a mounting surface for upright positioning of the extension rig, a rod coupled to and at least partially extending up and away from the base, and a ball grip coupled an upper end of the rod and opposite the base, the ball grip including a first articulable surface configured for friction-fit engagement with a second articulable surface of a puppet socket. The friction-fit engagement of the ball grip with the puppet socket may form a base joint wherein a surface interface pre-tension between the first and second articulable surfaces has a coefficient of friction relatively greater than the weight of the animation puppet when attached to the extension rig such that the base joint independently supports the weight of the animation puppet while simultaneously permitting relative independent position posing of the animation puppet for stop-motion animation.

As disclosed herein, the extension rig may further include an adapter having a pair of adapter sockets, wherein at least one of the pair of adapter sockets is configured for friction-fit engagement with the ball grip. In one embodiment, the friction-fit connection of the ball connectors with the adapter socket and/or the puppet socket permits multiple degree of freedom rotation (e.g., 360 degree rotation) relative thereto. The extension rig may also make sure of one or more connecting members that include a rod with a pair of ball connectors at opposite ends thereof. In this embodiment, one of the pair of ball connectors may be configured for friction-fit engagement with the adapter socket and the other of the pair of ball connectors may be configured for friction-fit engagement with the puppet socket.

In another aspect of this embodiment, the mounting surface may include a magnetic surface and/or the base may include one or more magnet receiving chambers for selectively receiving and retaining a magnet therein. In this respect, the animation puppet may further include a kit of components, including the animation puppet, the extension rig, and an installation tool that includes a rod having an insertion section with an insertion head relatively smaller than a removal section and its removal head. More specifically, the insertion section may include a first cylinder and the removal section may include a second cylinder, wherein the first cylinder has a diameter relatively smaller than the second cylinder. Here, magnetic attraction between the magnet and the base may be relatively stronger than between the magnet and the insertion head, while magnetic attraction between the magnet and the base may be relatively weaker than between the magnet and the removal head.

In another embodiment of the animation puppet disclosed herein, an appendage includes a main body having a size and shape for supporting the weight of the animation puppet and a magnet receiving chamber formed from the main body and having a size and shape for select reception and/or pull-out removal of a magnet therein. The appendage may further include one of a ball grip or a socket formed as part of the main body for connection to the opposite of the ball grip or the socket formed as part of the animation puppet. Here, the ball grip may include a first articulable surface configured for friction-fit engagement with a second articulable surface of the socket, wherein friction-fit engagement of the ball grip with the socket forms a joint wherein a surface interface pre-tension between the first and second articulable surfaces has a coefficient of friction relatively greater than the weight of the animation puppet such that the joint and the main body support the weight of the animation puppet in magnetized relation to a mounting surface while simultaneously permitting relative independent position posing of the animation puppet for stop-motion animation.

This embodiment may further include a cap for sealing the magnet inside the magnet receiving chamber, wherein the cap includes a keyed extension for one-way engagement with a keyed recess formed from the magnet receiving chamber. The magnet receiving chamber may include an upwardly facing magnet receiving chamber formed from a portion of a toe of the animation puppet. Here, for example, the magnet receiving chamber may more specifically include a top accessible bore and a bottom accessible bore, wherein the top accessible bore has a width relatively wider than a width of the bottom accessible bore. The width of the top accessible bore may be of a size and shape to selectively receive and retain the magnet or a screw head and the width of the bottom accessible bore may be of a size and shape relatively smaller than the magnet and relatively larger than a screw shank. The interface between the top accessible bore and the bottom accessible bore may form a retention lip (e.g., to stop through passage of the magnet or a screw head all the way through the toe).

In another aspect of this embodiment, the magnet may include a magnetic force sufficient to lock the animation puppet to the mounting surface for stop-motion animation.

In another embodiment, the appendage may include a heel and the magnet receiving chamber may include a bottom-mounted magnet receiving recess. The heel may include an ankle socket that includes a bore having a partial cut-out opening and an upwardly extending support cuff for select friction-fit engagement with other components of the animation puppet. Additionally, the appendage may include a hand and the magnet receiving chamber may be formed from a palm of the hand.

In another embodiment, the animation puppet may include a foot that has a toe and a heel, each having a size and shape for supporting the weight of the animation puppet. One of the toe or the heel may include a chamber having a size and shape for select reception and/or pull out removal of a magnet therein. More specifically in this respect, the chamber may include an upwardly facing magnet receiving chamber in the toe or the chamber may include a bottom-mounted magnet receiving recess.

A double joint may be formed between and facilitating friction-fit engagement of the toe with the heel. Here, the double joint may include a pair ball grips and a pair of corresponding sockets. The ball grips may each include a first articulable surface configured for friction-fit engagement with a second articulable surface of the respective sockets. The friction-fit engagement of the ball grips with the sockets may form the double joint wherein a surface interface pre-tension between the first and second articulable surfaces has a coefficient of friction relatively greater than the weight of the animation puppet such that the heel may move relative to the toe yet support the weight of the animation puppet while simultaneously permitting relative independent position posing of the animation puppet for stop-motion animation.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 14L is a right side elevation view of the left arm of FIGS. 14B, 14D, 14F, and 14H;

FIG. 15A is a perspective view of the front, top and left sides of one embodiment of a right forearm of the animation puppet as disclosed herein;

FIG. 15B is a perspective view of the front, top and left sides of one embodiment of a left forearm of the animation puppet as disclosed herein;

FIG. 15C is a perspective view of the front, top and right sides of the right forearm as disclosed in FIG. 15A;

FIG. 15D is a perspective view of the front, top and right sides of the left forearm as disclosed in FIG. 15B;

FIG. 15E is a perspective view of the front, bottom and left sides of the right forearm as disclosed in FIGS. 15A and 15C;

FIG. 15F is a perspective view of the front, bottom and left sides of the left forearm as disclosed in FIGS. 15B and 15D;

FIG. 15G is a perspective view of the front, bottom and right sides of the right forearm as disclosed in FIGS. 15A, 15C, and 15E;

FIG. 15H is a perspective view of the front, bottom and right sides of the left forearm as disclosed in FIGS. 15B, 15D, and 15F;

FIG. 15I is a front elevation view of the right forearm of FIGS. 15A, 15C, 15E, and 15G;

FIG. 15J is a front elevation view of the left forearm of FIGS. 15B, 15D, 15F, and 15H;

FIG. 15K is a left side elevation view of the right forearm of FIGS. 15A, 15C, 15E, and 15G;

Figure 15A:
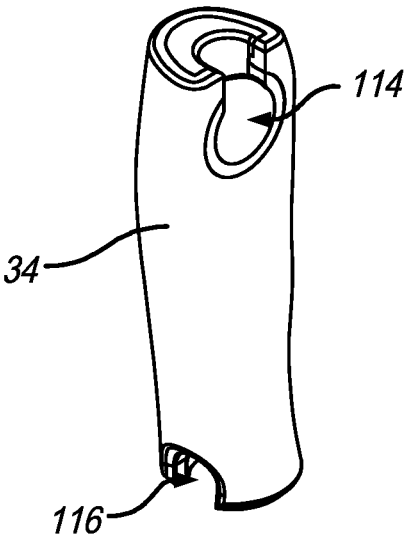
Figure 15B:
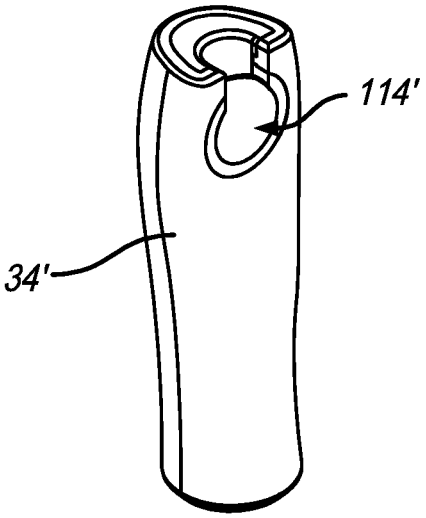
Figure 15C:
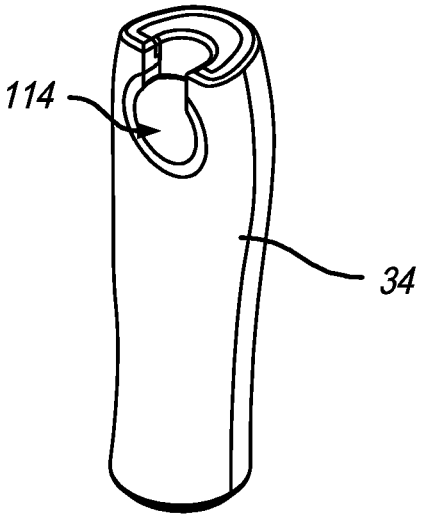
Figure 15D:
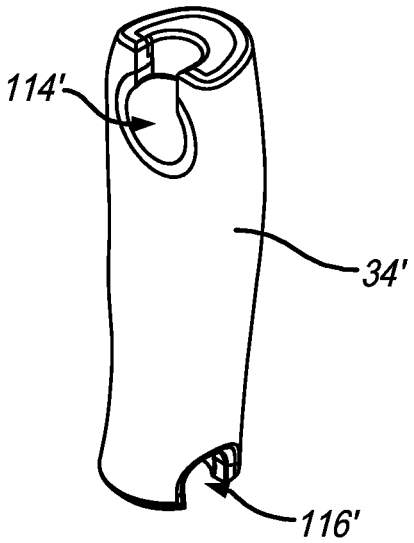
Figure 15E:
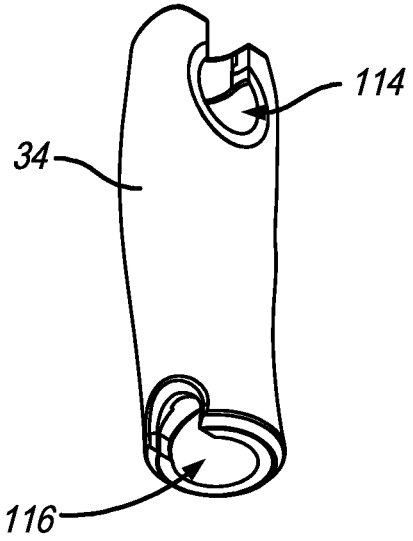
Figure 15F:
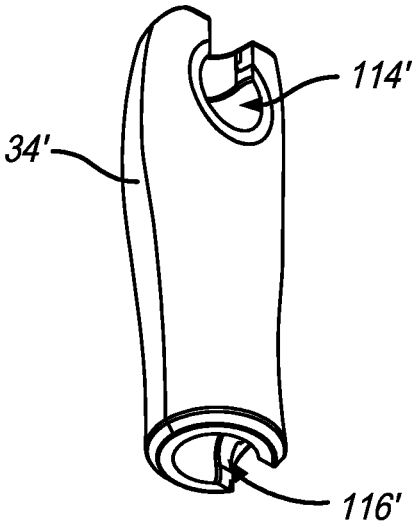
Figure 15G:
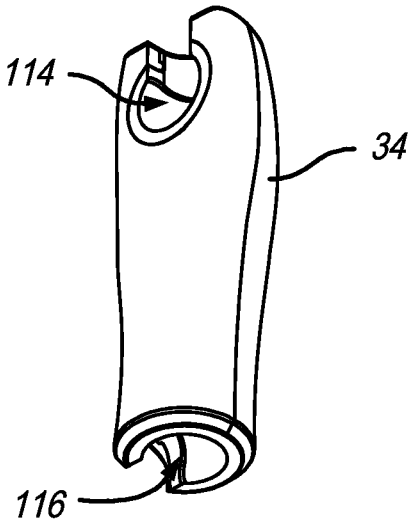
Figure 15H:
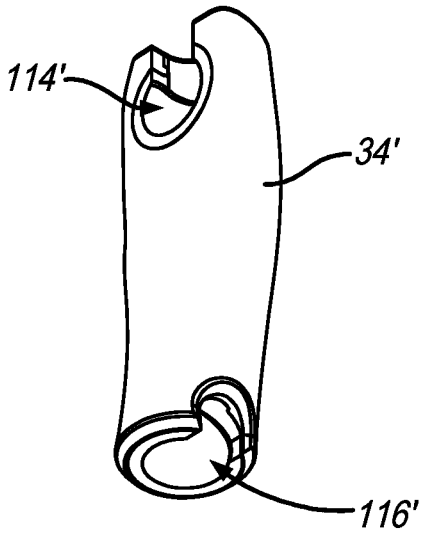
Figure 15I:
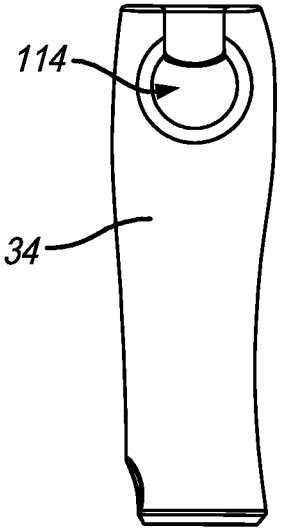
Figure 15J:
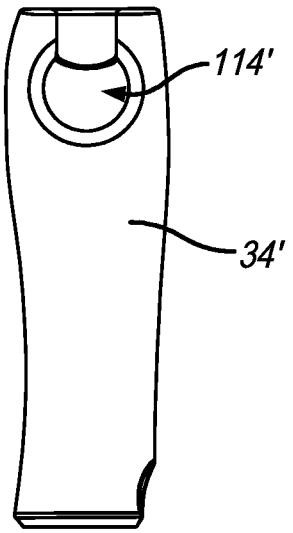
Figure 15K:
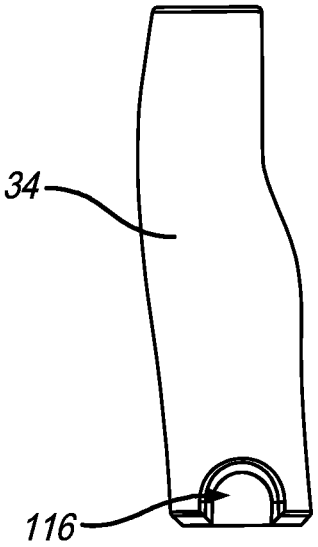
Figure 15L:
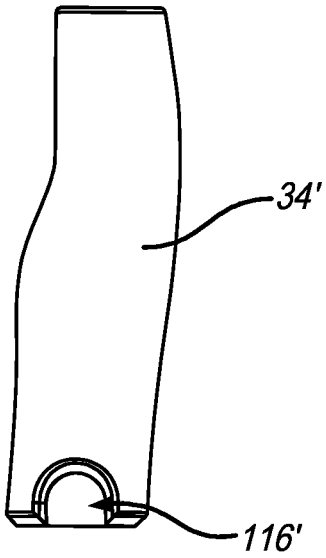
Figure 16A:
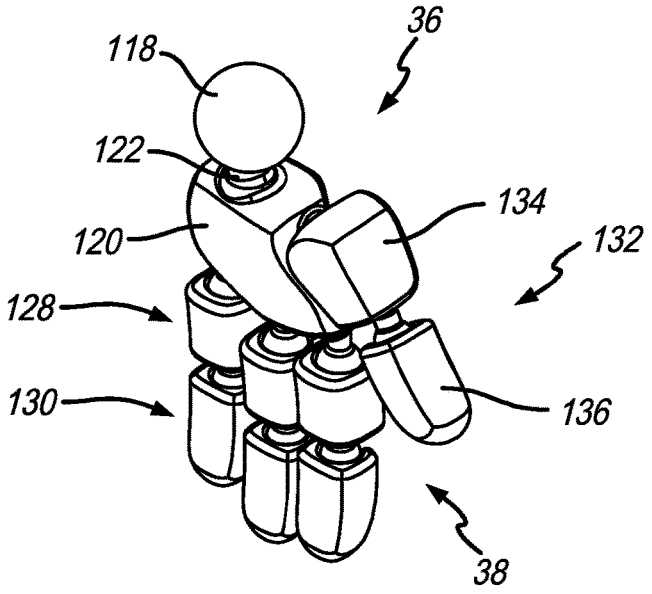
Figure 16B:
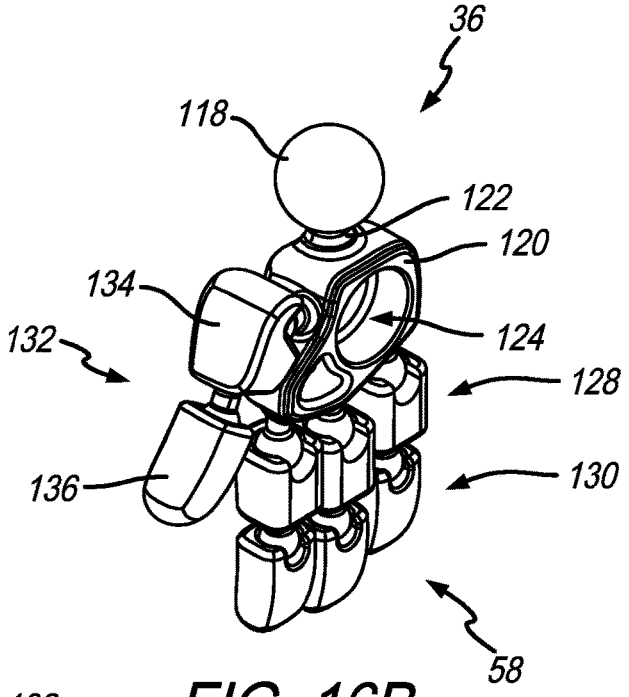
Figure 16C:
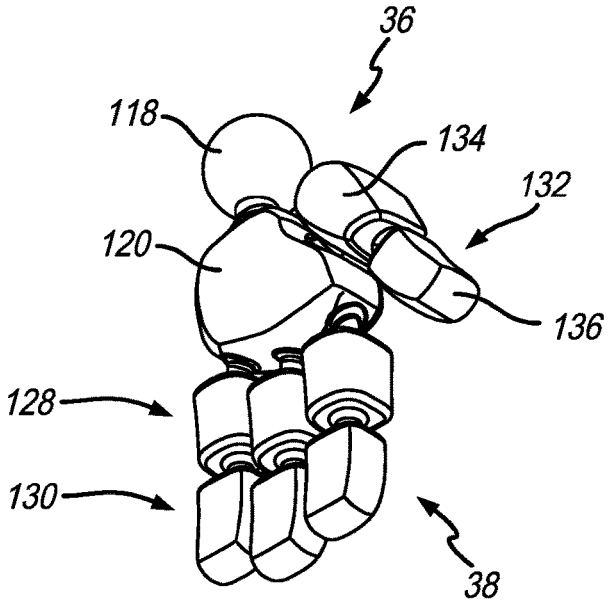
Figure 16D:
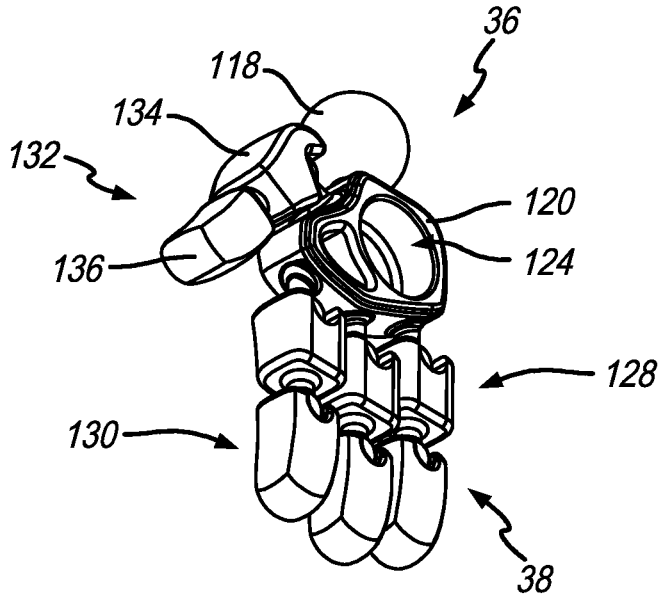
Figure 16E:
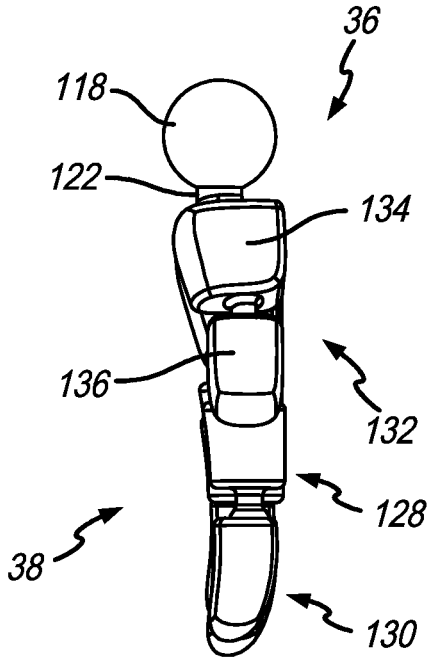
Figure 16F:
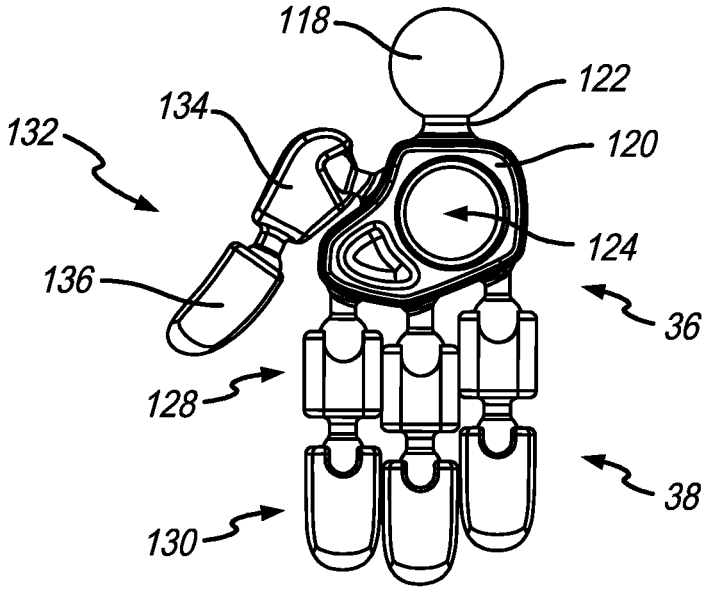
Figure 16G:
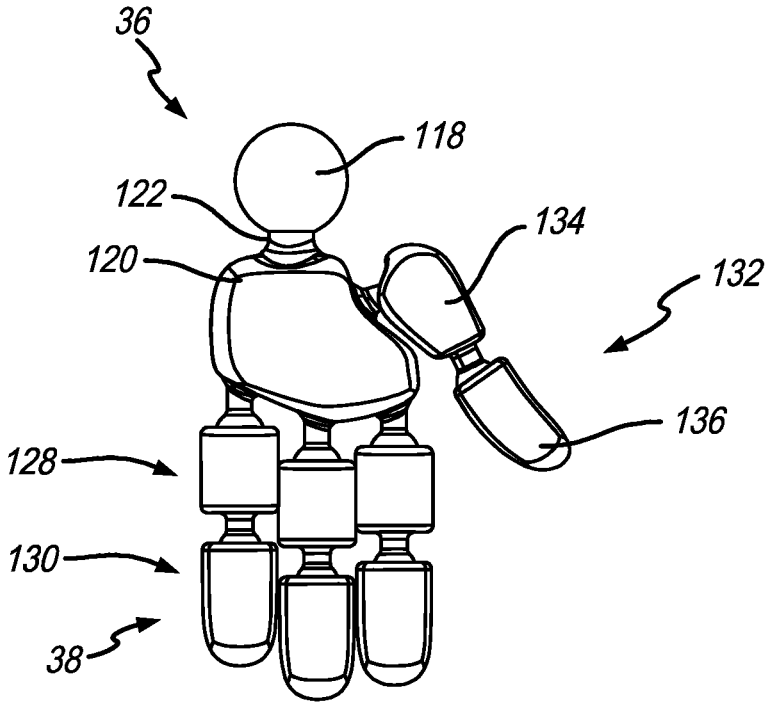
Figure 16H:
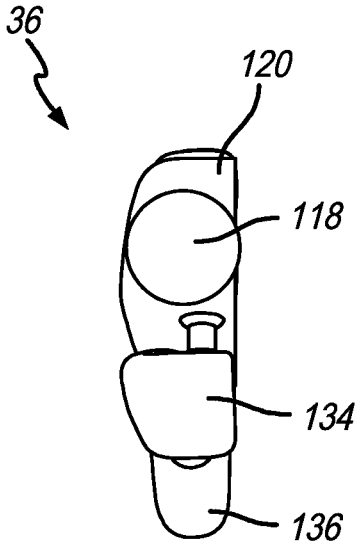
Figure 17:
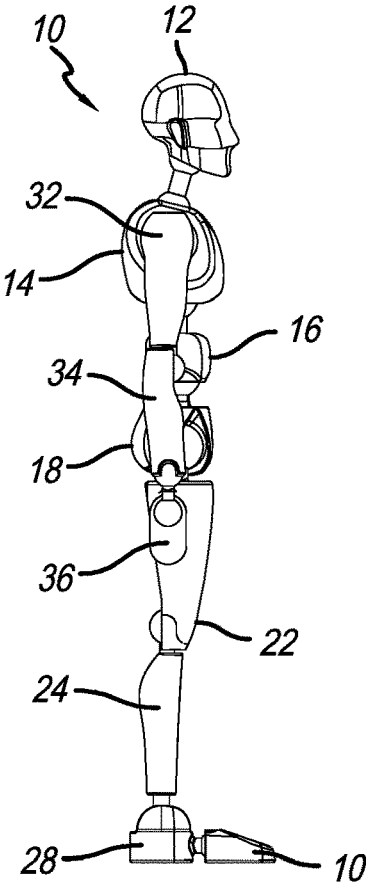
Figure 18:
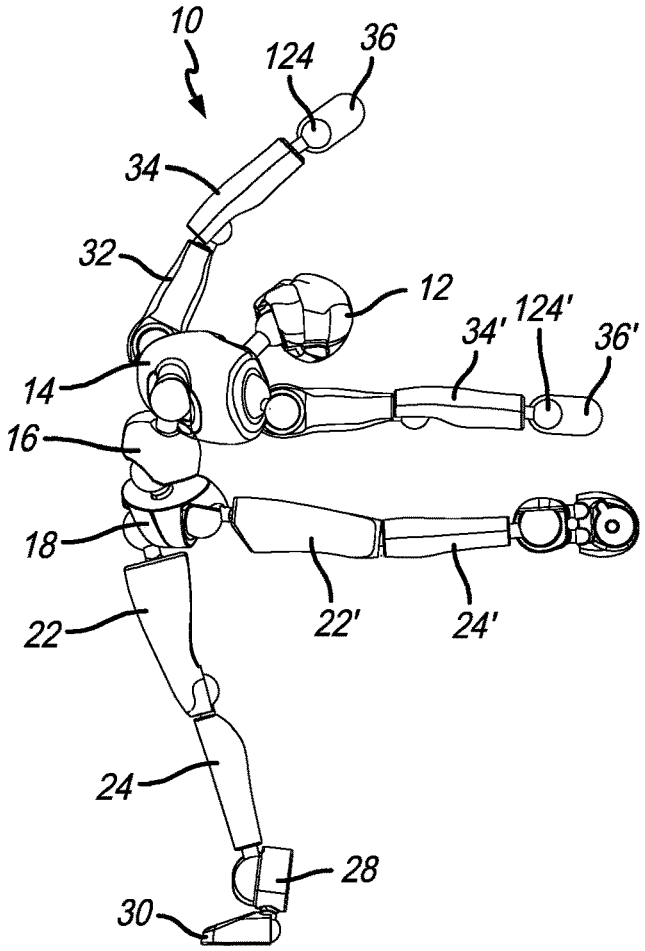
Figure 19:
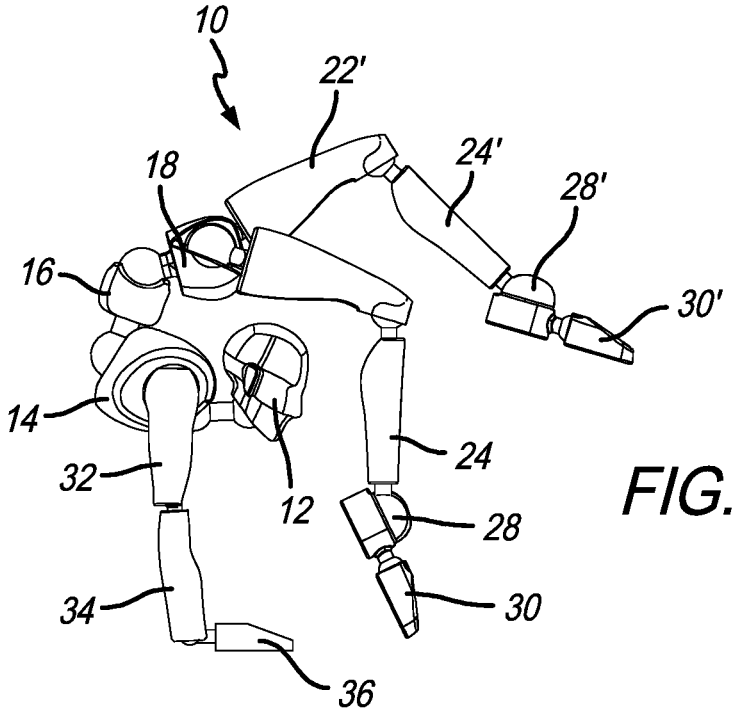
Figure 20:
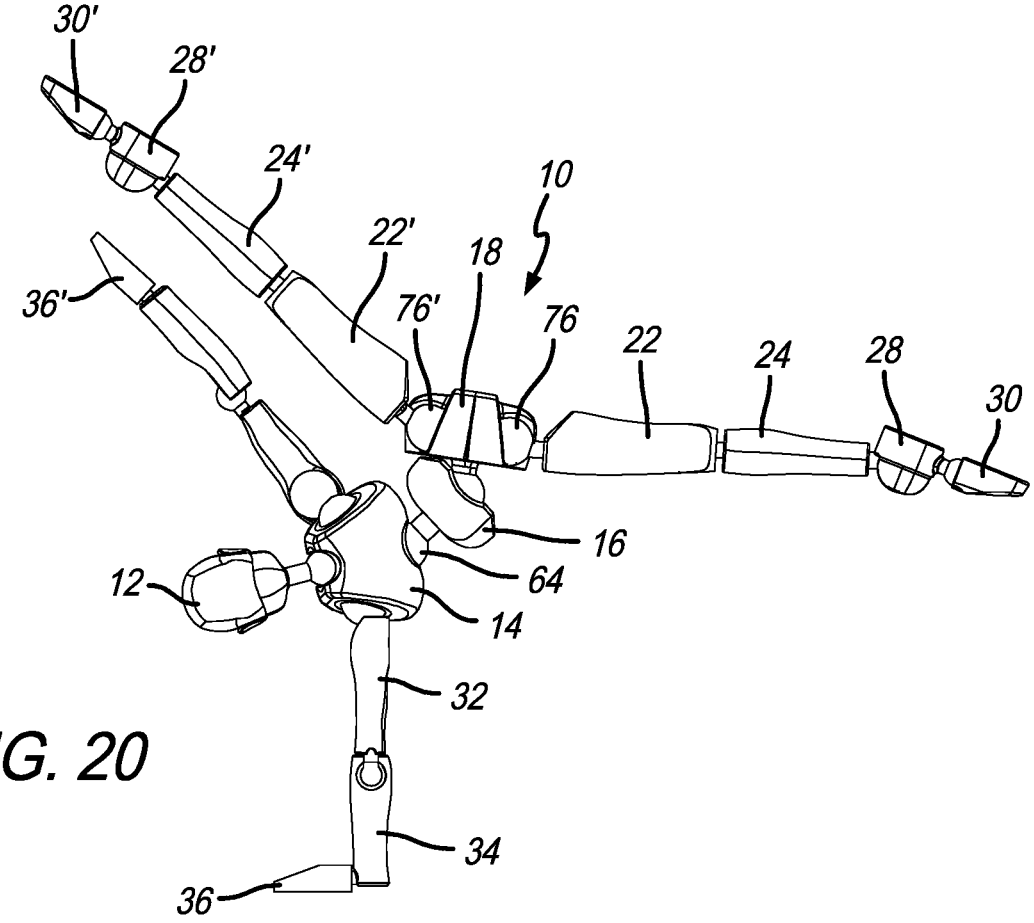
Figure 21:
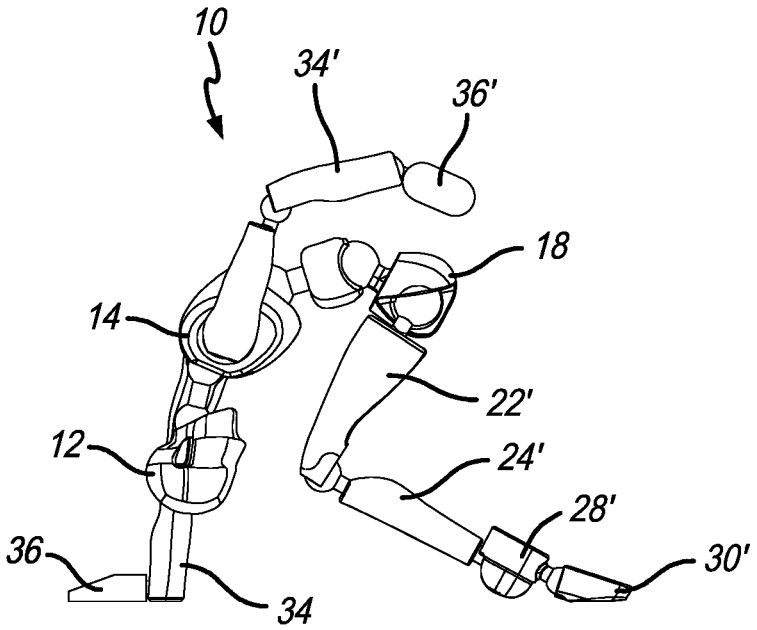
Figure 22:
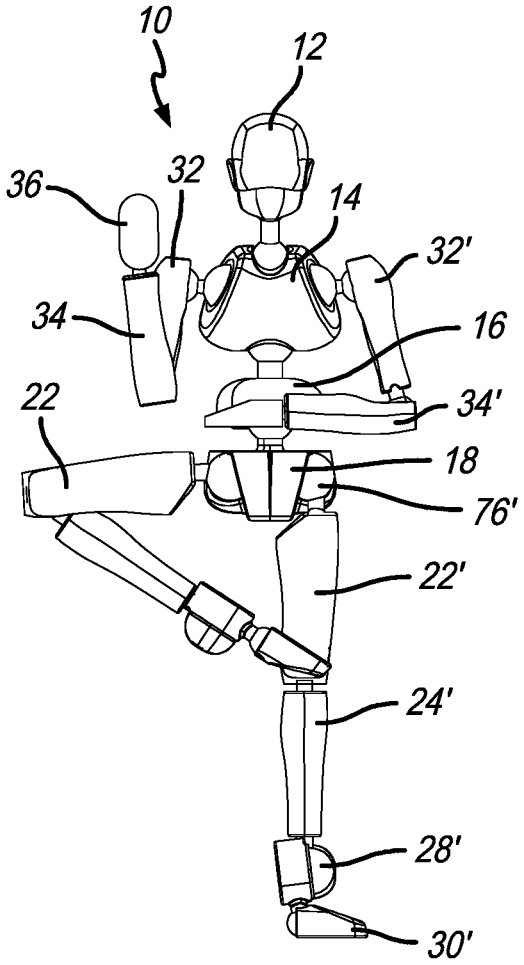
Figure 23:
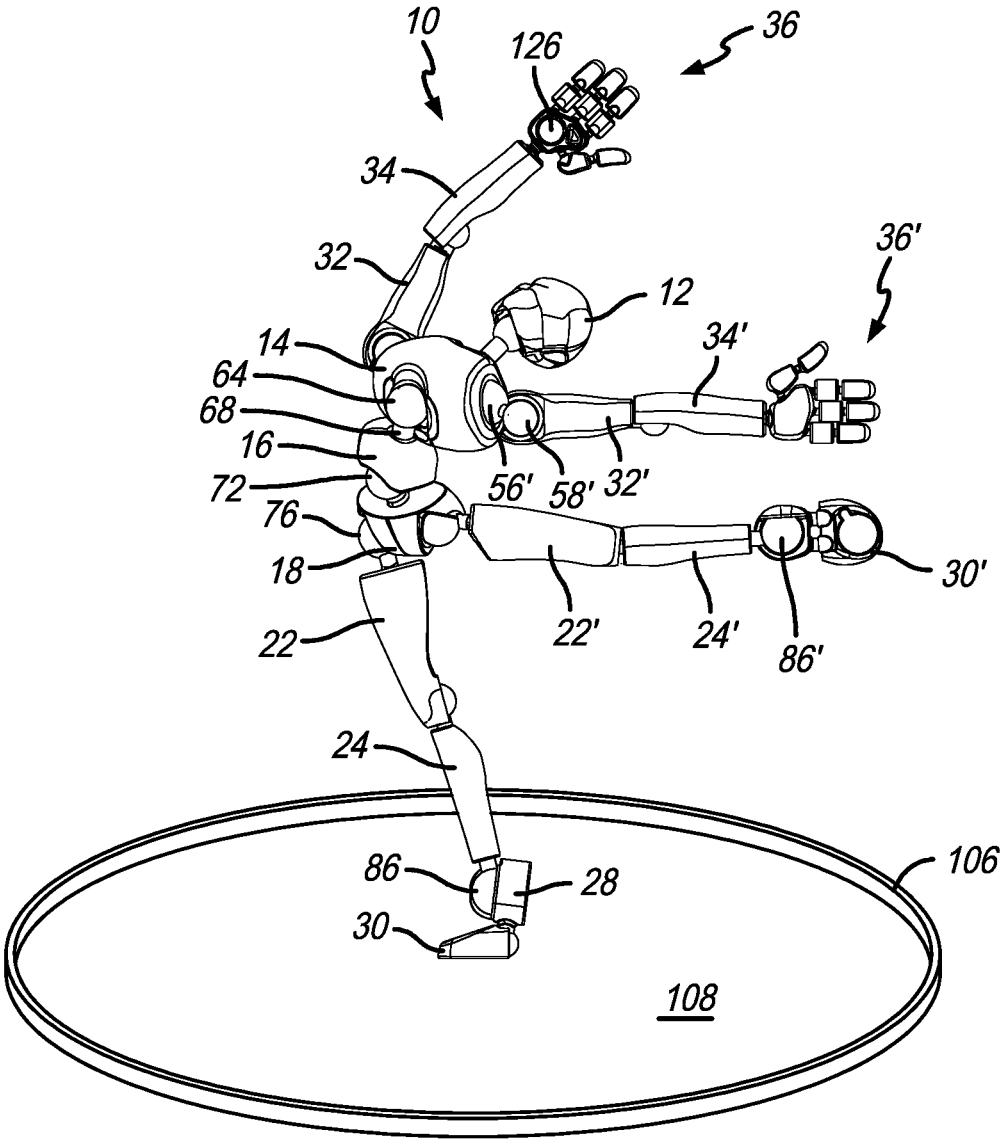
Figure 24:
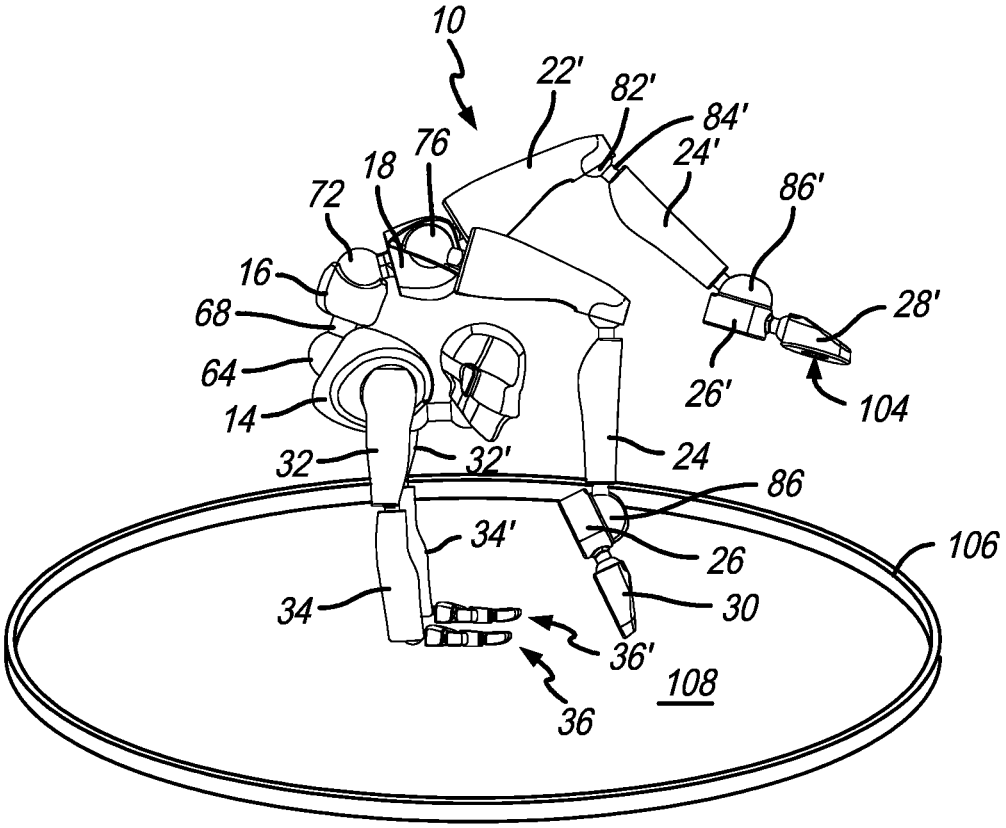
Figure 25:
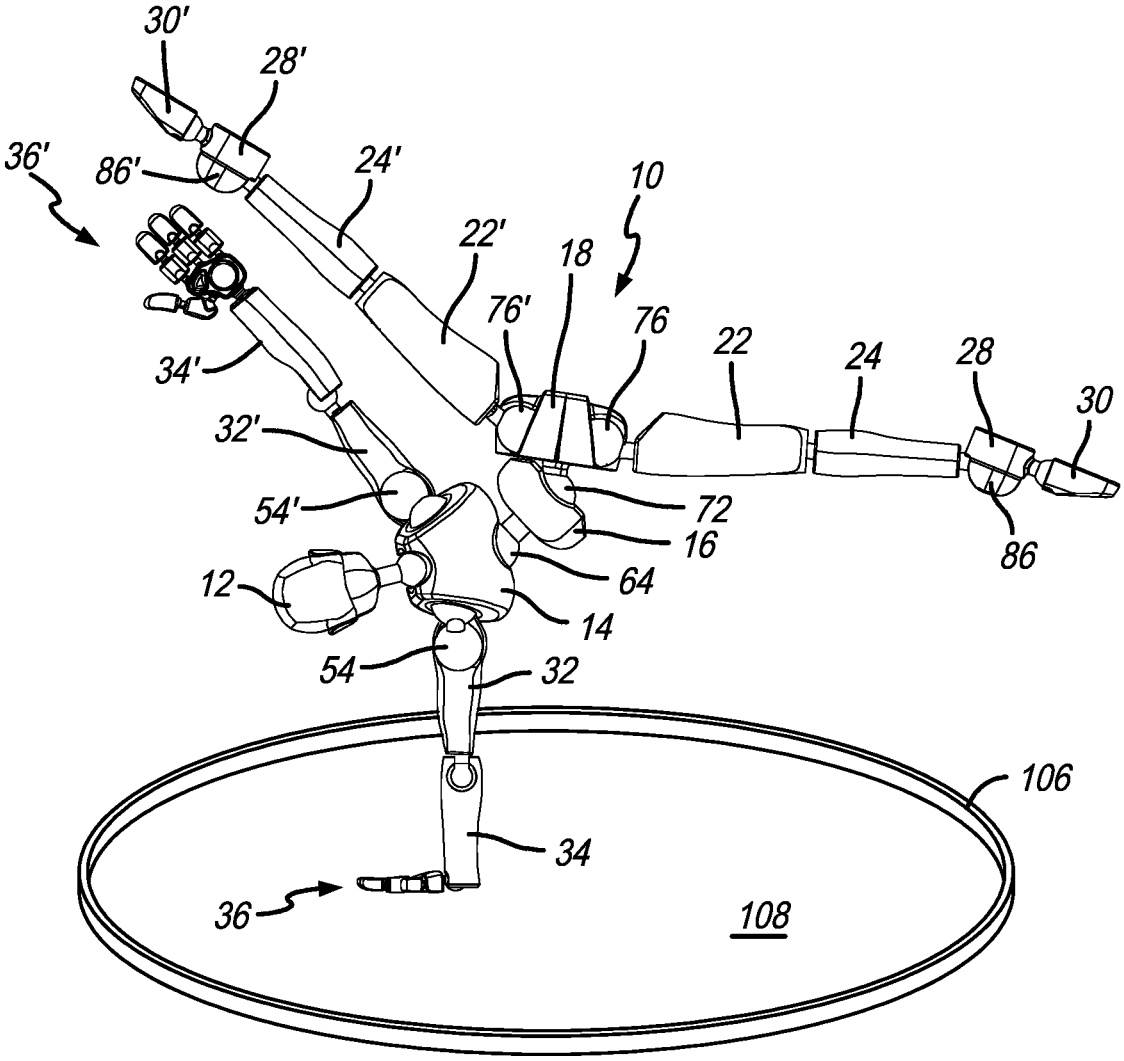
Figure 26:
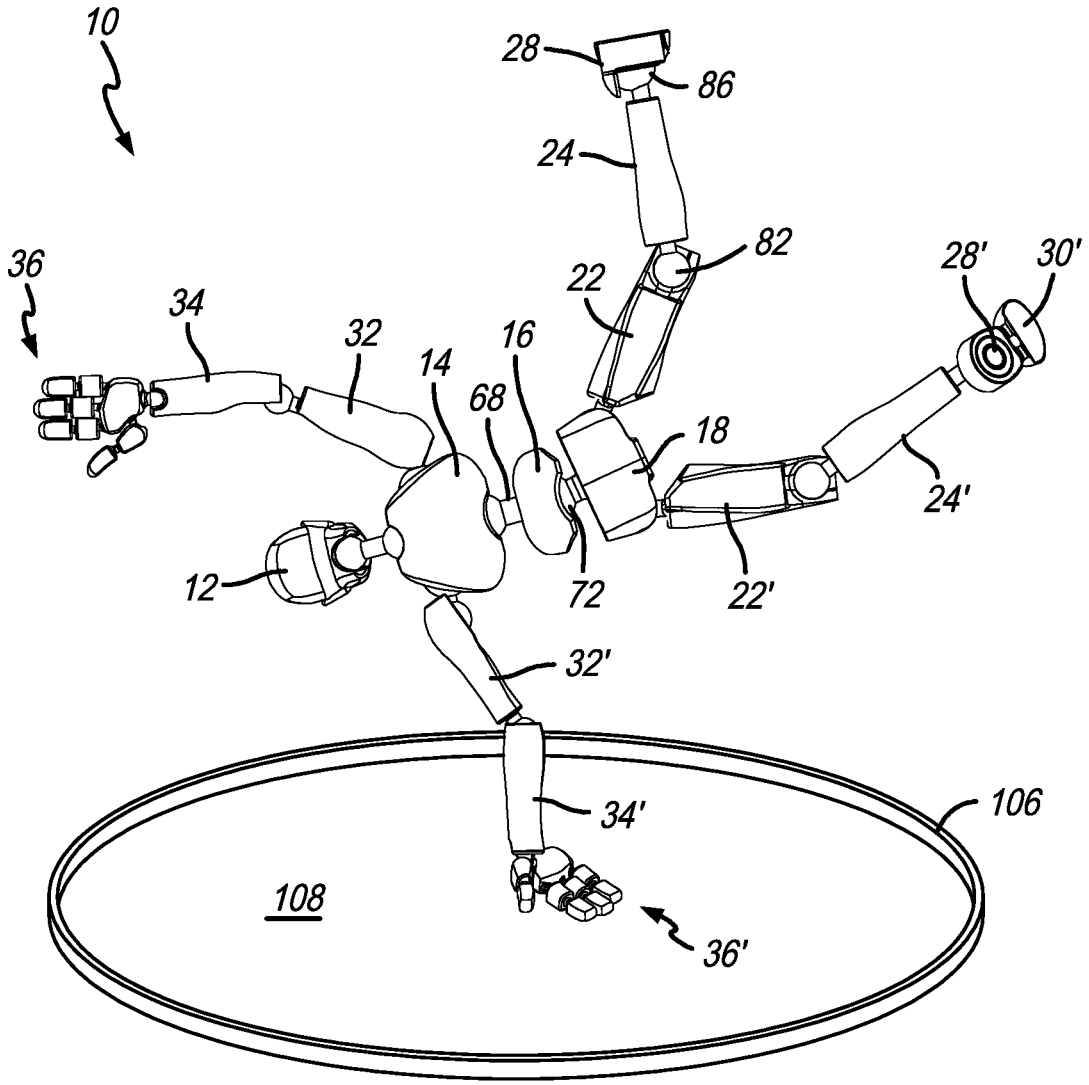
Figure 27:
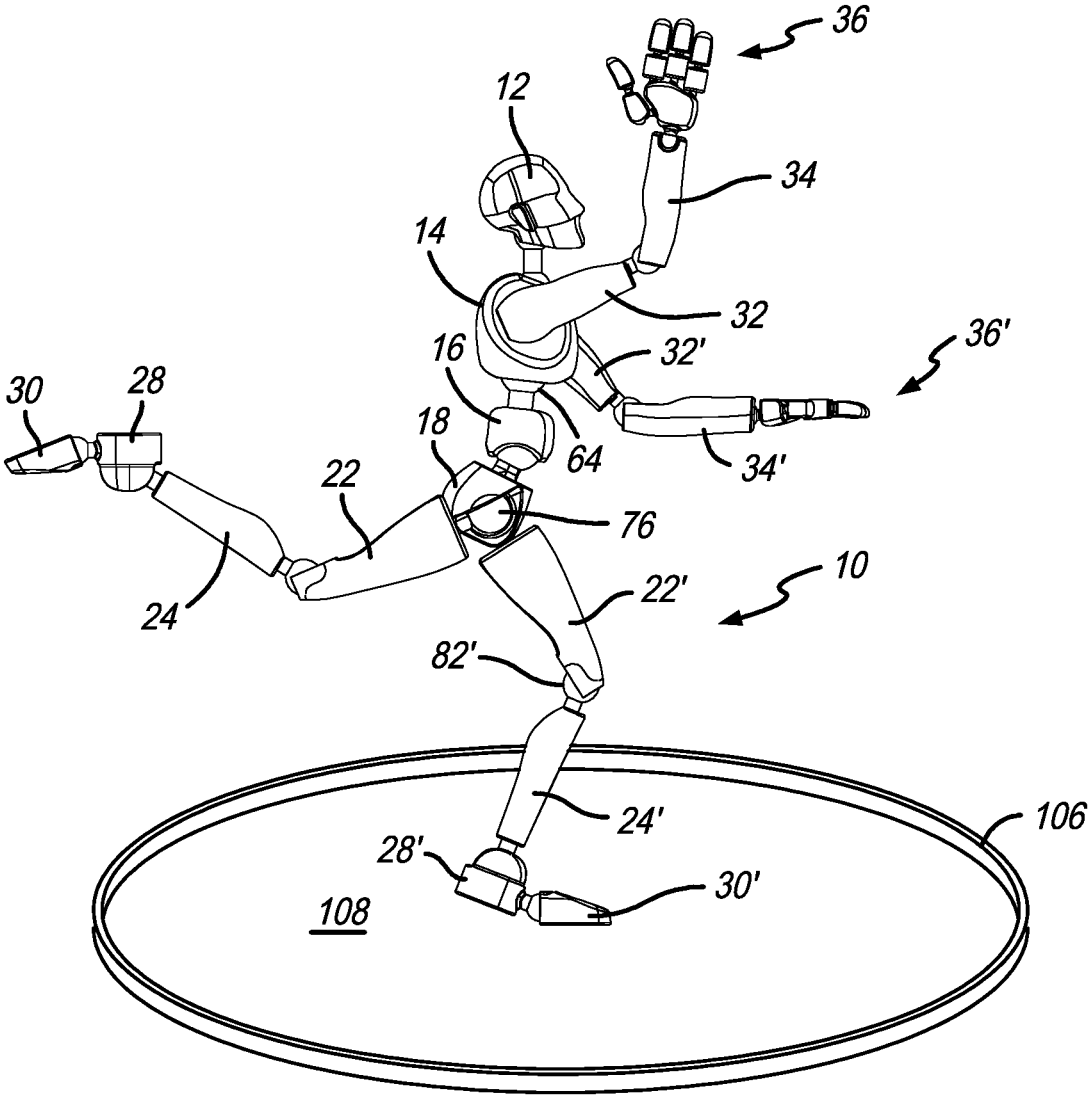
Figure 28:
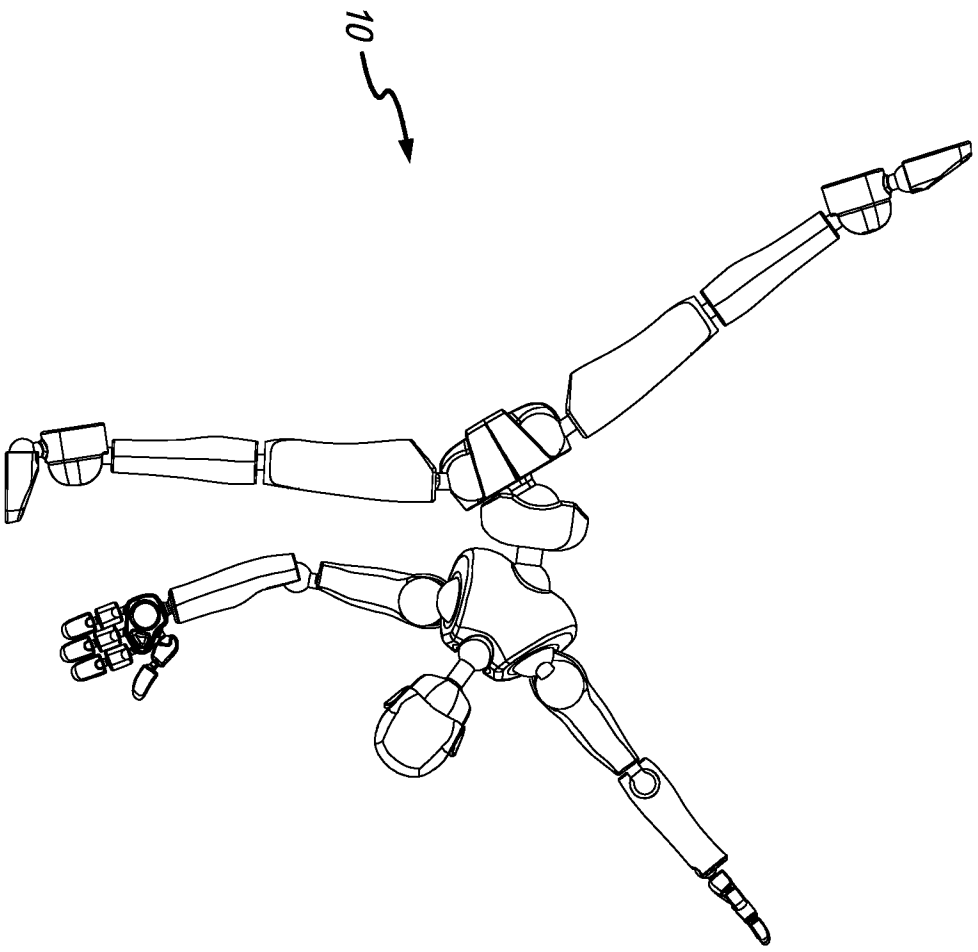
Figure 29:
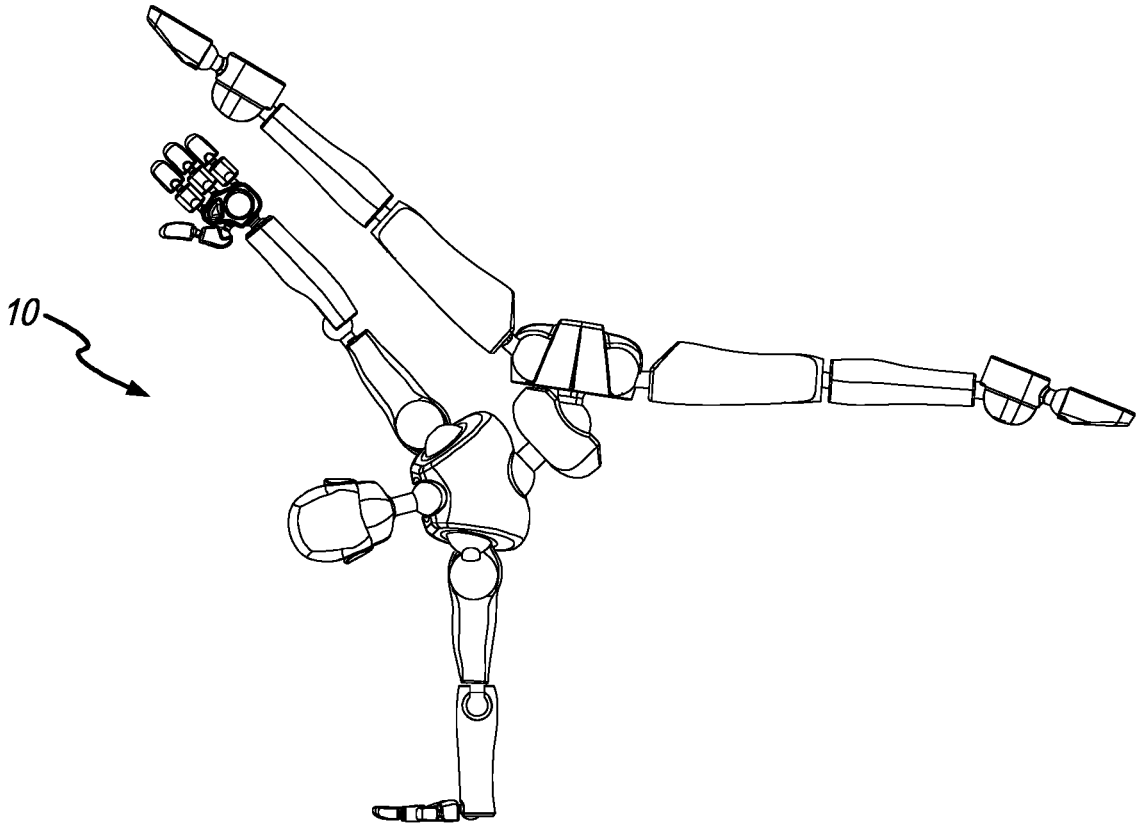
Figure 30:
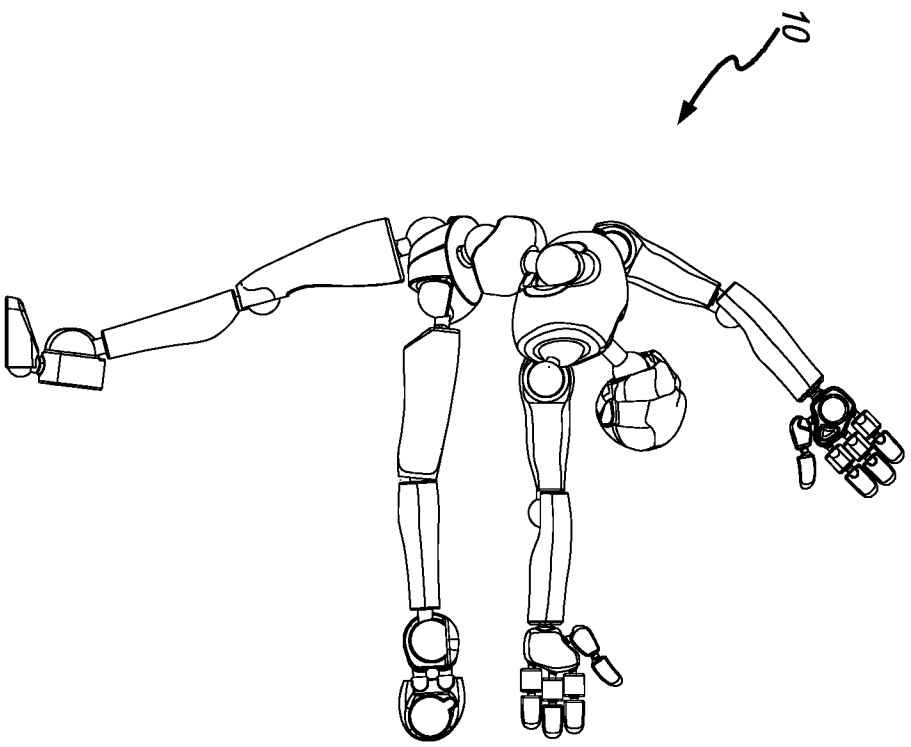
Figure 31:
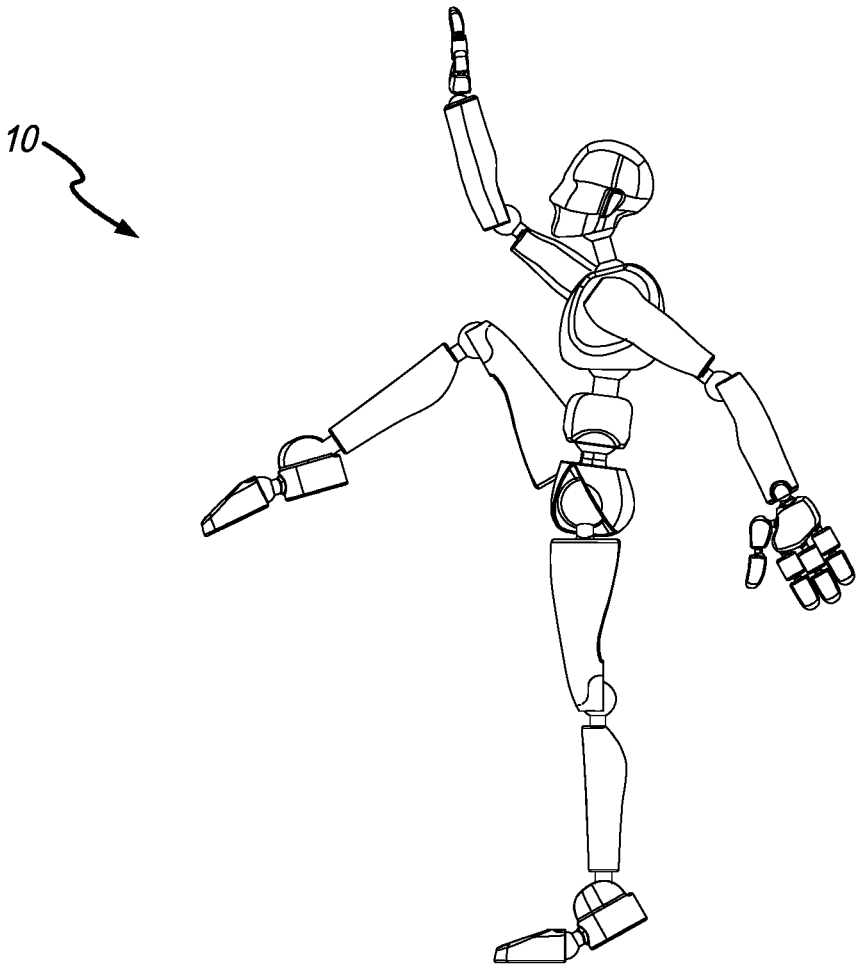
Figure 32:
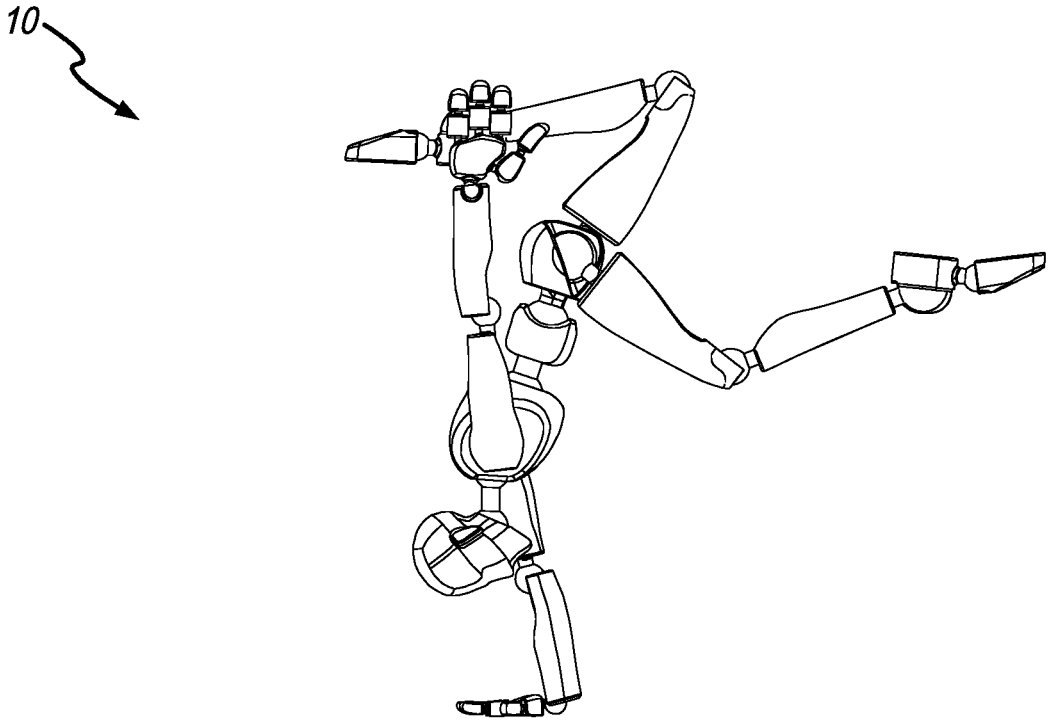
Figure 33:
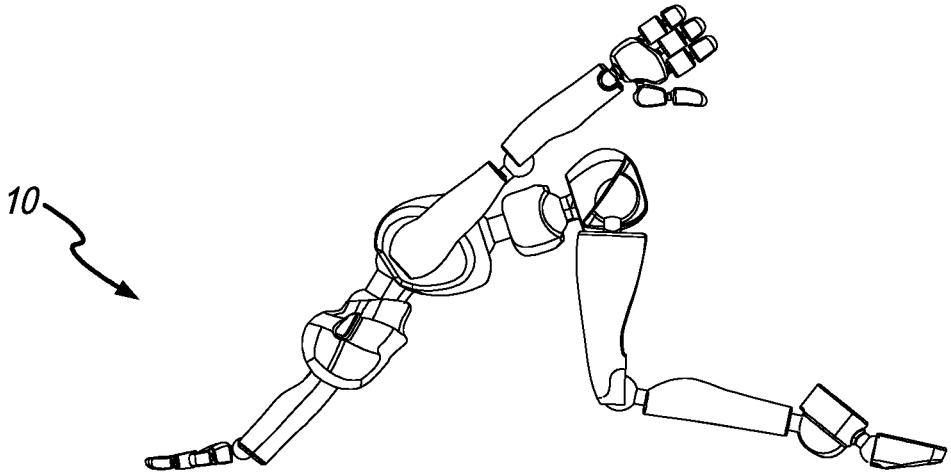
Figure 34:
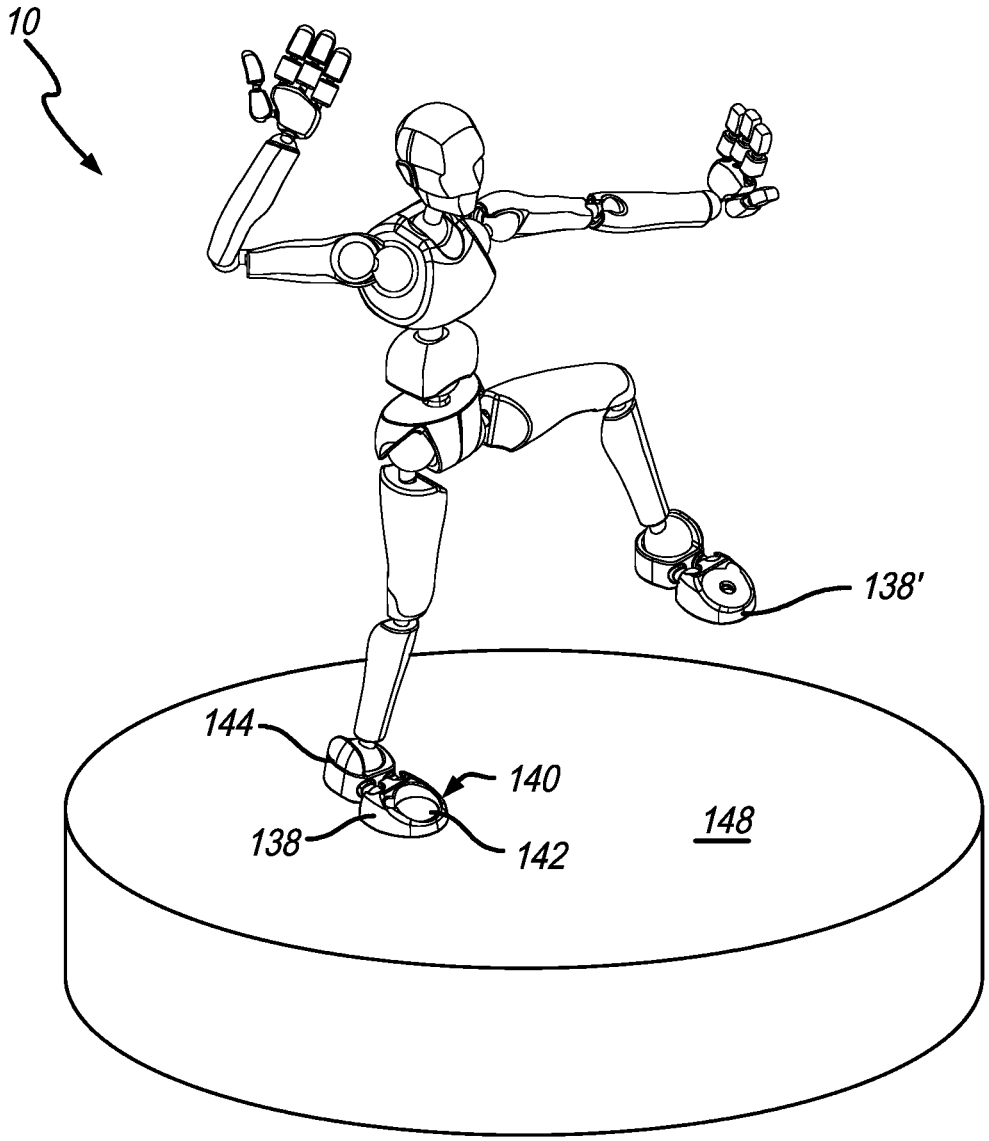
Figure 35:
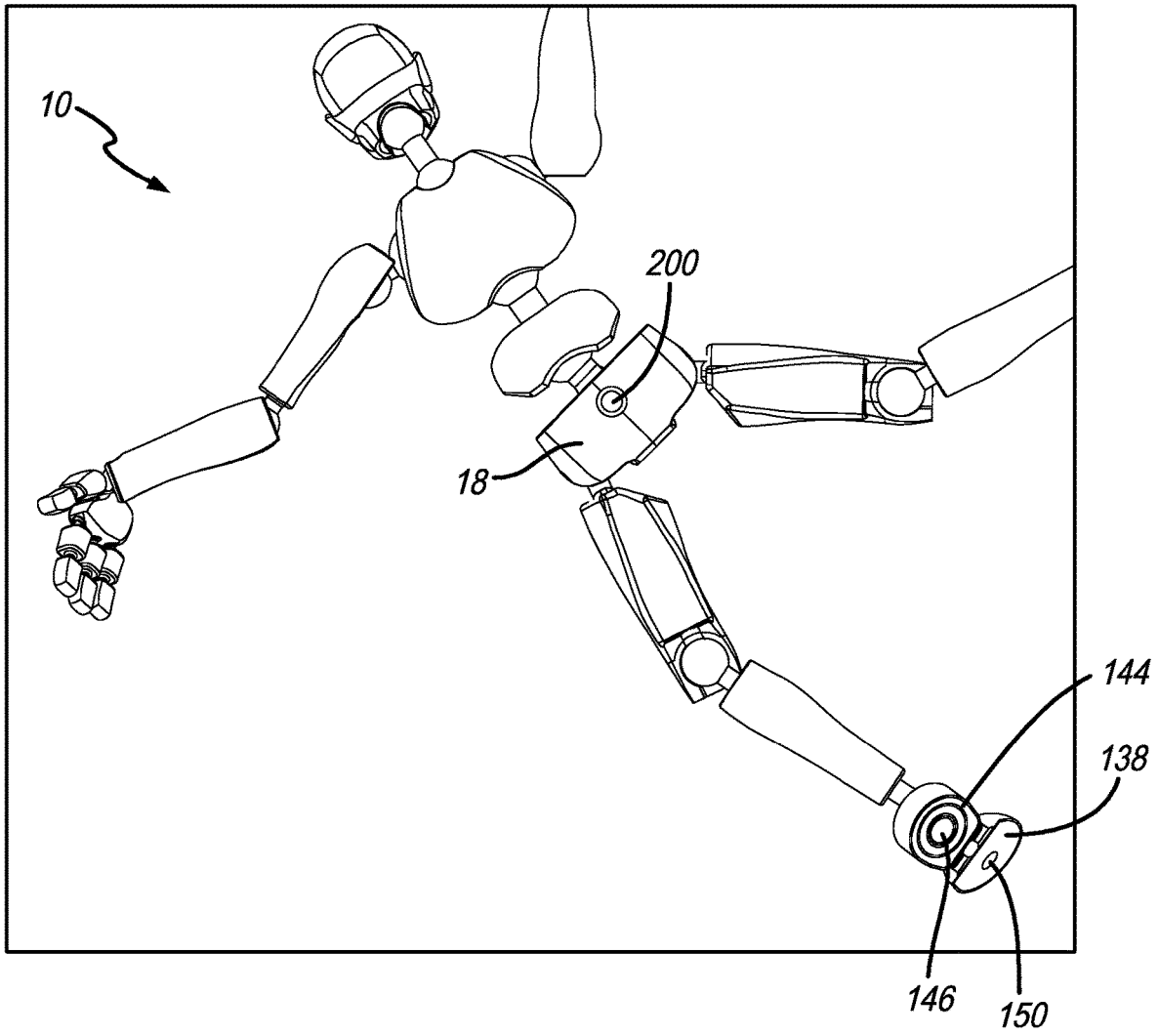
Figure 36:
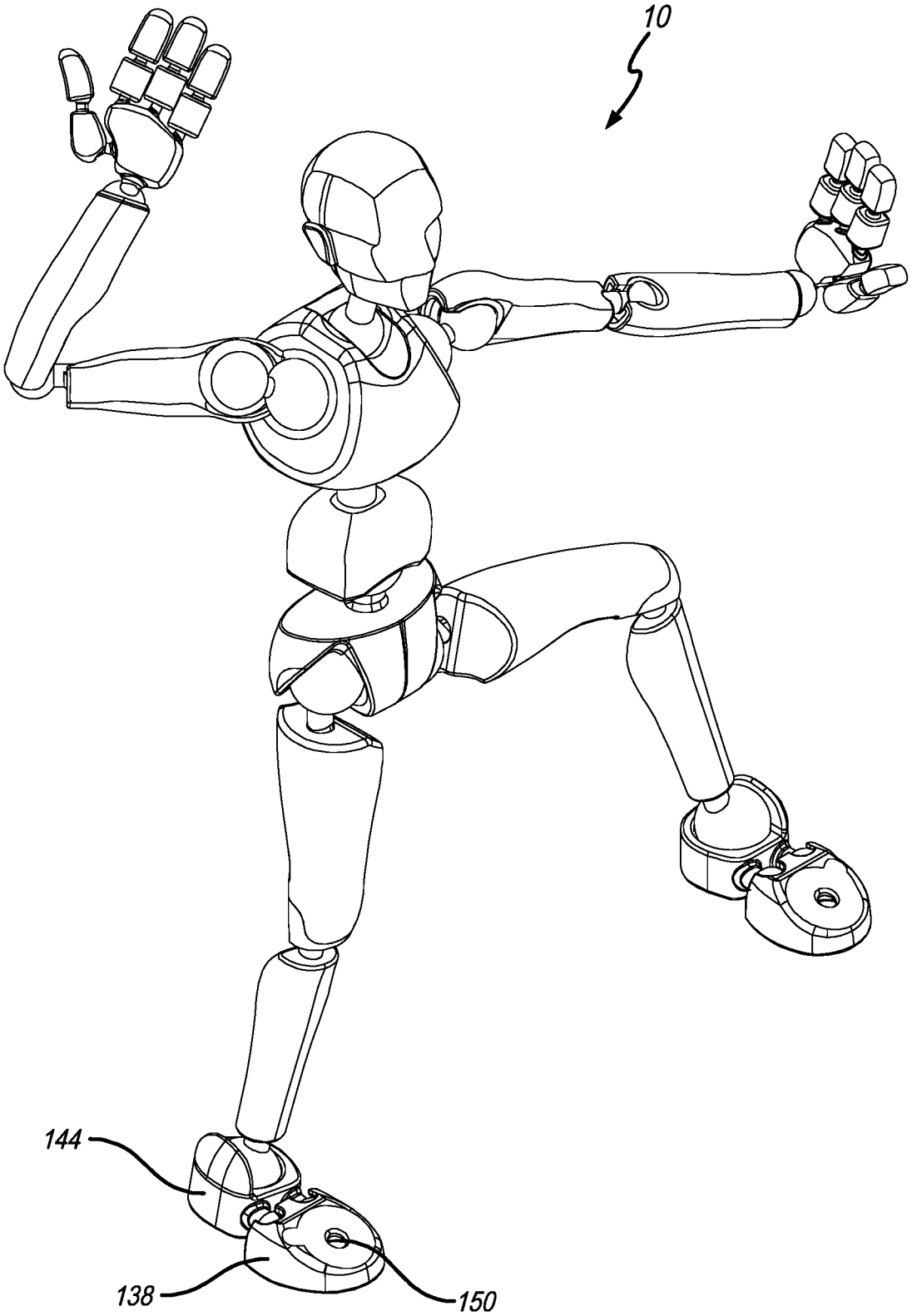
Figure 37:
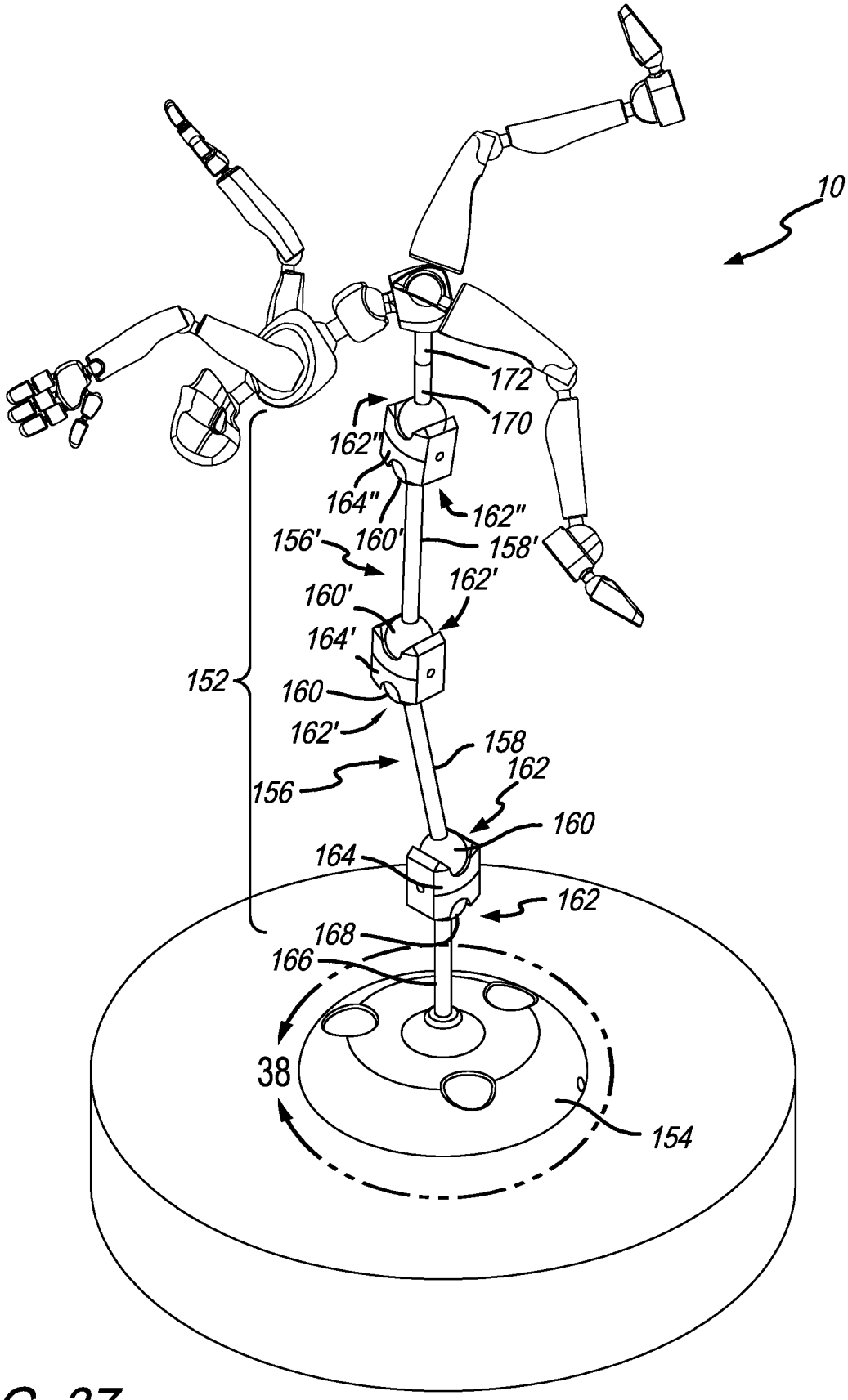
Figure 38:
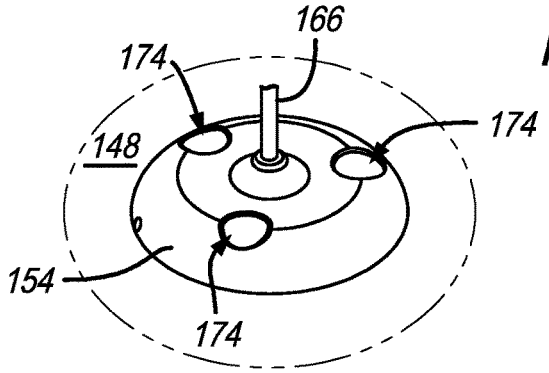
Figure 39:
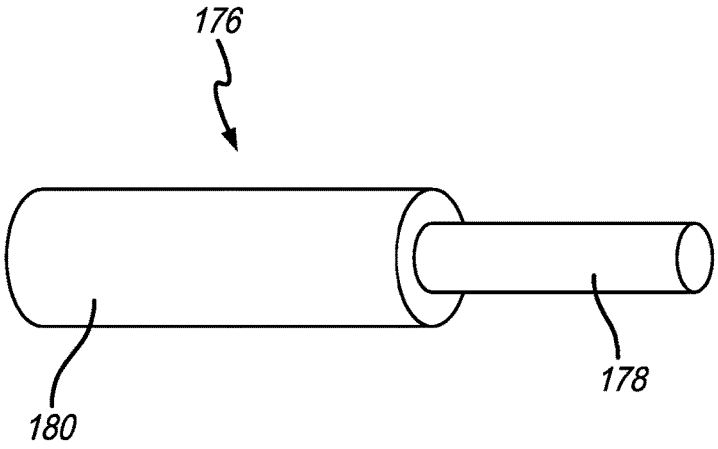
Figure 40:
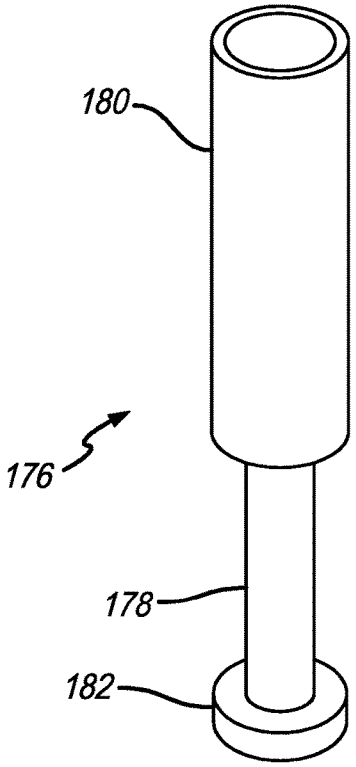
Figure 41:
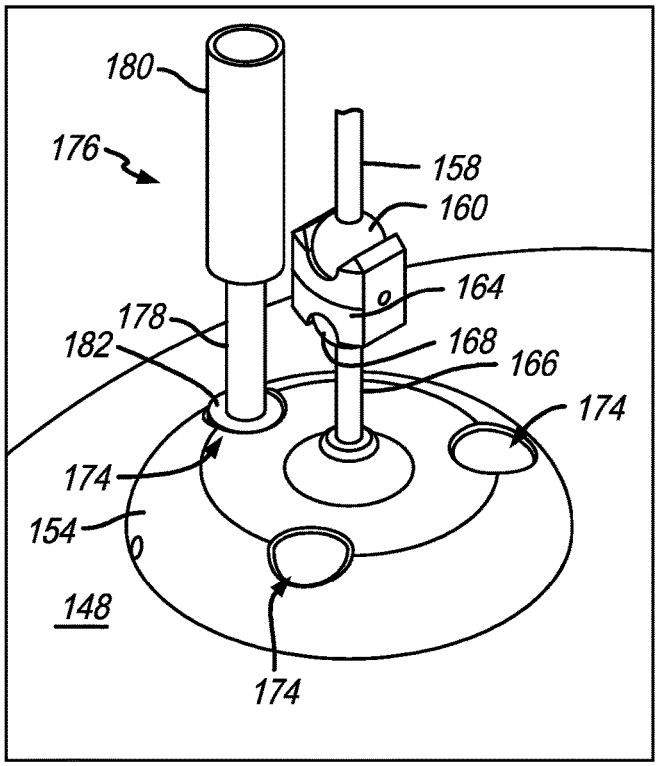
Figure 42:
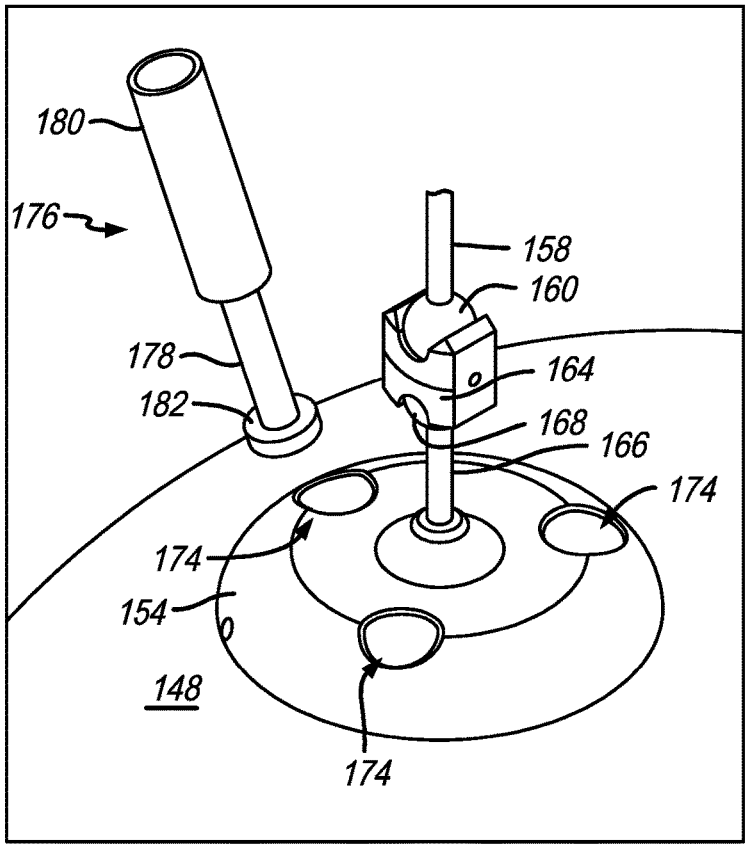
Figure 43:
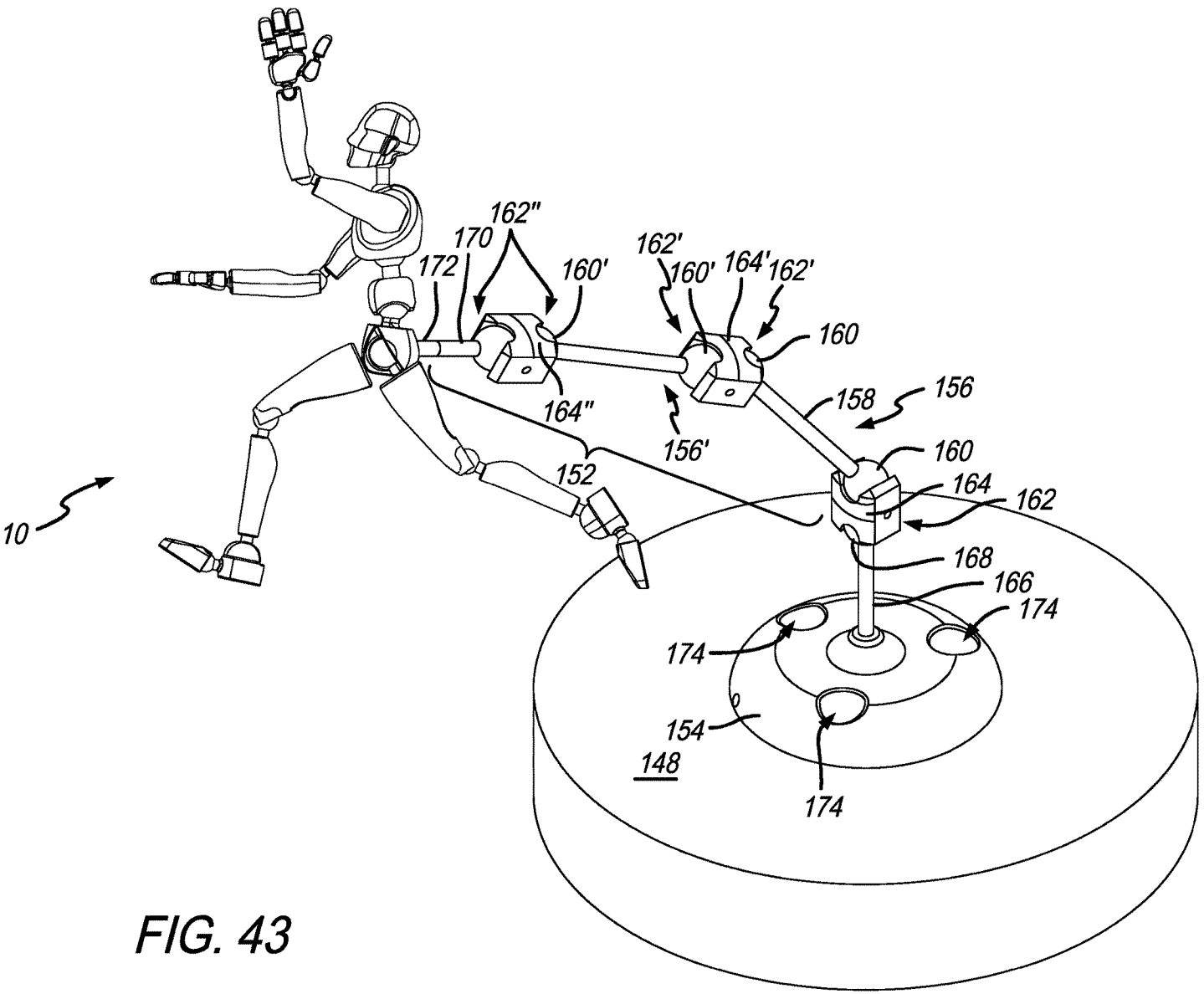
Figure 44:
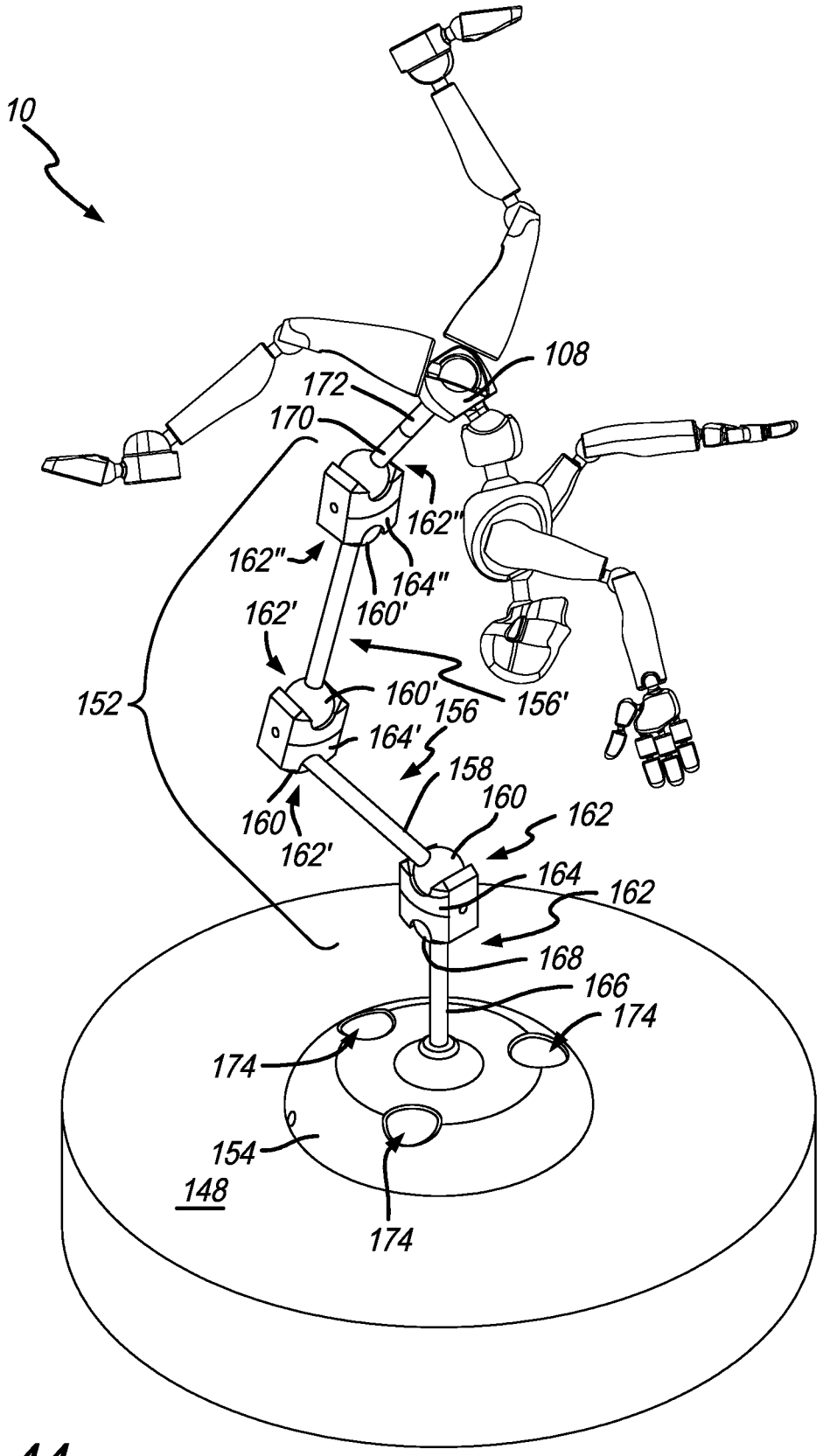
Figure 47:
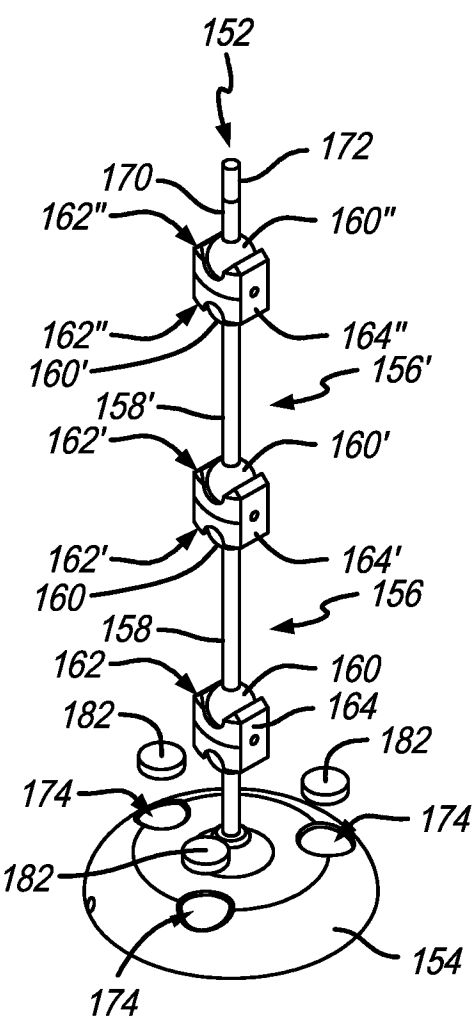
Figure 46:
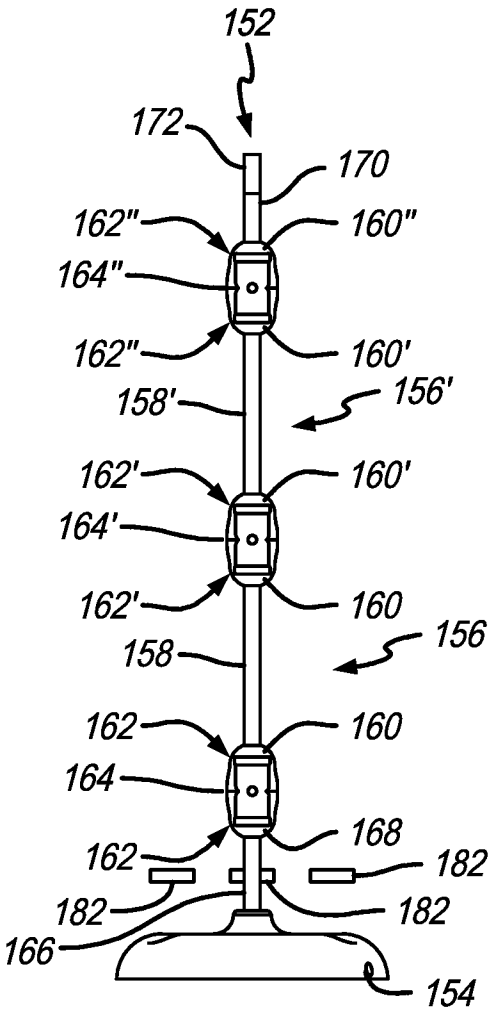
Figure 45:
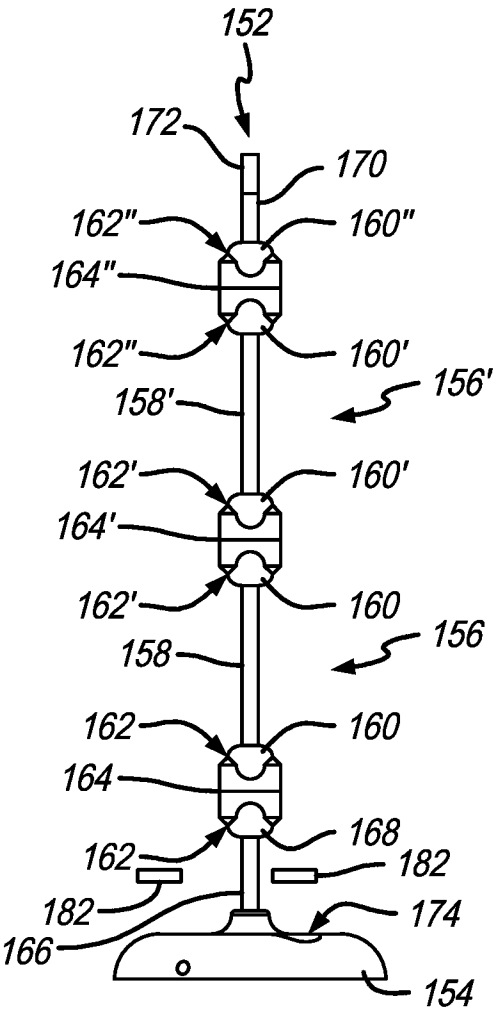
Figure 49:
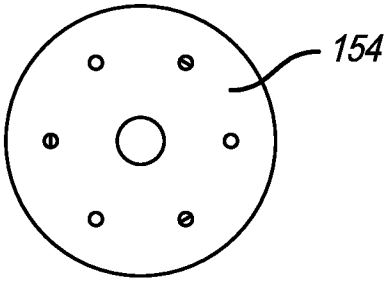
Figure 50:
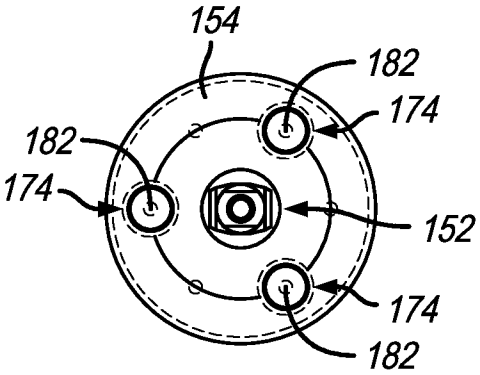
Figure 48:
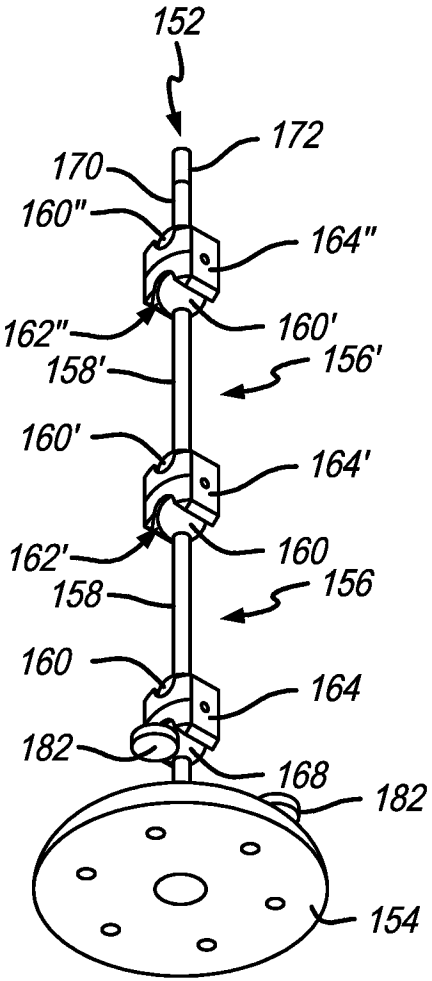
Figure 51A:
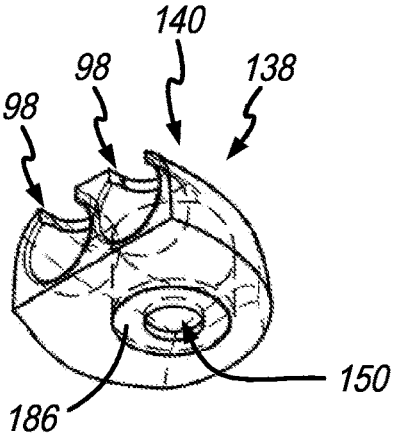
Figure 51B:
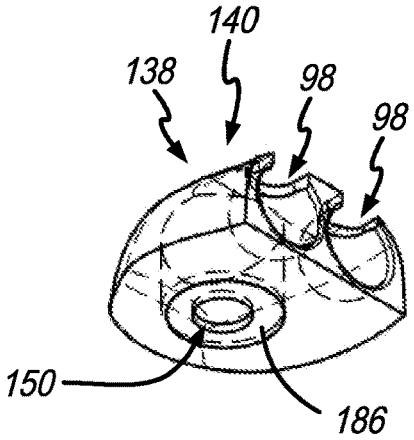
Figure 51C:
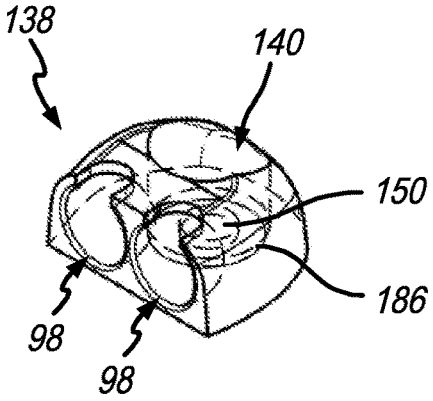
Figure 51D:
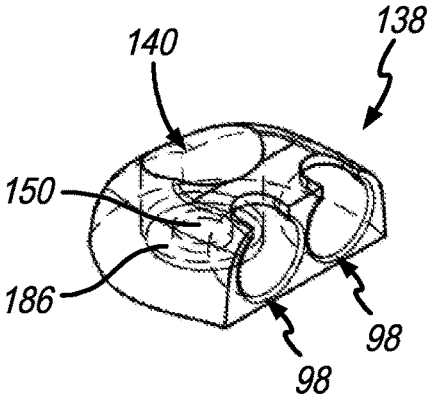
Figure 51E:
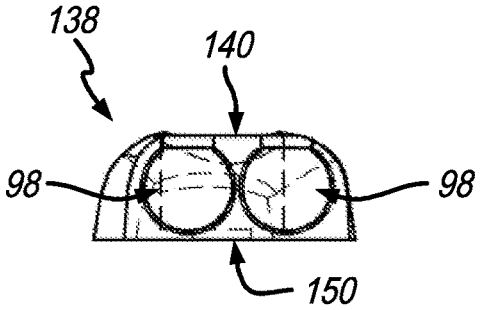
Figure 51F:
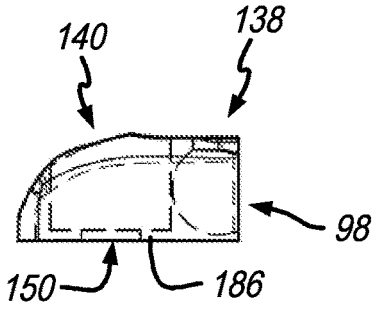
Figure 51G:
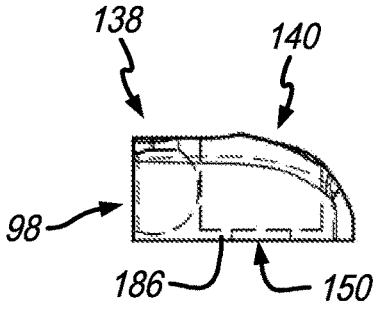
Figure 51H:
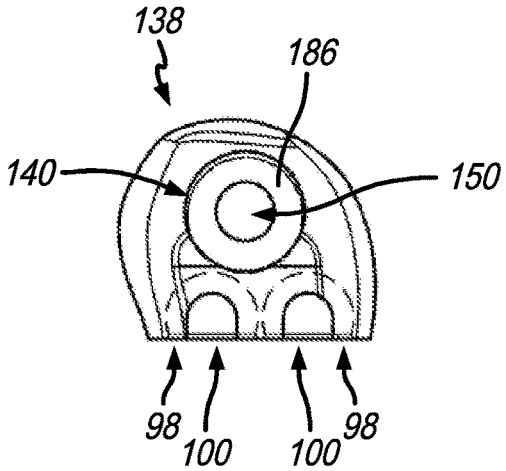
Figure 51I:
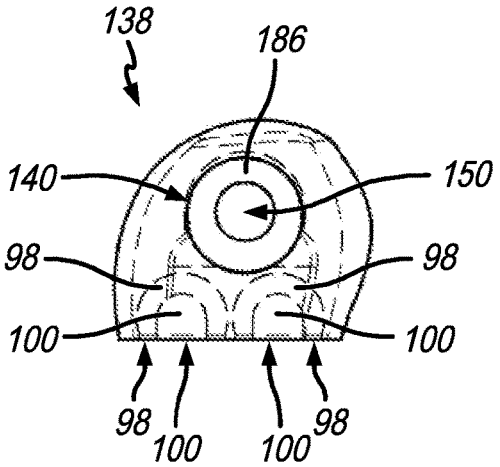
Figure 52A:
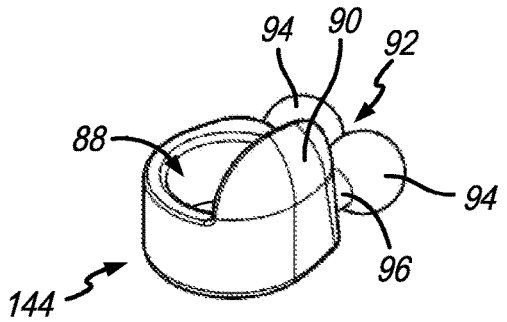
Figure 52B:
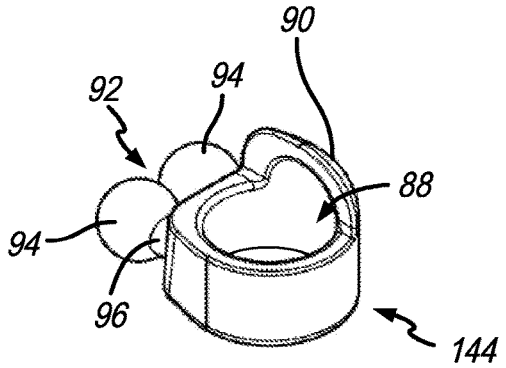
Figure 52C:
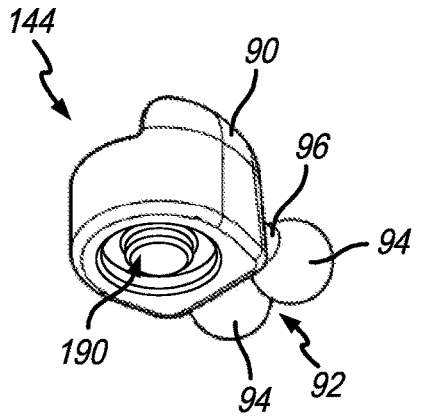
Figure 52D:
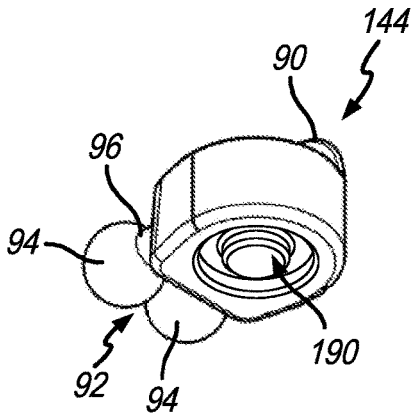
Figure 52E:
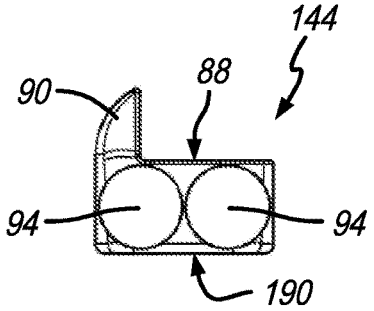
Figure 52F:
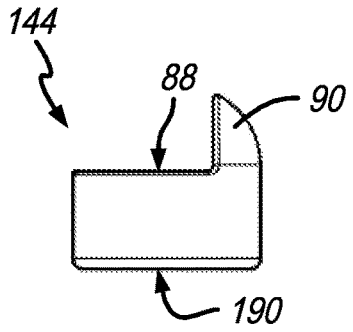
Figure 52G:
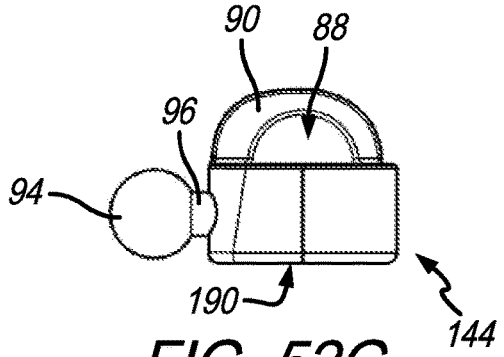
Figure 52H:
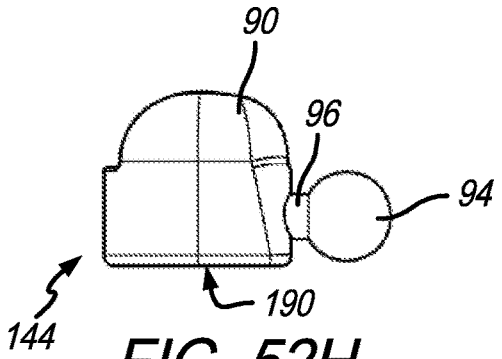
Figure 52I:
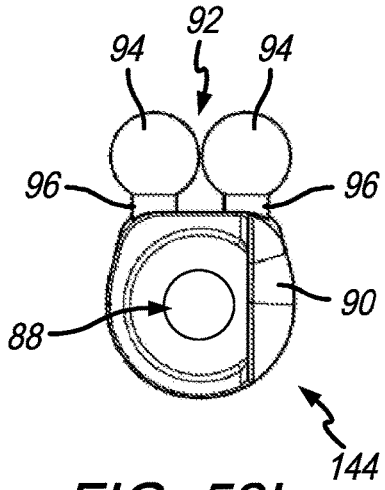
Figure 52J:
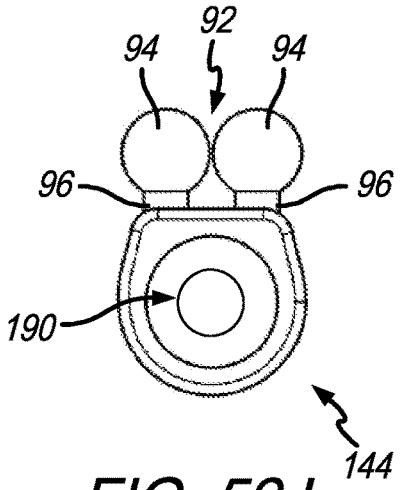
Figure 53A:
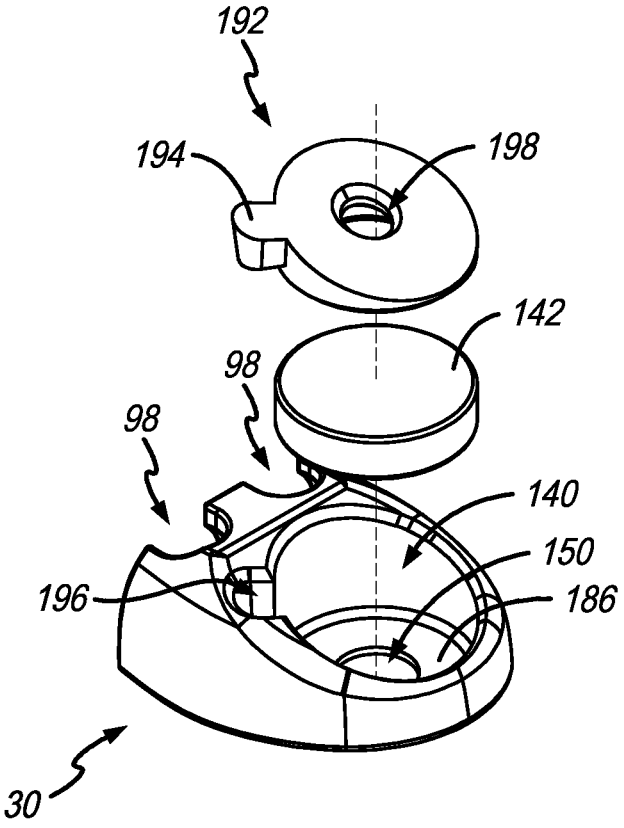
Figure 53B:
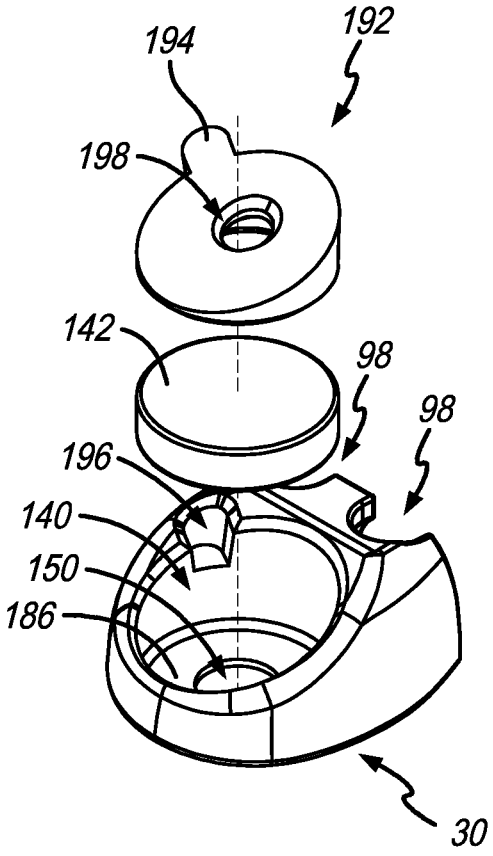
Figure 53C:
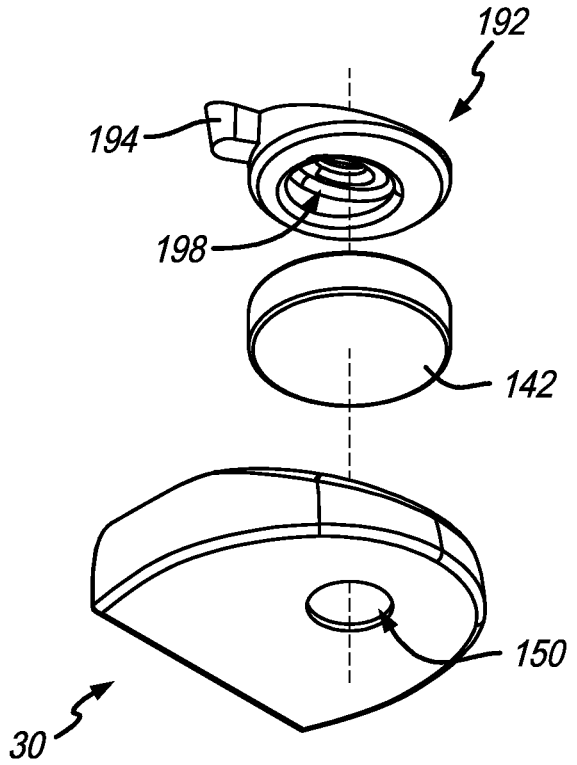
Figure 53D:
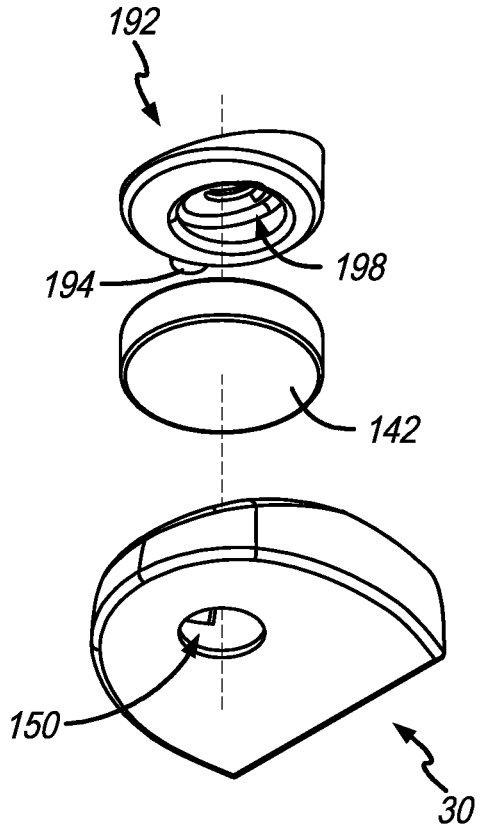
Figure 53E:
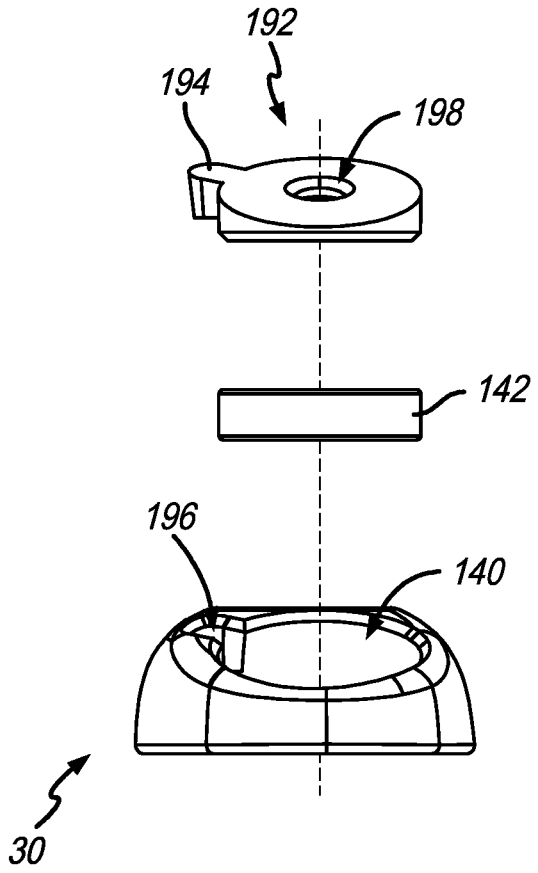
Figure 53F:
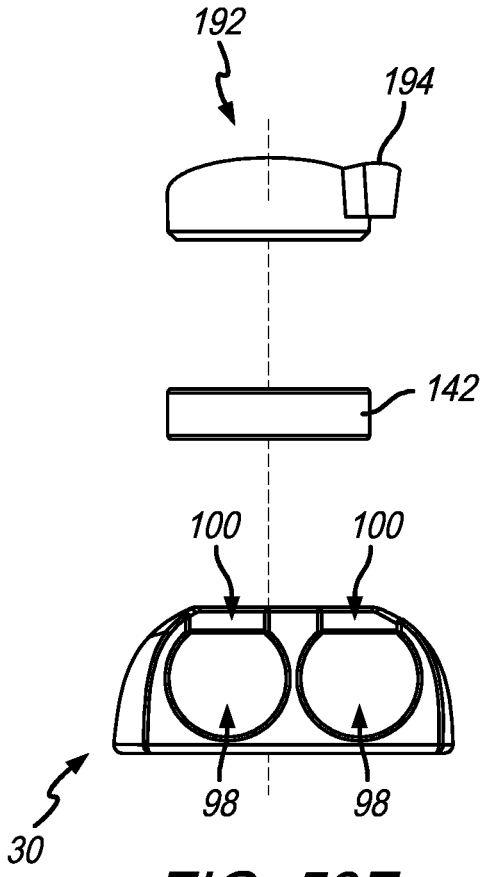
Figure 53G:
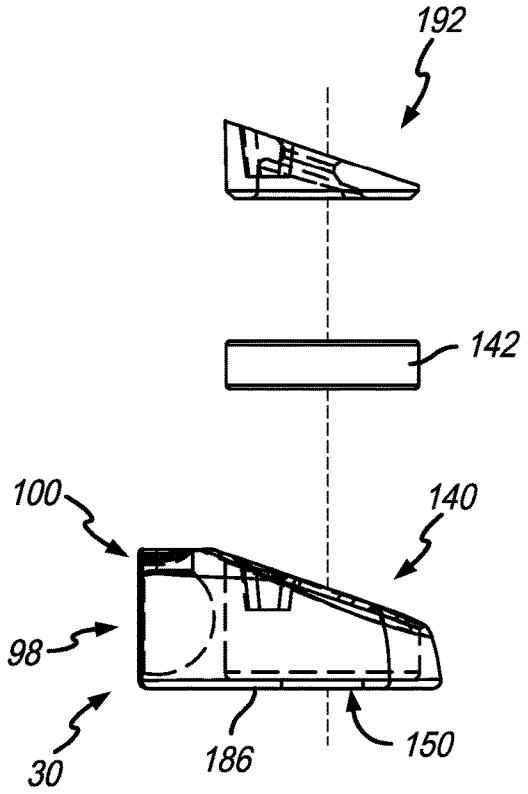
Figure 53H:
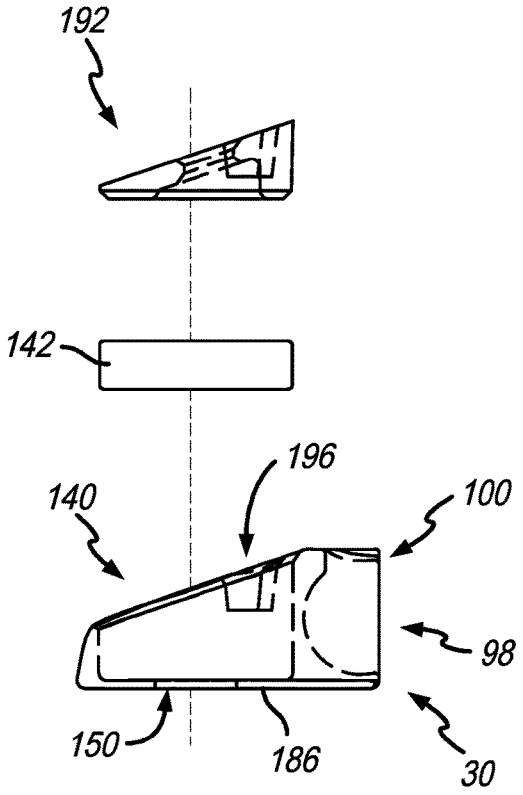
Figure 53I:
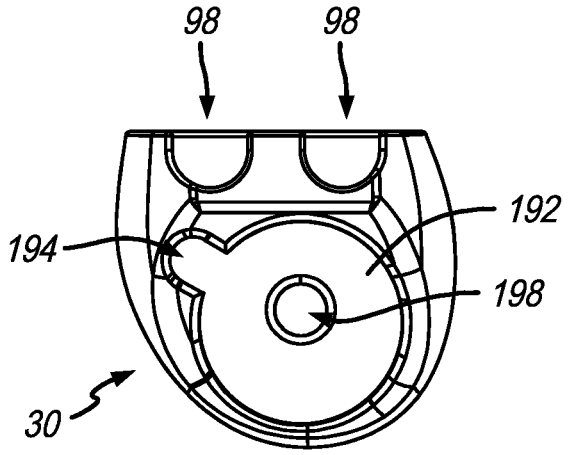
Figure 53J:
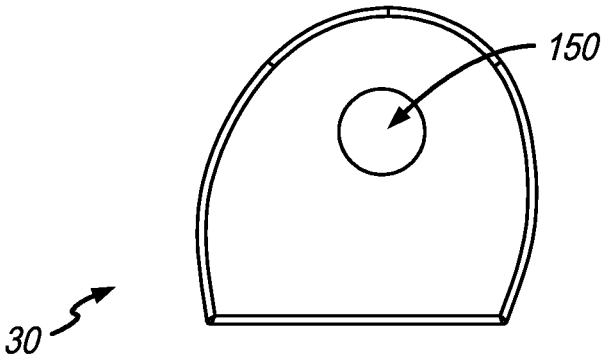

FIG. 15L is a right side elevation view of the left forearm of FIGS. 15B, 15D, 15F, and 15H;

FIG. 16A is a perspective view of the front, top and left sides of one embodiment of a hand of the animation puppet as disclosed herein;

FIG. 16B is a perspective view illustrating the front, top and right sides of the hand of FIG. 16A;

FIG. 16C is a perspective view illustrating the front, bottom and left sides of the hand of FIG. 16A;

FIG. 16D is a perspective view illustrating the front, bottom and right sides of the hand of FIG. 16A;

FIG. 16E is a front elevation view of the hand of FIGS. 16A-16D;

FIG. 16F is a right side elevation view of the hand of FIGS. 16A-16D;

FIG. 16G is a left side elevation view of the hand of FIGS. 16A-16D;

FIG. 16H is a top plan view of the hand of FIGS. 16A-16D;

FIG. 17 is a perspective side view of the animation puppet in one configuration of a standing position;

FIG. 18 is a perspective view of the animation puppet in another configuration standing on one leg with arms outstretched;

FIG. 19 is a perspective view of the animation puppet in another configuration standing on its hands;

FIG. 20 is a perspective view of the animation puppet in another configuration standing on one arm with legs outstretched;

FIG. 21 is a perspective view of the animation puppet in another configuration bent over;

FIG. 22 is a perspective view of the animation puppet in another configuration standing in one leg in a tree pose;

FIG. 23 is a perspective view of the animation puppet in a configuration similar to FIG. 18;

FIG. 24 is a perspective view of the animation puppet in a configuration similar to FIG. 19;

FIG. 25 is a perspective view of the animation puppet in a configuration similar to FIG. 20;

FIG. 26 is a perspective view of the animation puppet in another configuration similar to FIGS. 20 and 25;

FIG. 27 is a perspective view of the animation puppet in yet another position;

FIG. 28 is a perspective view of the animation puppet in another position;

FIG. 29 is a perspective view of the animation puppet in yet another position;

FIG. 30 is a perspective view of the animation puppet in another position;

FIG. 31 is a perspective view of the animation puppet in yet another position;

FIG. 32 is a perspective view of the animation puppet in another position;

FIG. 33 is a perspective view of the animation puppet in yet another position;

FIG. 34 is an environmental perspective view of the animation puppet coupled to a mounting surface by way of a drop-down magnet within an alternative toe;

FIG. 35 is an environmental bottom perspective view, more specifically illustrating the alternative toe of FIG. 34;

FIG. 36 is an environmental top perspective view, more specifically illustrating an aperture extending through the thickness of the alternative toe of FIG. 34;

FIG. 37 is an environmental perspective view illustrating the animation puppet coupled to an extension rig supported by an underlying base;

FIG. 38 is an enlarged environmental perspective view of the base, taken about the circle 38 in FIG. 37;

FIG. 39 is a perspective view of a installation rod having an insertion section relatively smaller in diameter than a removal section;

FIG. 40 is a perspective view of the insertion section of the installation rod magnetically attached to a magnetic disk;

FIG. 41 is an environmental perspective view illustrating inserting the magnetic disk into one of a plurality of magnet receiving chambers in the base;

FIG. 42 is an environmental perspective view illustrating removing the magnetic disk from one of the magnet receiving chambers in the base with the removal section of the installation rod;

FIG. 43 is an environmental perspective view illustrating the animation puppet coupled to an extension rig extending up from the base, which is magnetically coupled to a mounting surface by way of magnetic disks inserted into one or more of the magnet receiving chambers;

FIG. 44 is an environmental perspective view illustrating the animation puppet in a different position through manipulation of the extension rig;

FIG. 45 is a front elevation view of the extension rig coupled to the base, further illustrating two magnetic disks in exploded relation relative to their respective magnetic receiving chambers;

FIG. 46 is a side elevation view of the extension rig coupled to the base, with three magnetic disks shown in exploded relation relative to the base;

FIG. 47 is a top perspective view of the extension rig coupled to the base, with three magnetic disks shown in exploded relation relative to their respective magnetic receiving chambers;

FIG. 48 is a bottom perspective view of the extension rig coupled to the base, further illustrate a bottom of the base;

FIG. 49 is a bottom plan view of the base;

FIG. 50 is a top plan view of the extension rig coupled to the base, illustrating relative placement of the magnets in their respective magnet receiving chambers at equidistant positions around the periphery of the base;

FIG. 51A is a perspective view of the front, top and left sides of an alternative embodiment of the toe of the animation puppet as disclosed herein;

FIG. 51B is a perspective view illustrating the front, top and right sides of the alternative toe of FIG. 51A;

FIG. 51C is a perspective view illustrating the rear, top and left sides of the alternative toe of FIG. 51A;

FIG. 51D is a perspective view illustrating the rear, top and right sides of the alternative toe of FIG. 51A;

FIG. 51E is a rear elevation view of the alternative toe of FIGS. 51A-51D;

FIG. 51F is a right side elevation view of the alternative toe of FIGS. 51A-51D;

FIG. 51G is a left side elevation view of the alternative toe of FIGS. 51A-51D;

FIG. 51H is a top plan view of the alternative toe of FIGS. 51A-51D;

FIG. 51I is a bottom plan view of the alternative toe of FIGS. 51A-51D;

FIG. 52A is a perspective view of the rear, top and left sides of an alternative embodiment of the heel of the animation puppet as disclosed herein;

FIG. 52B is a perspective view illustrating the rear, top and right sides of the heel of FIG. 52A;

FIG. 52C is a perspective view illustrating the rear, bottom and left sides of the heel of FIG. 52A;

FIG. 52D is a perspective view illustrating the rear, bottom and right sides of the heel of FIG. 52A;

FIG. 52E is a front elevation view of the heel of FIGS. 52A-52D;

FIG. 52F is a rear elevation view of the heel of FIGS. 52A-52D;

FIG. 52G is a right side elevation view of the heel of FIGS. 52A-52D;

FIG. 52H is a left side elevation view of the heel of FIGS. 52A-52D;

FIG. 52I is a top plan view of the heel of FIGS. 52A-52D;

FIG. 52J is a bottom plan view of the heel of FIGS. 52A-52D;

FIG. 53A is an exploded perspective view of the front, top and left sides of one embodiment of a toe of the animation puppet, including a keyed cap for a magnet receiving chamber;

FIG. 53B is an exploded perspective view illustrating the front, top and right sides of the toes of FIG. 53A;

FIG. 53C is an exploded perspective view illustrating the front, bottom and left sides of the toe of FIG. 53A;

FIG. 53D is an exploded perspective view illustrating the front, bottom and right sides of the toe of FIG. 53A;

FIG. 53E is an exploded front elevation view of the toe of FIGS. 53A-53D;

FIG. 53F is an exploded rear elevation view of the toe of FIGS. 153A-53E;

FIG. 53G is an exploded left side elevation view of the toe of FIGS. 153A-53F;

FIG. 53H is an exploded right side elevation view of the toe of FIGS. 153A-53G;

FIG. 53I is a top plan view of the toe of FIGS. 53A-53H;

FIG. 53J is a bottom plan view of the toe of FIGS. 53A-53I; and

Figure 54:
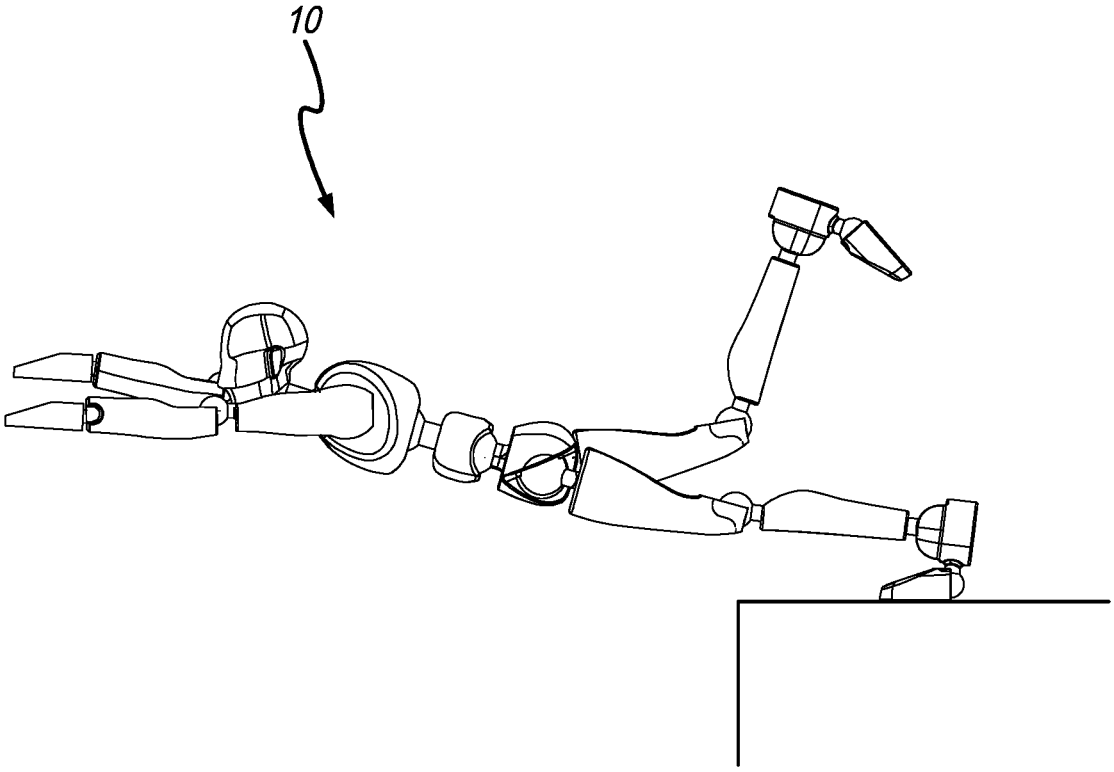

FIG. 54 is another alternative perspective view of an embodiment of the animation puppet as disclosed herein.

DETAILED DESCRIPTION OF THE PREFERRED EMBODIMENTS

As shown in the drawings for purposes of illustration, the present invention for an animation puppet is shown with respect to FIGS. 1A-1E and 17-27 with reference to numeral 10. As described in more detail below, the animation puppet 10 was developed from the ground up so that animators can more easily and quickly reposition the animation puppet 10 with greater consistency and precision to maximize a wide range of motion and articulation, thereby enhancing the ability to position the animation puppet 10 into expressive poses. Preferably, the joint rotation replicates the fluid and wide range of movement of humans, simulating both the limitations and the flexibility of human body mechanics, and in some cases, the joints are able to extend beyond the range of natural human joint motion so that the animation puppet 10 can be used to exaggerate natural human motion. The animation puppet 10 is able to consistently and repeatedly attain these precision-based poses, which can be held for an extended duration, and possibly indefinitely. In addition to creating stop-motion animation, the animation puppet 10 may enable animators and artists to more quickly explore ideas, by more quickly and accurately positioning the animation puppet 10 in a highly tactile manner, before committing to an idea (e.g., by way of computer animation).

The animation puppet 10 disclosed herein does not use nor require an underlying skeletal armature that has the aforementioned nuts and/or bolts that require "tensioning" before the puppet can be used for animation, as described above. Accordingly, elimination of these features naturally reduces the complexity of the design, including fabrication, sculpting, casting, tooling, tweaks, adjustments and related labor, and reduces reliance on expensive engineers, machinists, sculptures, artists and the like that are otherwise needed for producing one-off production puppets. Accordingly, the animation puppet 10 provides a low-cost, precise, highly articulated, free-standing, and positionable animation puppet. As discussed in more detail below, the animation puppet 10 is able to maintain consistent performance because the tension required to support the components of the animation puppet 10 are built into the joints. As a result, the strength and skeletal function of the animation puppet 10 are superior to that of puppets known in the art that require the use of the aforementioned metal armature or skeletal support. To this end, the animation puppet 10 is an "out of the box" solution, namely being immediately positionable for animation.

As shown in FIGS. 1A-1E, the animation puppet 10 disclosed herein is formed from one or more of a series of interlocking components that may include, in one embodiment, a head 12, a chest 14, an abdomen 16, and a pelvis 18, the chest 14, the abdomen 16 and the pelvis 18 forming the core of the animation puppet 10, with the head 12 generally extending outwardly from the chest 14, as shown. Furthermore, the animation puppet 10 may include a pair of legs connected to the pelvis 18, and more specifically a right leg 20, which generally includes a thigh 22 and a shin 24, the shin 24 connecting to a foot 26, which generally includes a heel 28 and a toe 30; and a corresponding left leg 20', which may generally include a thigh 22' and a shin 24', the shin 24' being connected to a foot 26', which also generally includes a heel 28' and a toe 30'. Additionally, the chest 14 may couple with a right arm 32 and a left arm 32', which respectively couple with a corresponding forearm 34, 34' and a respective hand 36, 36' having a respective set of fingers 38, 38'. As will become apparent from the description herein, each of the interlocking components may be designed to be mixed and/or matched as needed and/or desired, depending on the type of animation project. Moreover, while the interlocking parts are precise and designed to integrate into the form of the animation puppet 10 disclosed herein, i.e., one that has clean and flowing lines conducive to creating appealing, flowing poses, other designs may be contemplated using the same or a substantially similar interlocking component relationship. The animation puppet 10 disclosed herein is shown with one silhouette designed to maintain one sculptural look and feel. While one embodiment is disclosed herein, the size, shape and overall aesthetic look of the animation puppet 10 may change to fit the desired project, so the present disclosure should not be limited only to the embodiments disclosed herein.

The animation puppet 10 achieves a consistent and wide range of motion and high functioning degree of articulation through interconnection of a ball grip and socket design, which defines the corresponding movable joints of the animation puppet 10. The spatial orientation and size relationships of the ball grips and corresponding sockets maximizes the range of smooth, positionable motion and articulation that allows the animator or artist to animate or pose the animation puppet 10 with less effort and without compromising the strength of the joints. In this respect, the joints are pre-tensioned as a result of the surface friction interface between the ball grip and socket surfaces. In one embodiment, the desired balance and tension may be meticulously built into precise high-performance industrial strength plastic injection-molded ball grips and corresponding sockets. This enables the animation puppet 10 to be mass produced, yet positioned and selectively repositioned in desired poses, and to hold those positions or poses for an extended duration, and possibly even indefinitely. As described in more detail below, the assembled animation puppet 10 may be free-standing since the joints are able to carry the various components without other structural reinforcement, equipment or tools known in the art to hold other animation puppets upright (e.g., the aforementioned nuts/bolts). As such, the animation puppet 10 combines the metal skeletal function of a stop-motion armature with the aesthetic form of a finished puppet.

Figure 1A:
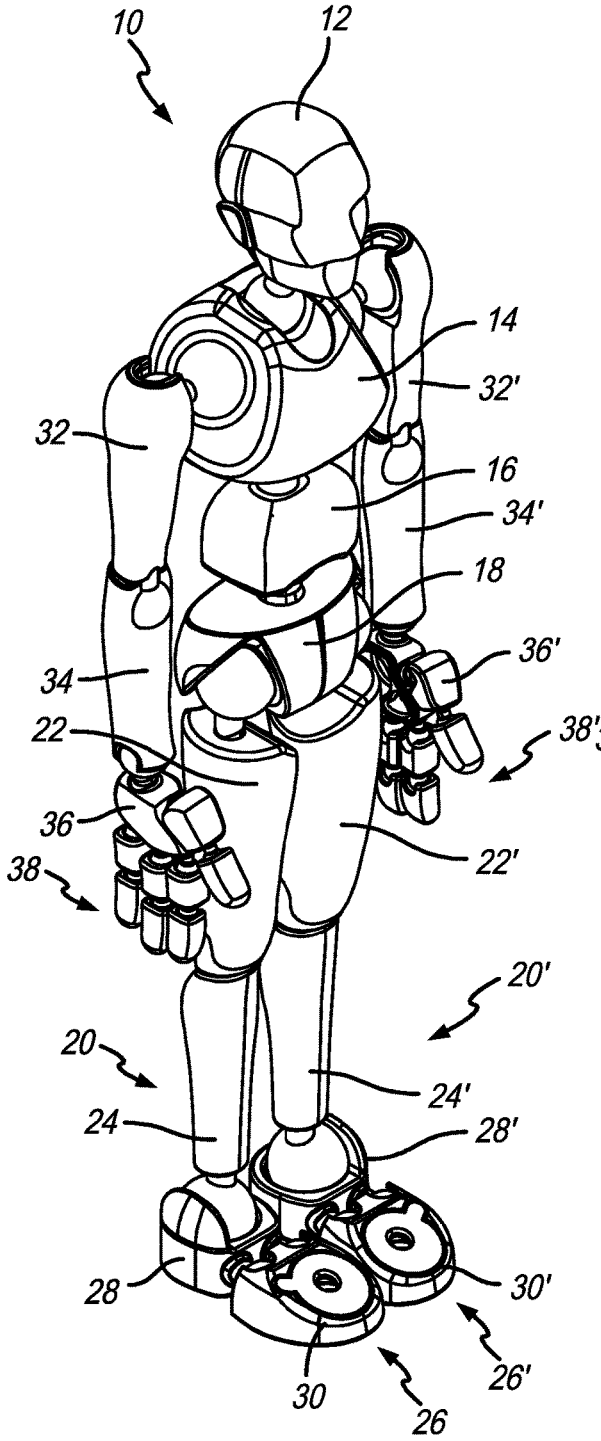
FIG. 1A is a perspective view of the front, top and left sides of one embodiment of an animation puppet as disclosed herein.
Figure 1B:
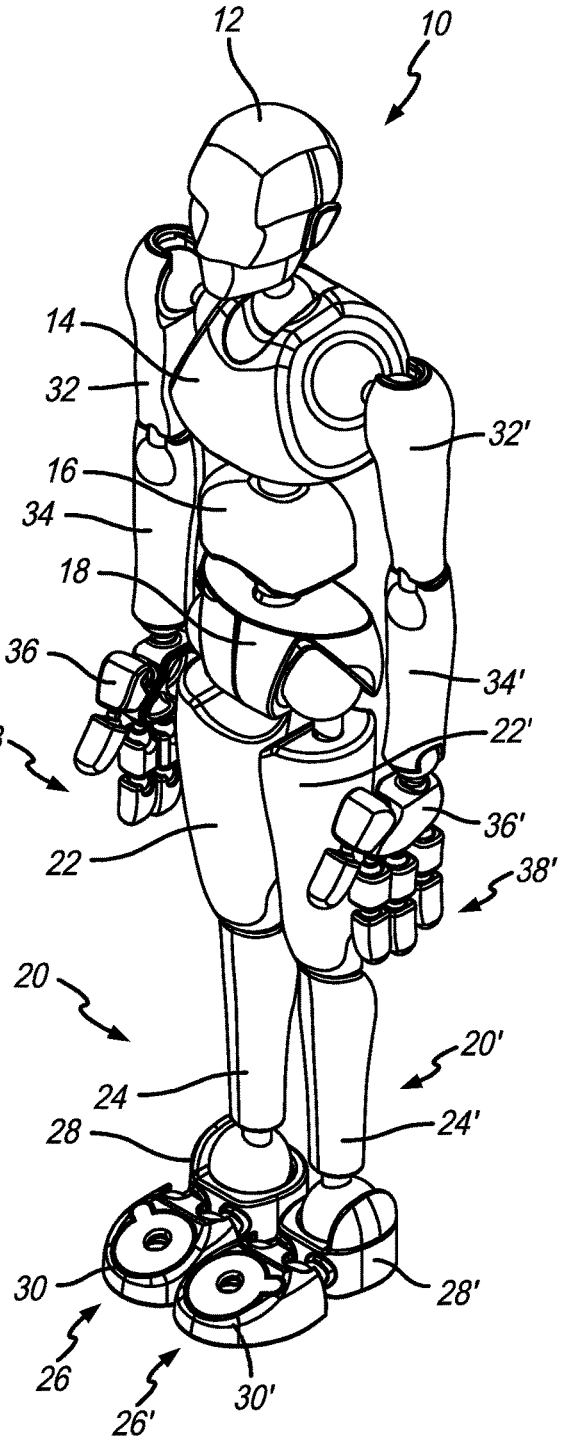
FIG. 1B is a perspective view illustrating the front, top and right sides of the animation puppet of FIG. 1A.
Figure 1C:
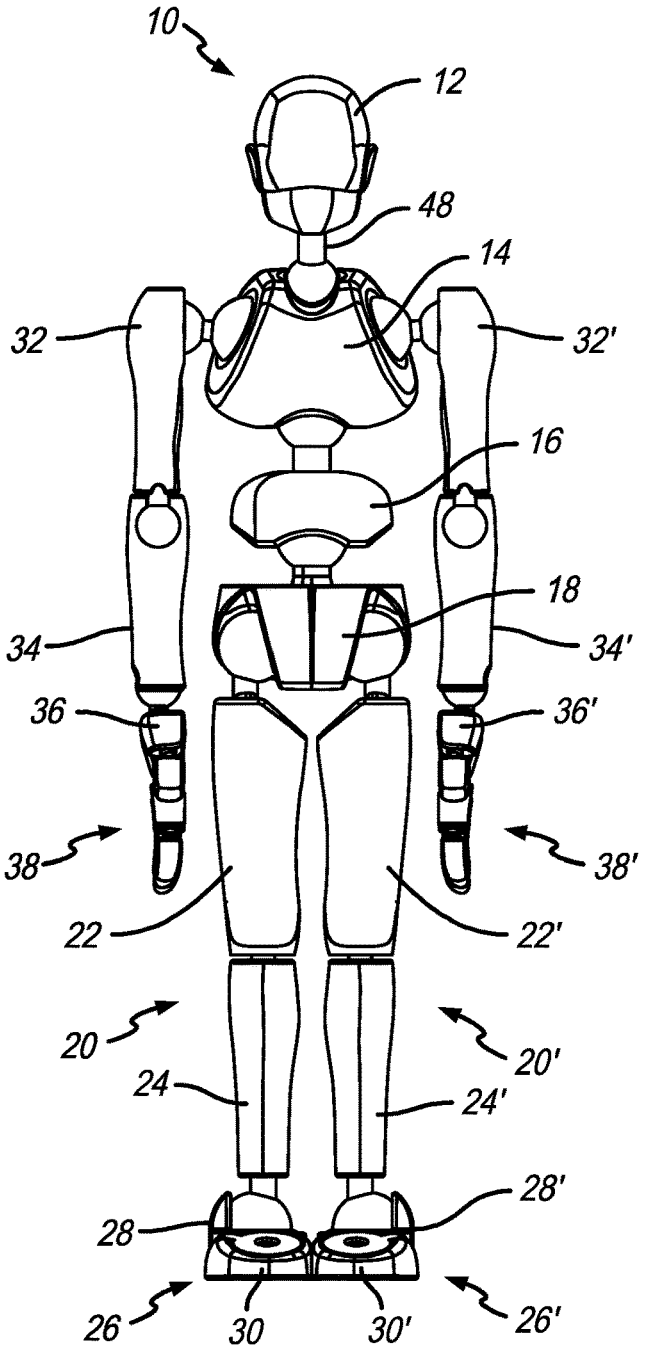
FIG. 1C is a front elevation view of the animation puppet of FIGS. 1A and 1B.
Figure 1D:
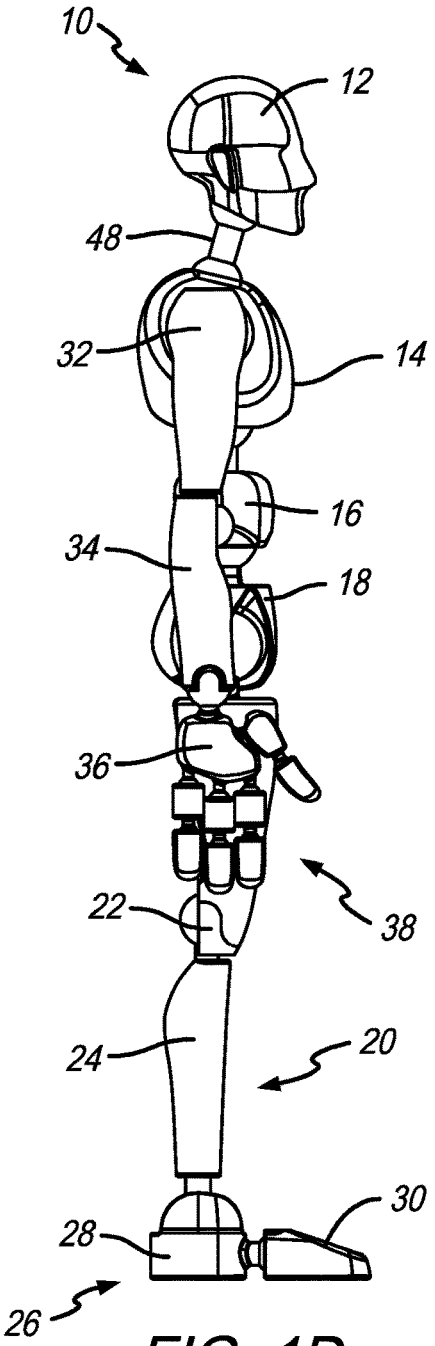
FIG. 1D is a left side elevation view of the animation puppet of FIGS. 1A and 1B.
Figure 1E:
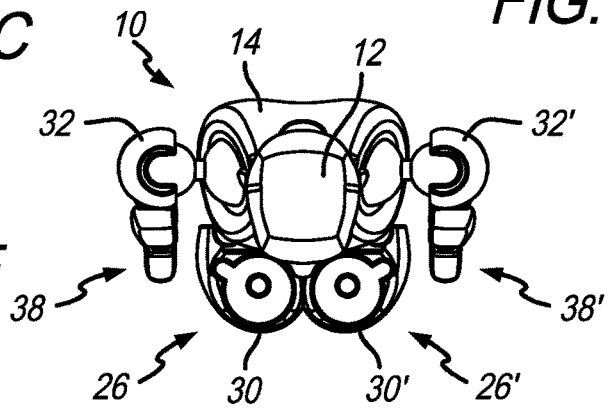
FIG. 1E is a top plan view of the animation puppet of FIGS. 1A and 1B.
Figure 2A:
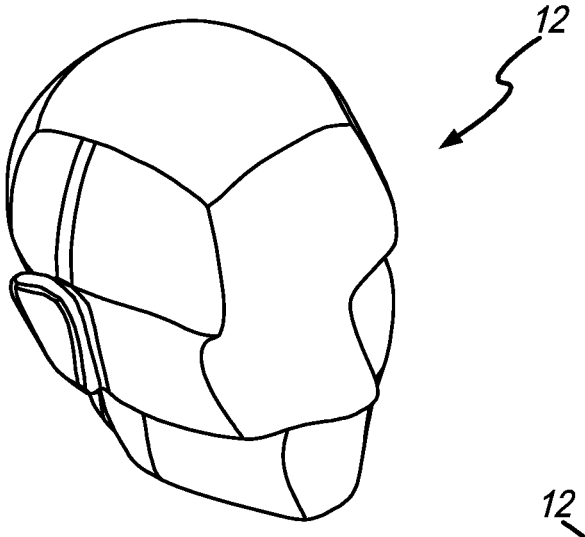
FIG. 2A is a perspective view of the front, top and left sides of one embodiment of a head of the animation puppet as disclosed herein.
Figure 2B:
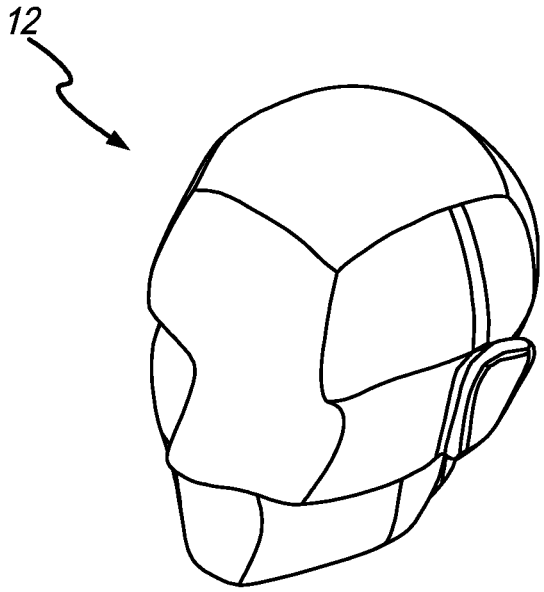
FIG. 2B is a perspective view illustrating the front, top and right sides of the head of FIG. 2A.
Figure 2C:
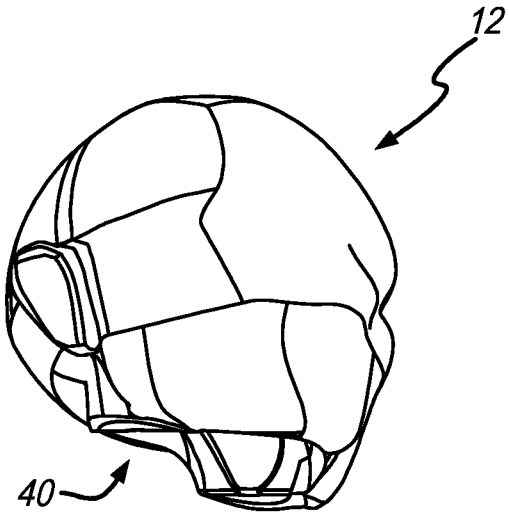
FIG. 2C is a perspective view illustrating the rear, top and left sides of the head of FIG. 2A.
Figure 2D:
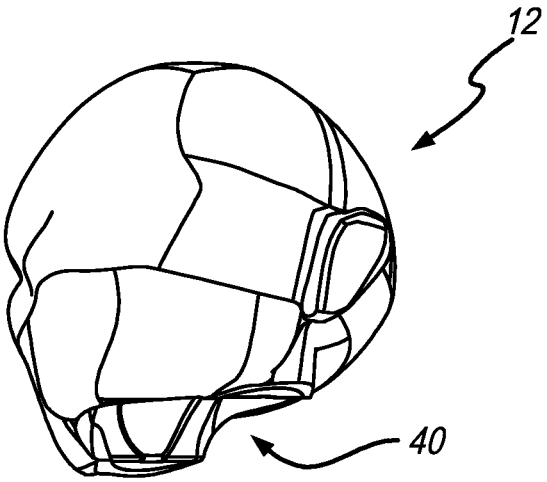
FIG. 2D is a perspective view illustrating the rear, top and right sides of the head of FIG. 2A.
Figure 2E:
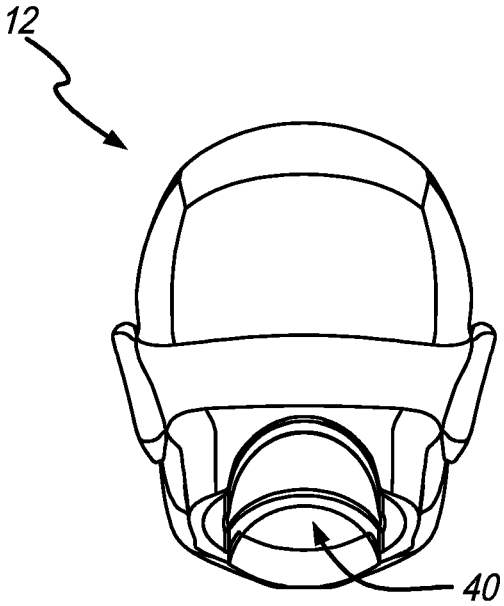
FIG. 2E is a rear elevation view of the head of FIGS. 2A-2D.
Figure 2F:
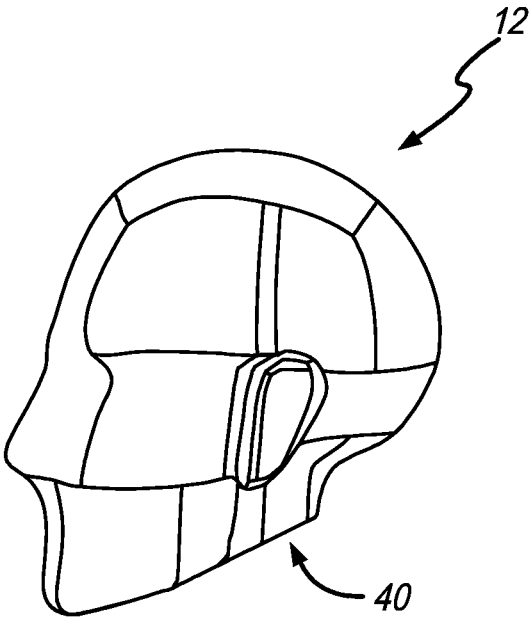
FIG. 2F is a right side elevation view of the head of FIGS. 2A-2D.
Figure 2G:
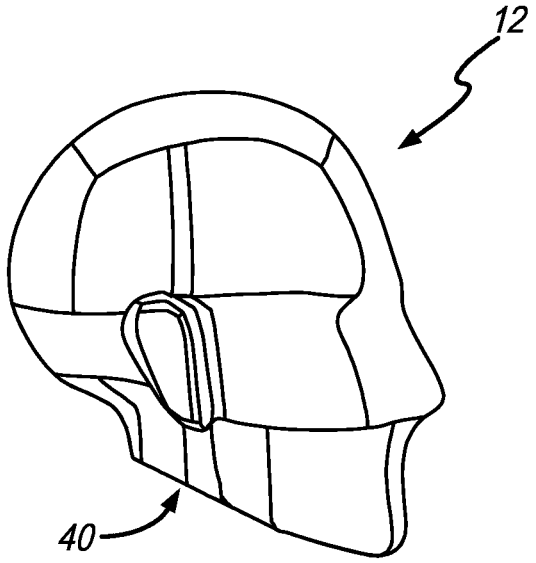
FIG. 2G is a left side elevation view of the head of FIGS. 2A-2D.
Figure 2H:
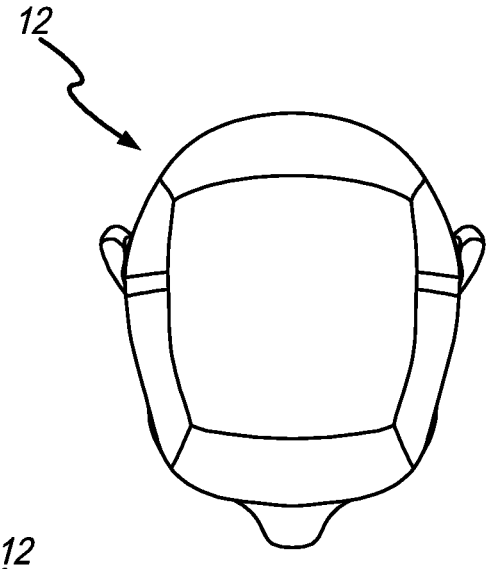
FIG. 2H is a top plan view of the head of FIGS. 2A-2D.
Figure 2I:
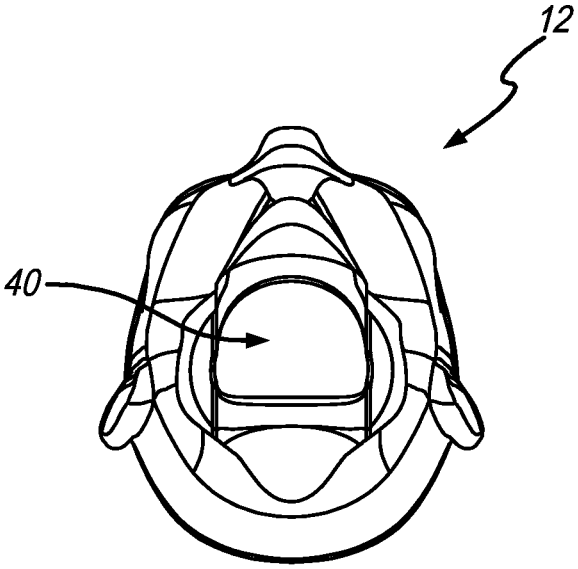
FIG. 2I is a bottom plan view of the head of FIGS. 2A-2D.
Figure 3A:
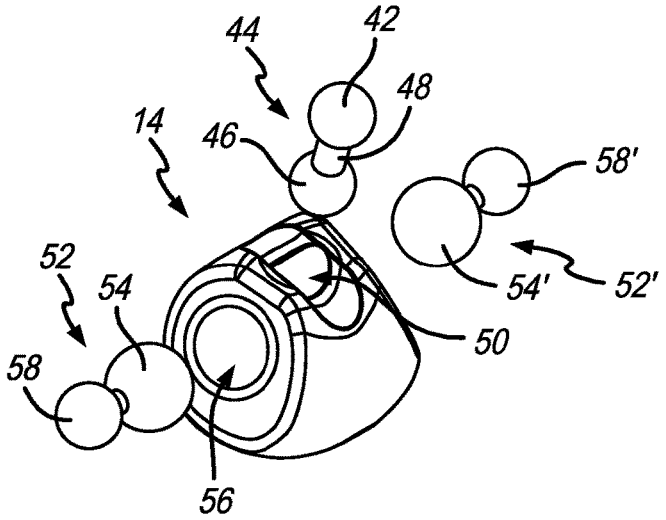
FIG. 3A is an exploded perspective view of the front, top and left sides of one embodiment of a chest and a plurality double joints used to form the animation puppet as disclosed herein.
Figure 3B:
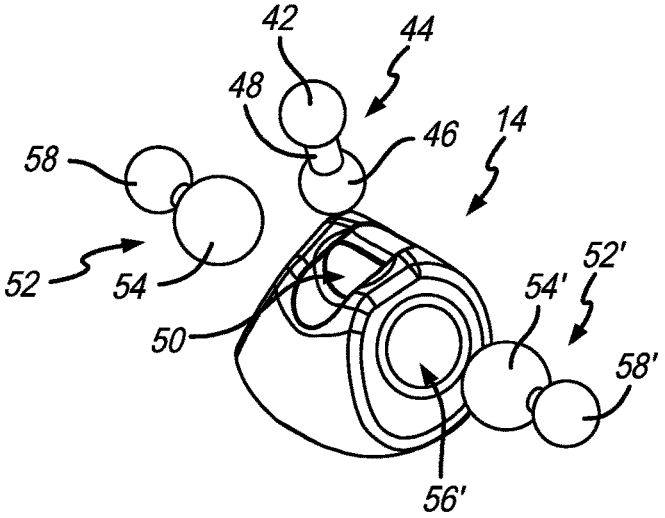
FIG. 3B is an exploded perspective view illustrating the front, top and right sides of the chest and the plurality double joints of FIG. 3A.
Figure 3C:
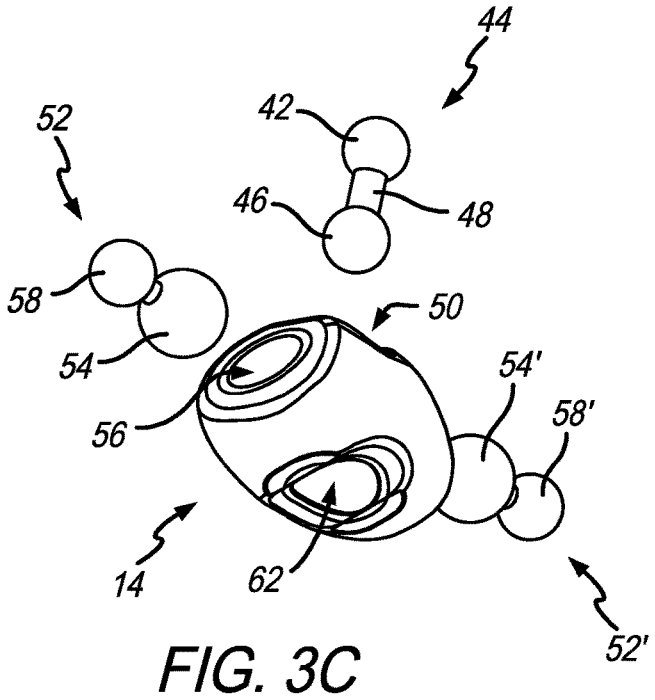
FIG. 3C is an exploded perspective view illustrating the front, bottom and left sides of the chest and the plurality double joints of FIG. 3A.
Figure 3D:
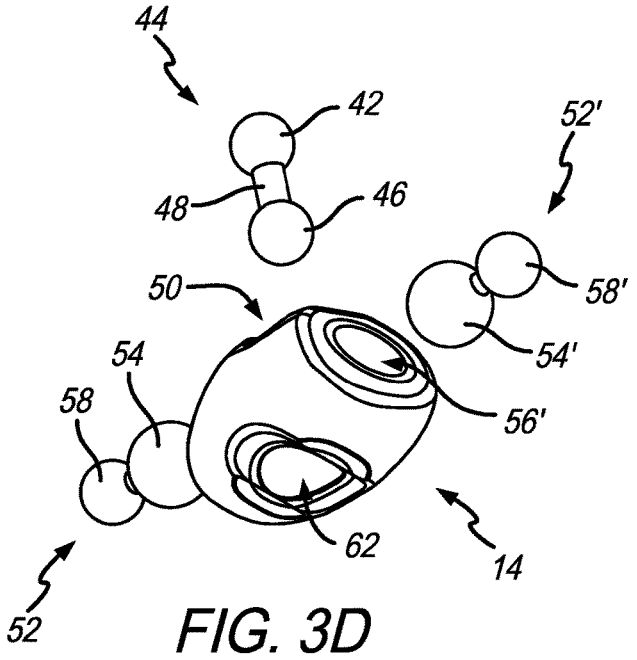
FIG. 3D is an exploded perspective view illustrating the front, bottom and right sides of the chest and the plurality double joints of FIG. 3A.
Figure 3E:
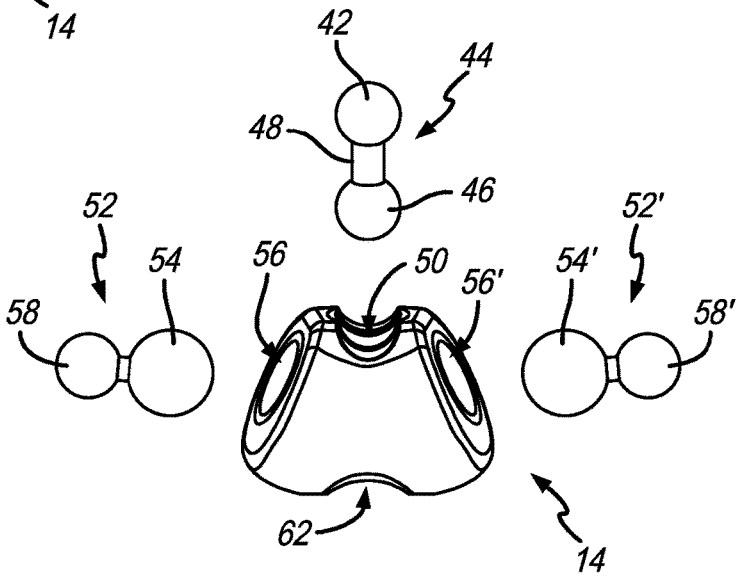
FIG. 3E is an exploded rear elevation view of the chest and the plurality double joints of FIGS. 3A-3D.
Figure 3F:
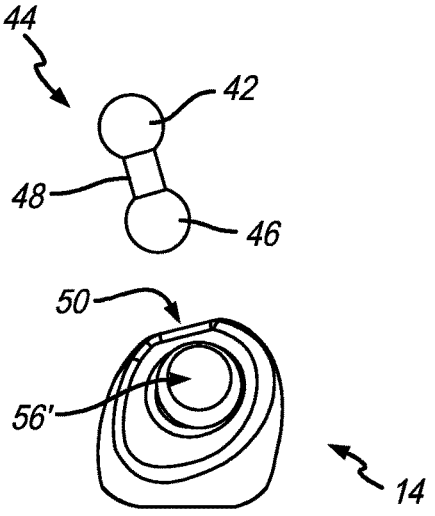
FIG. 3F is an exploded right side elevation view of the chest and the plurality double joints of FIGS. 3A-3D.
Figure 3G:
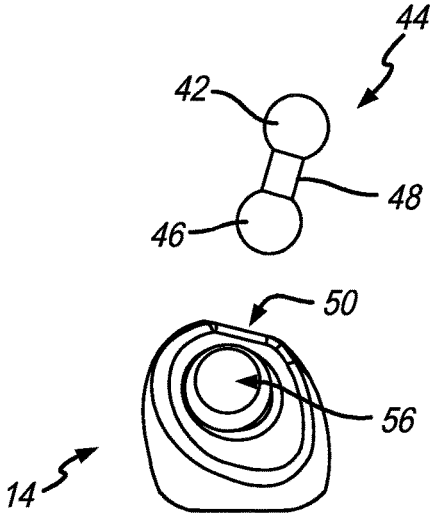
FIG. 3G is an exploded left side elevation view of the chest and the plurality double joints of FIGS. 3A-3D.
Figure 3H:
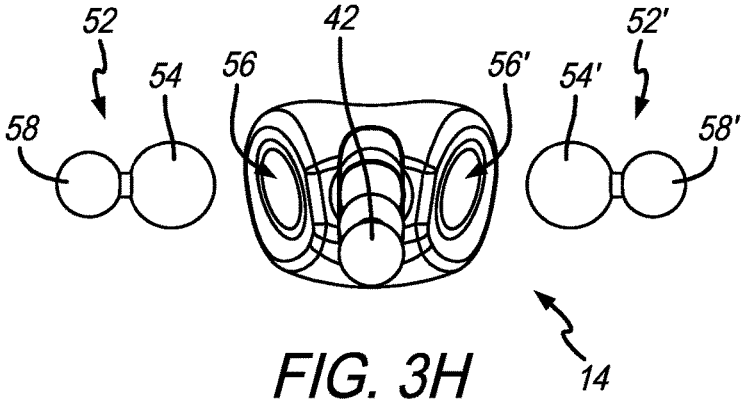
FIG. 3H is an exploded top plan view of the chest and the plurality double joints of FIGS. 3A-3D.
Figure 3I:
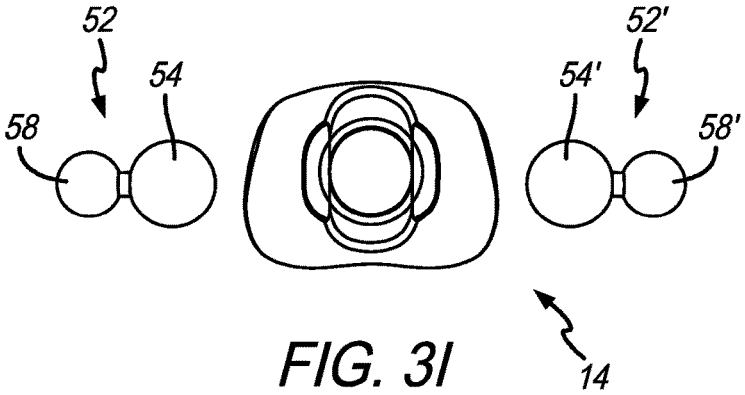
FIG. 3I is an exploded bottom plan view of the chest and the plurality double joints of FIGS. 3A-3D.

One embodiment of the head 12 is illustrated in more detail in FIGS. 2A-21. As shown, the head 12 may include the general facial features of a human head, although persons of ordinary skill in the art will readily recognize that the head 12 could be virtually any shape, size or aesthetic look (including not being a human head) depending on the animation project. Here, the head 12 includes a neck socket 40 injection-molded formed or otherwise bored out from one portion of the head 12 and designed for interlocking engagement with a head ball grip 42 formed as part of a double joint 44. The double joint 44 (FIGS. 3A-31 and 4A-41) also includes a chest ball grip 46 on an opposite end thereof and separated by a connecting joint 48. The corresponding chest ball grip 46 is designed for interlocking engagement with a chest socket 50 injection-molded formed or otherwise bored out from a portion of the chest 14 as shown in FIGS. 3A-31. When the head 12 is connected to the chest 14 by the respective head ball grip 42 and the chest ball grip 46 of the double joint 44, the connecting joint 48 extending in between may provide the appearance of a neck (generally numeral 48), as shown in FIGS. 1C and 1D, since the head ball grip 42 and the chest ball grip 46 are substantially seated within the respective sockets 40, 50. The head ball grip 42 and the chest ball grip 46 may selectively engage with the respective sockets 40, 50 by snap-fit engagement such that the outer diameter surface of the ball grips 42, 46 are pre-tensioned to the diameter of the sockets 40, 50 to provide the desired resistance for virtually an endless selection of formations, some of which are shown below with respect to FIGS. 17-27. Of course, this ball-and-socket relationship may permit 360 degree rotation of one part (e.g., the head 12) relative to another part (e.g., the chest 14). Preferably the double joint 44 with the head ball grip 42, which couples with the neck socket 40, and the check ball grip 46, which couples with the check socket 50, meets and exceeds the normal ranges of human neck joint motion, and specifically has flexion of approximately 70 to 90 degrees (allowing the chin of the head 12 to touch the sternum of the chest 14), extension up to about 55 degrees (allowing the chin to point upwardly), lateral bending up to about 35 degrees (allowing the ear to close to the shoulder joint), and rotation up to about 70 degrees in both the right and left directions (allowing the head 12 to turn to the right and to the left).

FIGS. 3A-31 further illustrate other aspects of the animation puppet 10, including a pair of double ball joints 52, 52' for use in coupling the chest 14 to each of the arms 32, 32'. Each of the double ball joints 52, 52' include a shoulder ball grip 54, 54' for interconnection with a respective shoulder socket 56, 56' (forming a shoulder joint), and arm ball grips 58, 58' for coupling with a respective arm sockets 60, 60' (see, e.g., FIGS. 14A-14D, 14F, and 14G). Engagement of the chest ball grip 46 with the chest socket 50 and the shoulder ball grips 54, 54' with the shoulder sockets 56, 56' is shown in more detail in FIGS. 4A-41, and preferably has the form and fit and permits 360 degree rotation, as described above with respect to the neck socket 40 and the head ball grip 42. More specifically, the shoulder joints formed by the respective shoulder ball grips 54, 54' and the shoulder sockets 56, 56' preferably exceeds the normal range of motion of the human shoulder joint, and may more specifically provide for abduction up to 180 degrees (allowing the arms 32, 32' to move to a horizontal position), adduction up to 45 degrees (allowing the arms 32, 32' to move toward the midline of the animation puppet 10), horizontal extension up to 45 degrees (allowing the arms 32, 32' to swing horizontally backward), horizontal flexion up to 130 degrees (allowing the arms 32, 32' to swing horizontally forward), vertical extension up to 60 degrees (allowing the arms 32, 32' to raise straight backward), and vertical flexion up to 180 degrees (allowing the arms 32, 32' to raise straight forward).

Figure 4A:
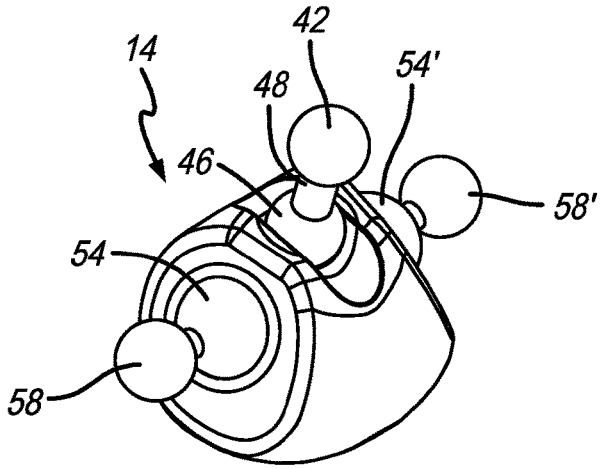
FIG. 4A is a perspective view of the front, top and left sides of the chest of FIG. 3A, illustrating connection of the plurality of double joints therein.
Figure 4B:
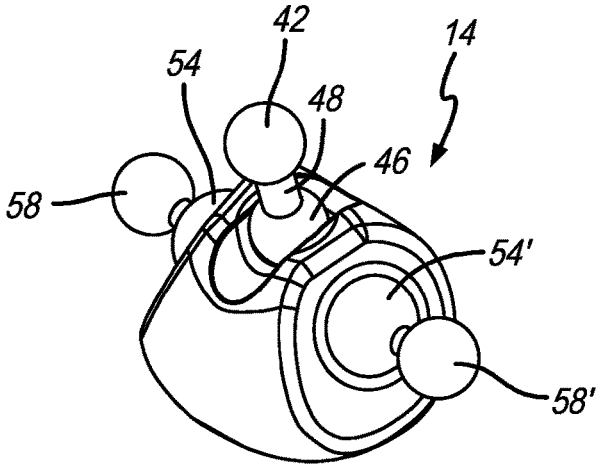
FIG. 4B is a perspective view illustrating the front, top and right sides of the chest of FIG. 3B, illustrating connection of the plurality of double joints therein.
Figure 4C:
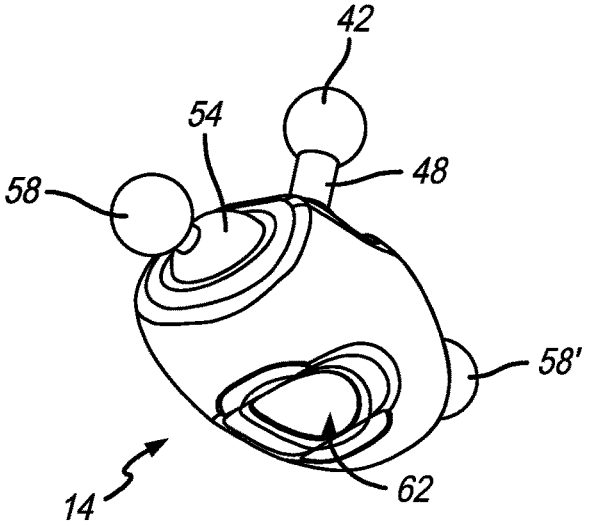
FIG. 4C is a perspective view illustrating the front, bottom and left sides of the chest of FIG. 3C, illustrating connection of the plurality of double joints therein.
Figure 4D:
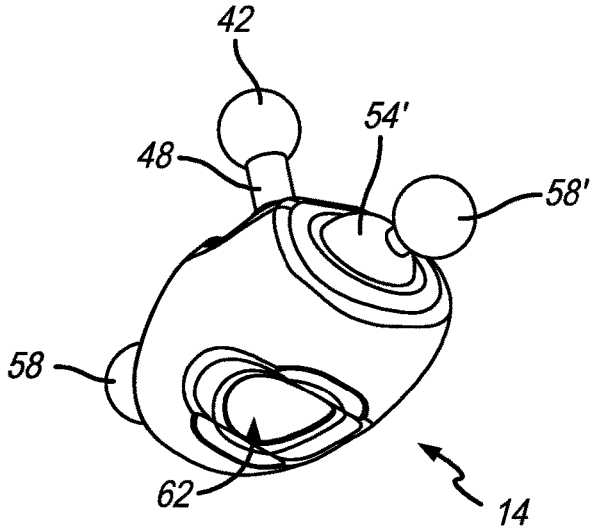
FIG. 4D is a perspective view illustrating the front, bottom and right sides of the chest of FIG. 3D, illustrating connection of the plurality of double joints therein.
Figure 4E:
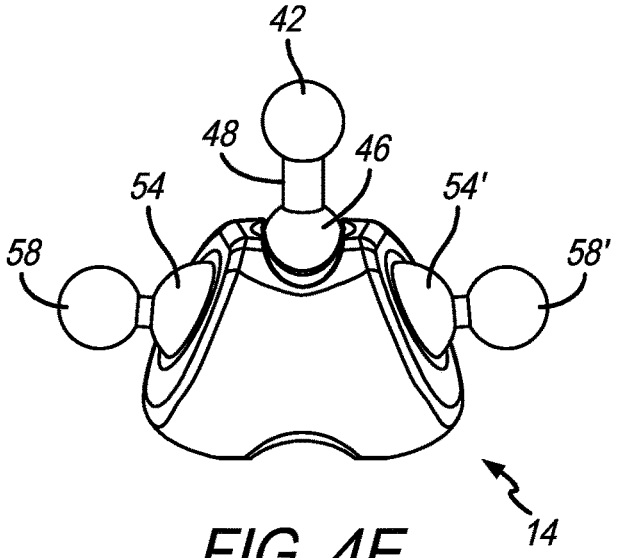
FIG. 4E is a rear elevation view of the chest of FIG. 3E, illustrating connection of the plurality of double joints therein.
Figure 4F:
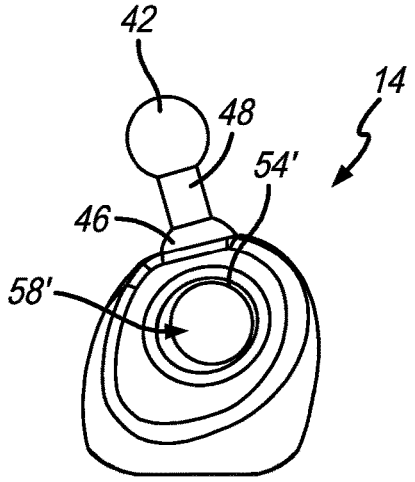
FIG. 4F is a right side elevation view of the chest of FIG. 3F, illustrating connection of the plurality of double joints therein.
Figure 4G:
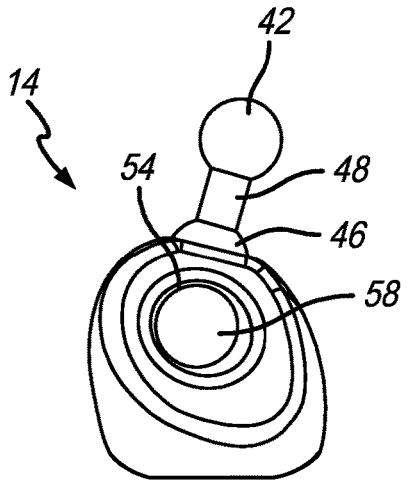
FIG. 4G is a left side elevation view of the chest of FIG. 3G, illustrating connection of the plurality of double joints therein.
Figure 4H:
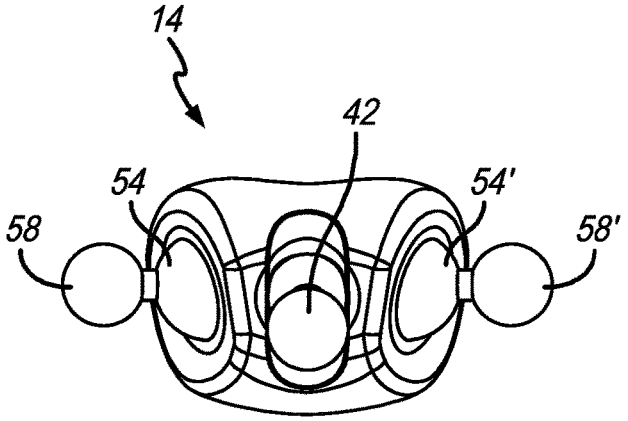
FIG. 4H is a top plan view of the chest of FIG. 3H, illustrating connection of the plurality of double joints therein.
Figure 4I:
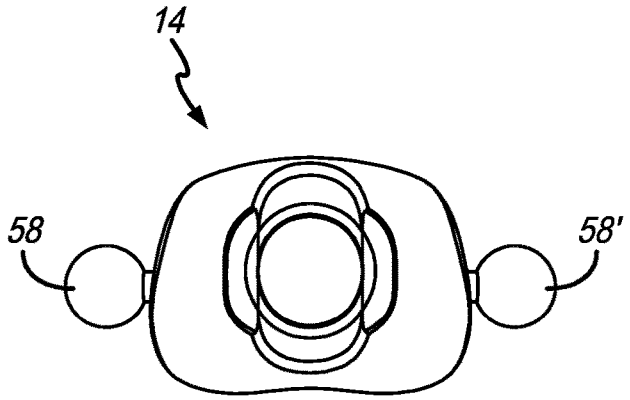
FIG. 4I is a bottom plan view of the chest of FIG. 3I, illustrating connection of the plurality of double joints therein.
Figure 5A:
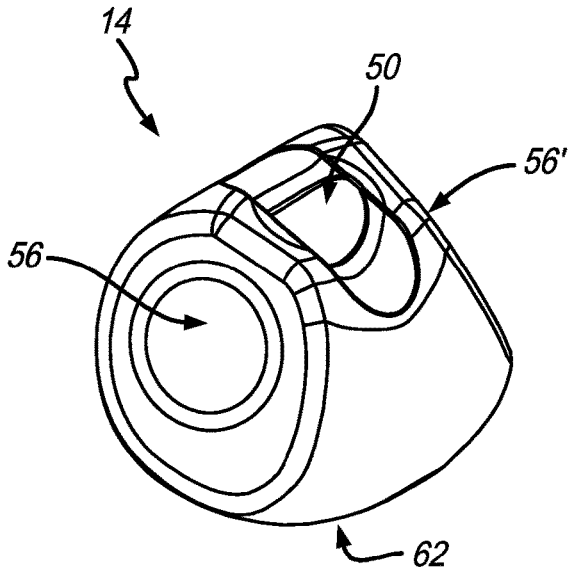
FIG. 5A is a perspective view of the front, top and left sides of the chest of FIGS. 3A-31 and 4A-41, further illustrating a neck socket and a pair of shoulder sockets.
Figure 5B:
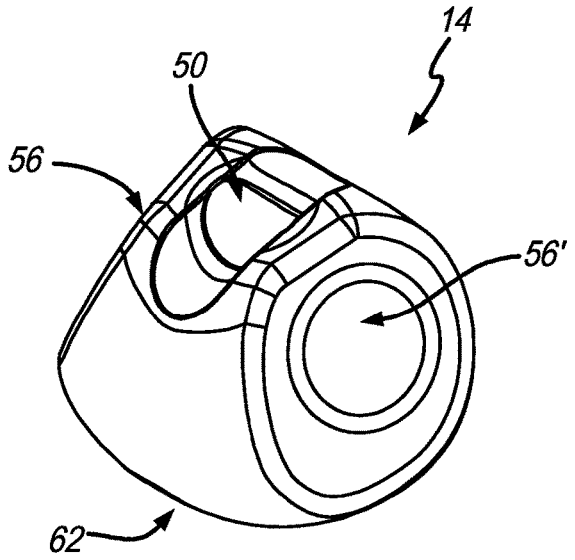
FIG. 5B is a perspective view illustrating the front, top and right sides of the chest of FIGS. 3A-31 and 4A-41, further illustrating the neck and the shoulder sockets.
Figure 5C:
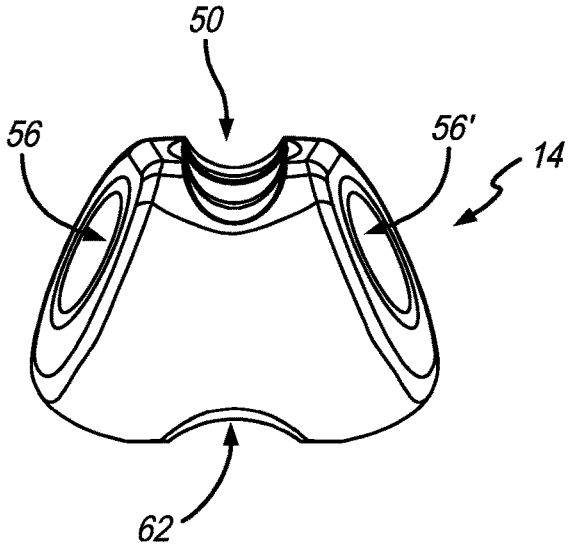
FIG. 5C is a front elevation view of the chest of FIGS. 5A and 5B.
Figure 5D:
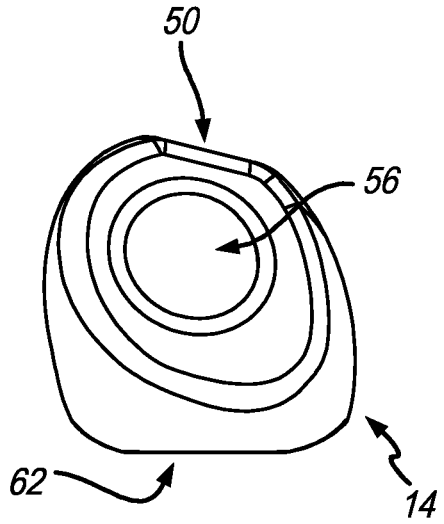
FIG. 5D is a left side elevation view of the chest of FIGS. 5A and 5B.
Figure 5E:
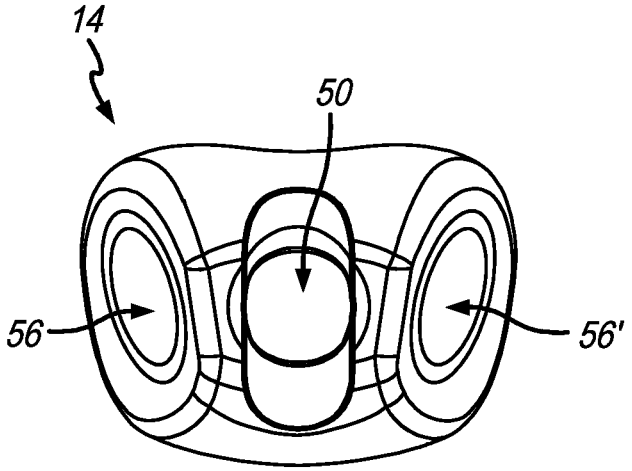
FIG. 5E is a top plan view of the chest of FIGS. 5A and 5B.
Figure 5F:
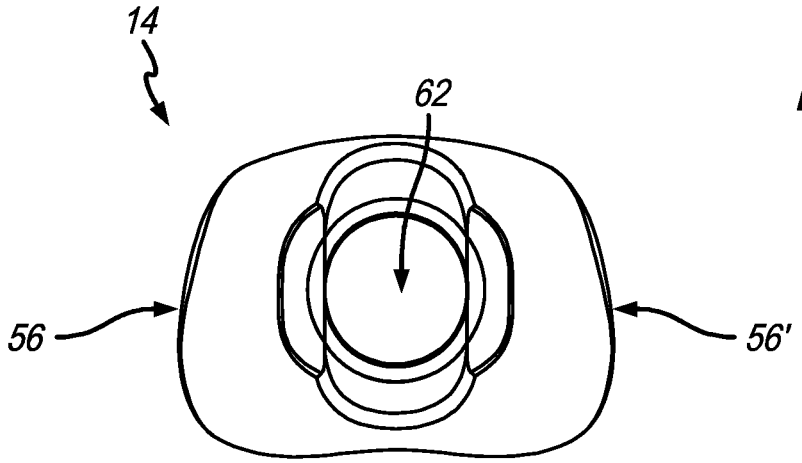
FIG. 5F is a bottom plan view of the chest of FIGS. 5A and 5B.
Figure 6A:
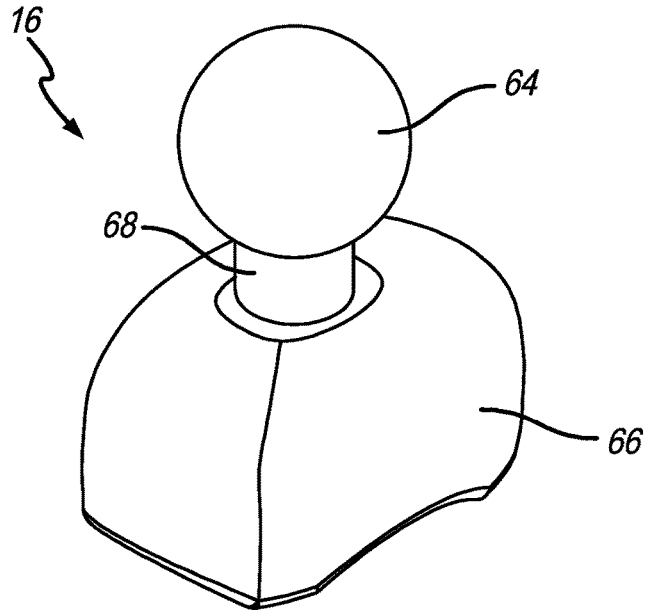
FIG. 6A is a perspective view of the front, top and left sides of one embodiment of an abdomen of the animation puppet as disclosed herein.
Figure 6B:
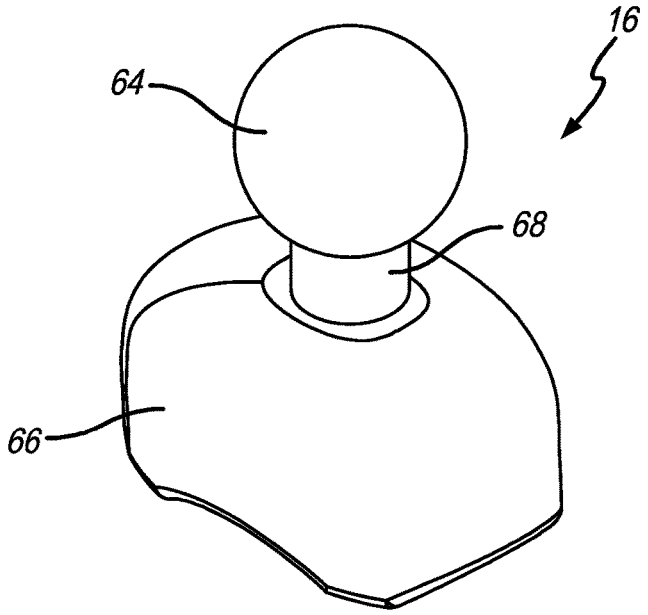
FIG. 6B is a perspective view illustrating the front, top and right sides of the abdomen of FIG. 6A.
Figure 6C:
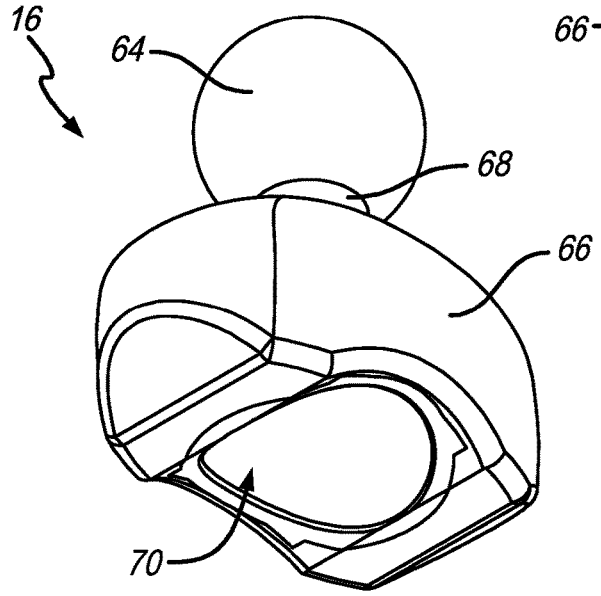
FIG. 6C is a perspective view illustrating the front, bottom and left sides of the abdomen of FIG. 6A.
Figure 6D:
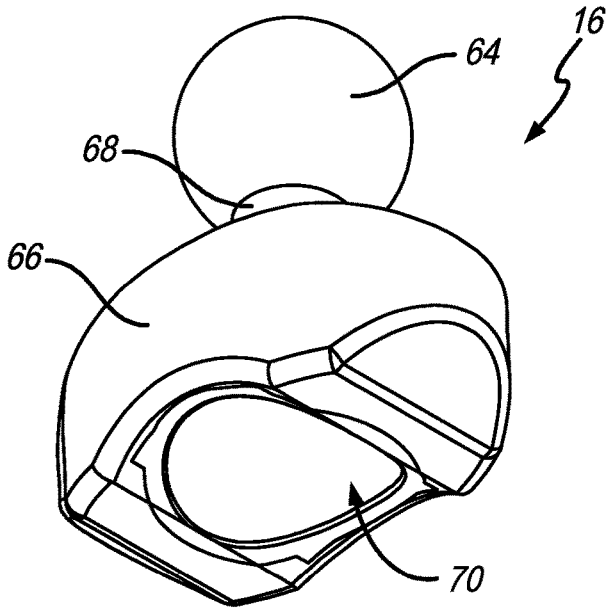
FIG. 6D is a perspective view illustrating the front, bottom and right sides of the abdomen of FIG. 6A.
Figure 6E:
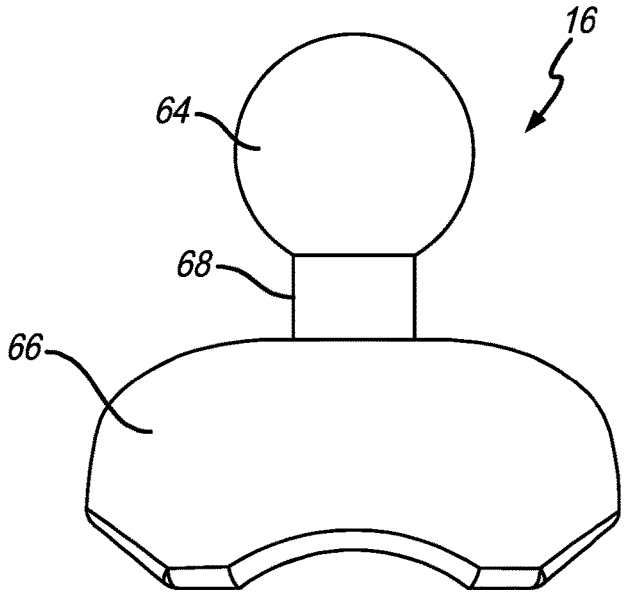
FIG. 6E is a front elevation view of the abdomen of FIGS. 6A-6D.
Figure 6F:
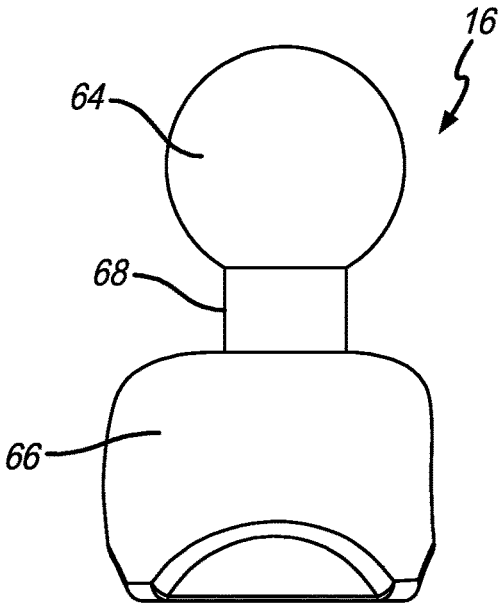
FIG. 6F is a right side elevation view of the abdomen of FIGS. 6A-6D.
Figure 6G:
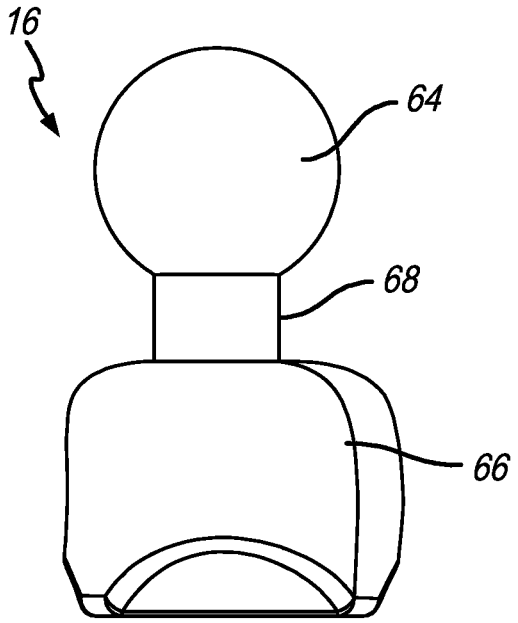
FIG. 6G is a left side elevation view of the abdomen of FIGS. 6A-6D.
Figure 6H:
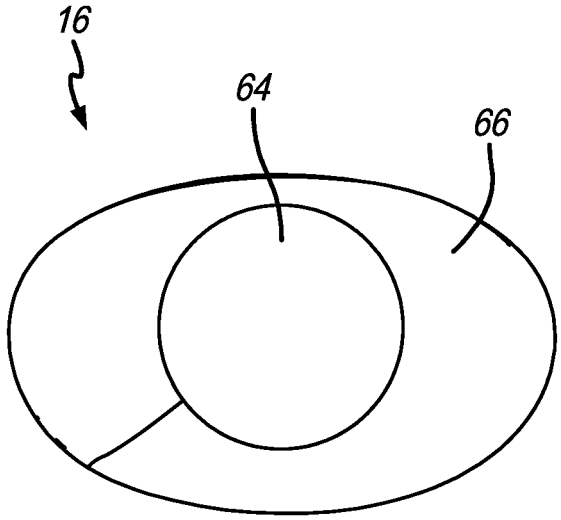
FIG. 6H is a top plan view of the abdomen of FIGS. 6A-6D.
Figure 6I:
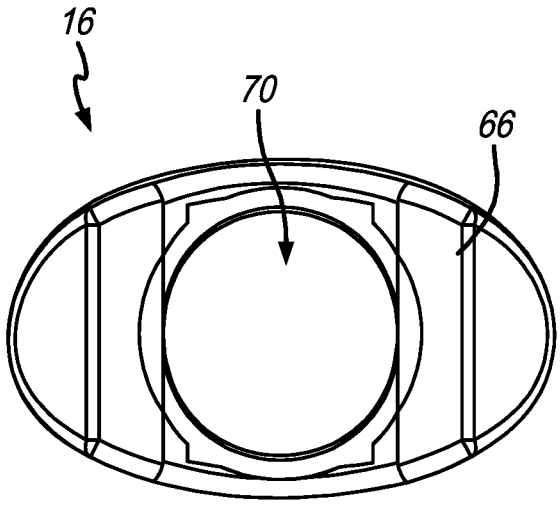
FIG. 6I is a bottom plan view of the abdomen of FIGS. 6A-6D.
Figure 7A:
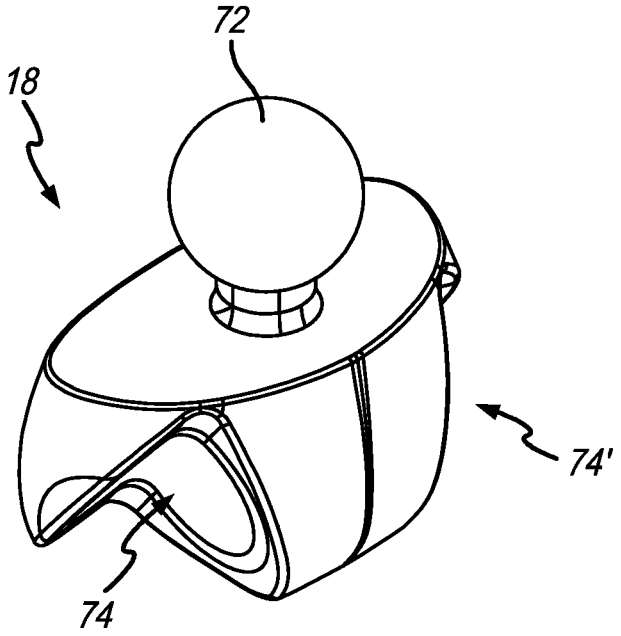
FIG. 7A is a perspective view of the front, top and left sides of one embodiment of a pelvis of the animation puppet as disclosed herein.
Figure 7B:
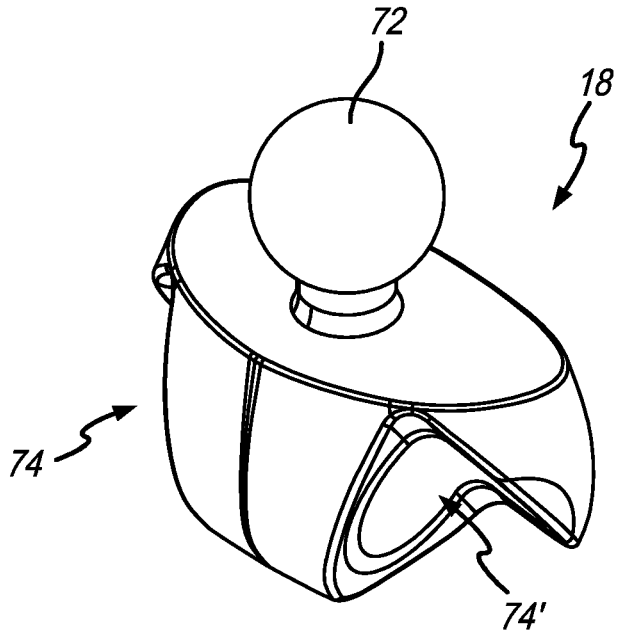
FIG. 7B is a perspective view illustrating the front, top and right sides of the pelvis of FIG. 7A.
Figure 7C:
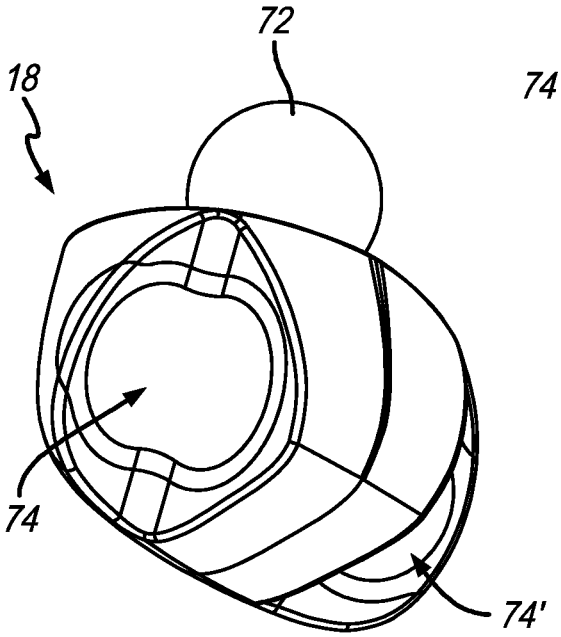
FIG. 7C is a perspective view illustrating the front, bottom and left sides of the pelvis of FIG. 7A.
Figure 7D:
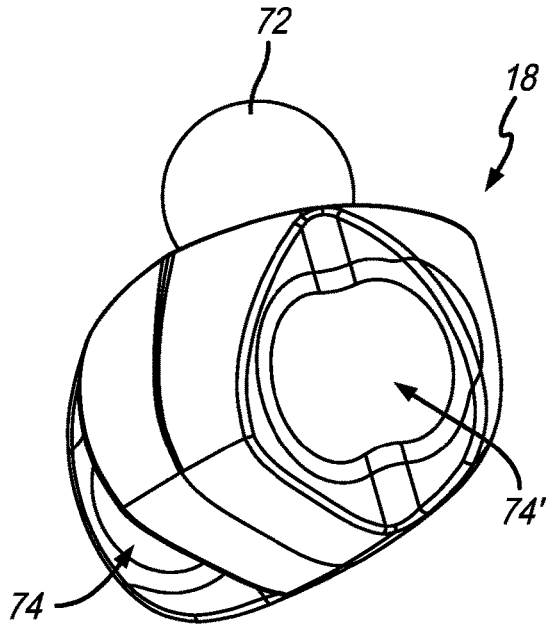
FIG. 7D is a perspective view illustrating the front, bottom and right sides of the pelvis of FIG. 7A.
Figure 7E:
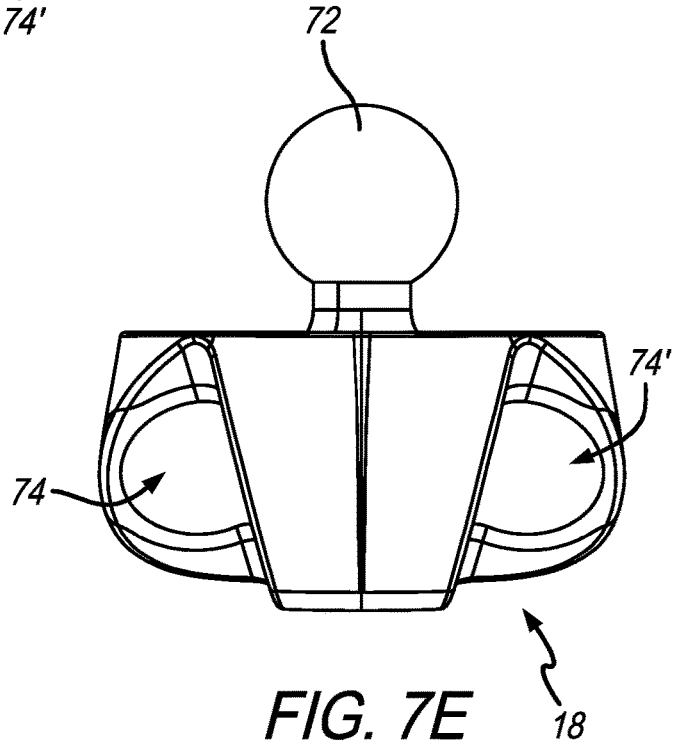
FIG. 7E is a front elevation view of the pelvis of FIGS. 7A-7D.
Figure 7F:
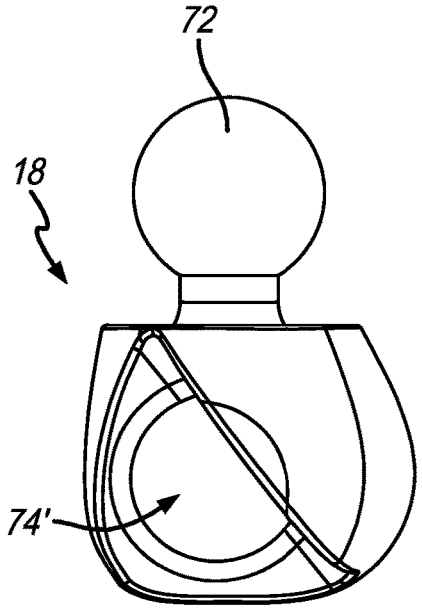
FIG. 7F is a right side elevation view of the pelvis of FIGS. 7A-7D.
Figure 7G:
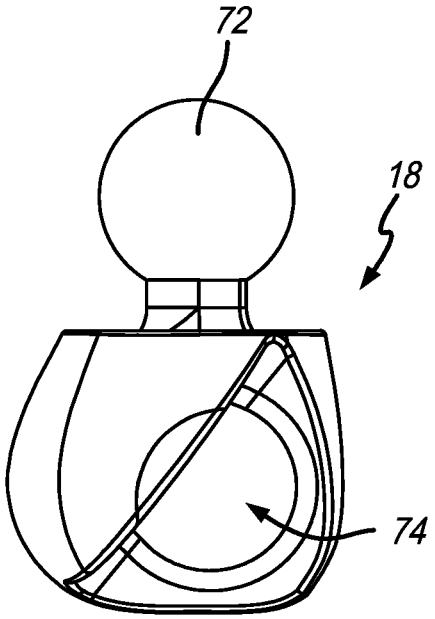
FIG. 7G is a left side elevation view of the pelvis of FIGS. 7A-7D.
Figure 7H:
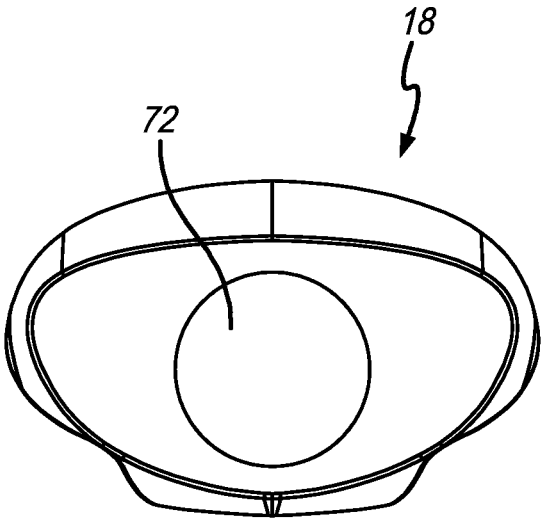
FIG. 7H is a top plan view of the pelvis of FIGS. 7A-7D.
Figure 7I:
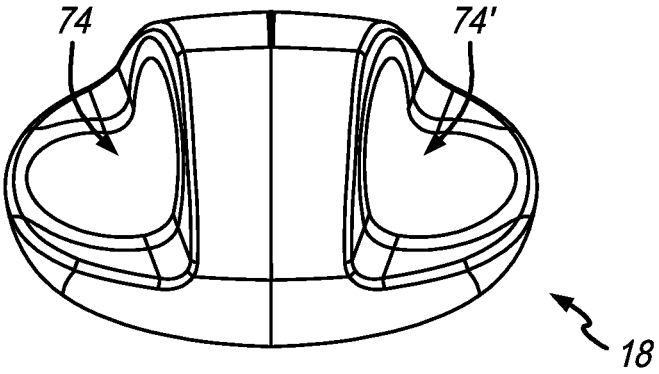
FIG. 7I is a bottom plan view of the pelvis of FIGS. 7A-7D.
Figure 8A:
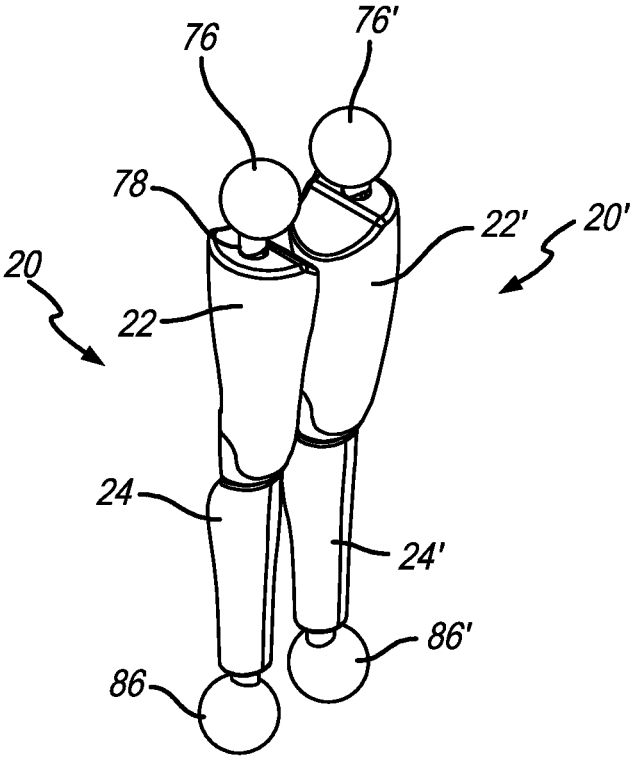
FIG. 8A is a perspective view of the front, top and left sides of one embodiment of a pair of legs of the animation puppet as disclosed herein.
Figure 8B:
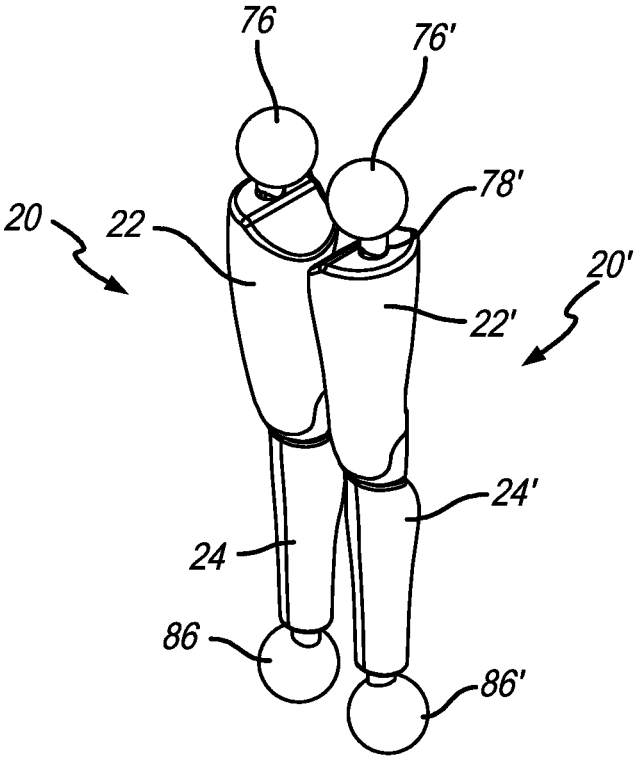
FIG. 8B is a perspective view illustrating the front, top and right sides of the pair of legs of FIG. 8A.
Figure 8C:
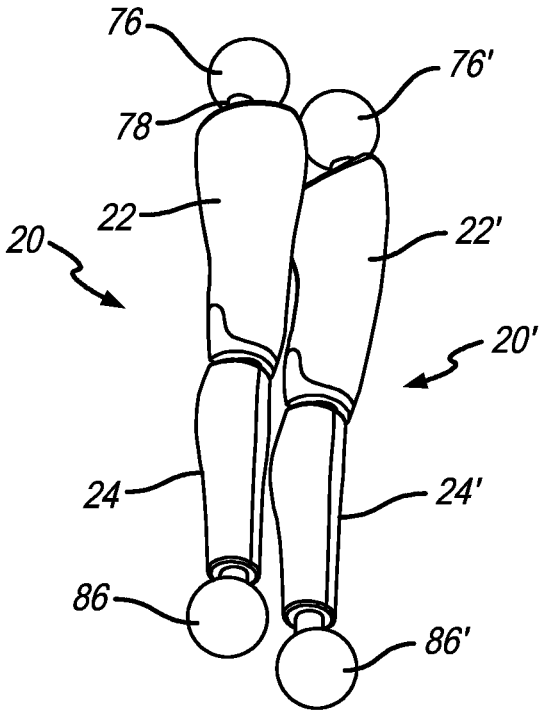
FIG. 8C is a perspective view illustrating the front, bottom and left sides of the pair of legs of FIG. 8A.
Figure 8D:
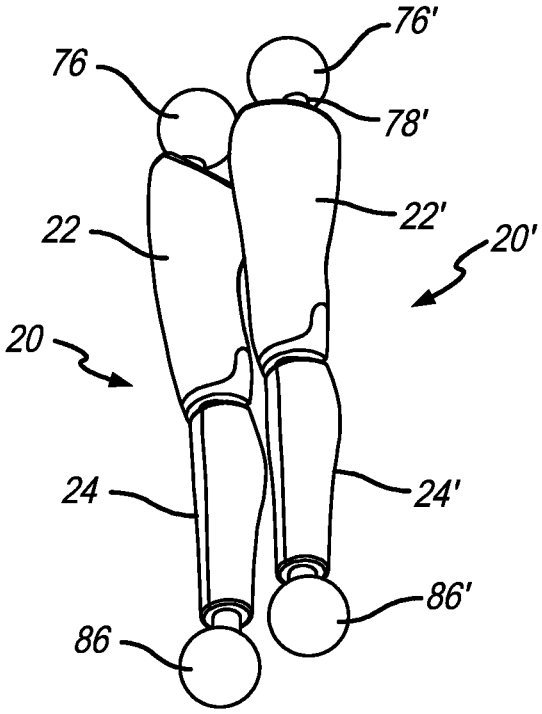
FIG. 8D is a perspective view illustrating the front, bottom and right sides of the pair of legs of FIG. 8A.
Figure 8E:
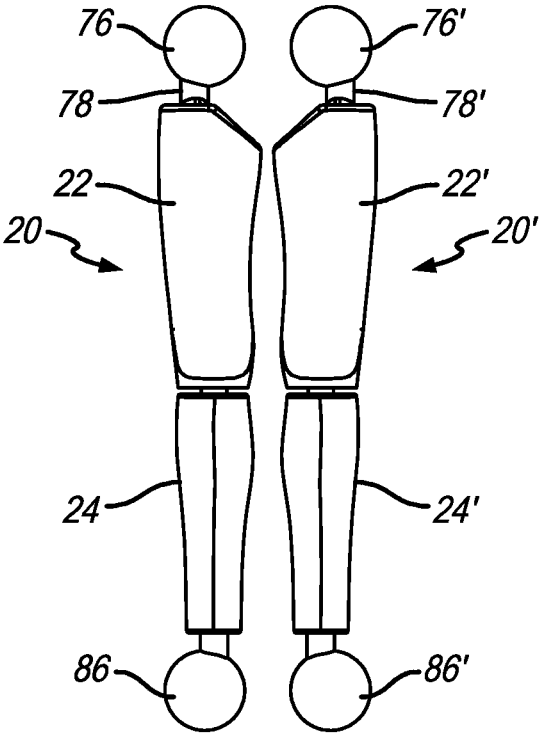
FIG. 8E is a front elevation view of the pair of legs of FIGS. 8A-8D.
Figure 8F:
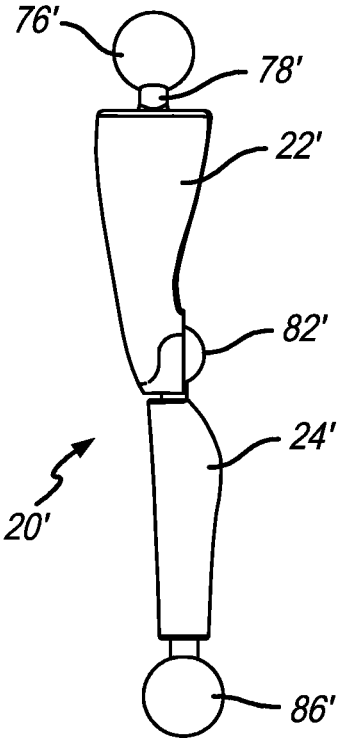
FIG. 8F is a right side elevation view of the pair of legs of FIGS. 8A-8D.
Figure 8G:
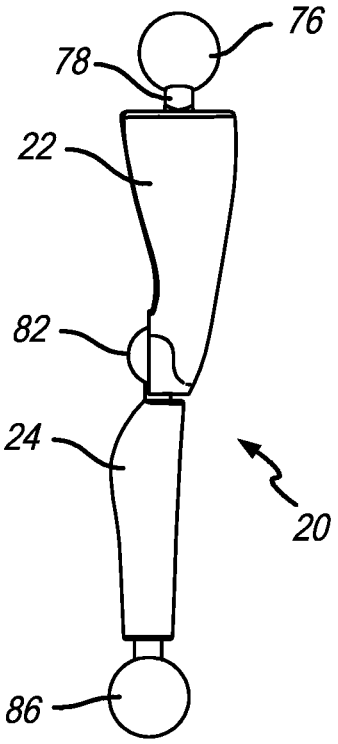
FIG. 8G is a left side elevation view of the pair of legs of FIGS. 8A-8D.

Further in this respect, FIGS. 5A-5F illustrate the structure of the chest 14 in more detail, and specifically with respect to the size and shape of the chest socket 50, the shoulder sockets 56, 56', and an abdomen socket 62 (also shown in FIGS. 4C and 4D). The abdomen socket 62 is of a size and shape for selective snap-fit reception of an abdomen ball grip 64 shown formed as part of the abdomen 16 and extending out and away from a body 66 of the abdomen 16 by a connector 68. The abdomen 16 further includes a pelvis socket 70 for select snap-fit reception of a pelvis ball grip 72, as shown in FIGS. 7A-7I with respect to the pelvis 18. The abdomen 16 links the pelvis 18 to the chest 14, and forms the functionality of the lumbar spine. The abdomen 16 preferably exceeds the natural human range of joint motion, and specifically the pelvis ball grip 72 couples to the pelvis socket 70 to permit flexion of up to 75 degrees (allowing the abdomen 16 to bend forward relative to the pelvis 18), extension up to 30 degrees (allowing the abdomen 16 to bend backward relative to the pelvis 18), and lateral bending up to about 35 degrees (allowing the abdomen 16 to bend side-to-side relative to the pelvis 18).

The pelvis 18 similarly includes a pair of hip sockets 74, 74' for selected snap-fit engagement with a respective pair of hip ball grips 76, 76' (FIGS. 8A-8G). FIGS. 7A-7I more specifically illustrate the shape and structure of the pelvis 18, including the formation of the hip sockets 74, 74' having a generally wedge-shaped cut-out with a back flange designed to provide additional support for the hip ball grips 76, 76' when engaged with the hip sockets 74, 74'. The corresponding hip joint formed through interconnection of the hip ball grips 76, 76' with the respective hip sockets 74, 74' provides a wide range of smooth positionable motion, without compromising the ability of the hip joint to be positioned and hold the weight of the animation puppet 10. Each of the hip ball grips 76, 76' preferably extends out from the thigh 22 by an extension 78, 78' designed to permit seated reception of the hip ball grips 76, 76' within the hip sockets 74, 74' while at the same time permitting maximum rotational freedom relative thereto, and preferably 360 degree rotational freedom. In a preferred embodiment, each ball grip 76, 76' couples to its respective extension 78, 78' at an angled offset. In other words, the extensions 78, 78' preferably do not extend through the center of each respective ball grip 76, 76', but rather through the offset position shown best, e.g., in FIGS. 8A, 8B and 8E. This design helps to more accurately replicate the natural range of motion. The extension 78, 78' may be needed to provide clearance of the thigh 78, 78' relative to the pelvis sockets 70, 70' of the pelvis 18. Here, the extension 78, 78' bridges the hip ball grips 76, 76' with the thigh 22.

For the purposes of animation, it is preferred that the hip joint include a wide range of motion, while maintaining the structure of the joint and providing the strength required to hold the weight of the animation puppet. In this respect, the hip joint formed by the respective hip ball grips 76, 76' and the respective hip sockets 74, 74' preferably exceeds the normal range of the human hip joint, and may more specifically provide for flexion between approximately 110 and 130 degrees (allowing the thighs 22, 22' to be brought close to the abdomen 16), extension up to 30 degrees (allowing the thighs 22, 22' to be moved backward without moving the pelvis 18), abduction between approximately 45 to 30 degrees (allowing the thighs 22, 22' to be positioned away from the midline), adduction between approximately 20 to 30 degrees (allowing the thighs 22, 22' to move toward and across the midline), internal rotation up to 40 degrees (allowing the knee joint to flex and swing the shins 24, 24' away from the midline), and external rotation up to 45 degrees (allowing the knee joint to flex and swing the shins 24, 24' toward the midline).

Figure 9A:
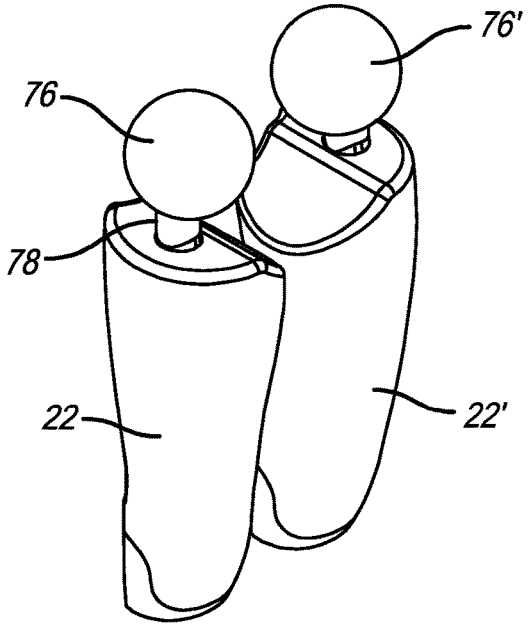
FIG. 9A is a perspective view of the front, top and left sides of one embodiment of a pair of thighs of the animation puppet as disclosed herein.
Figure 9B:
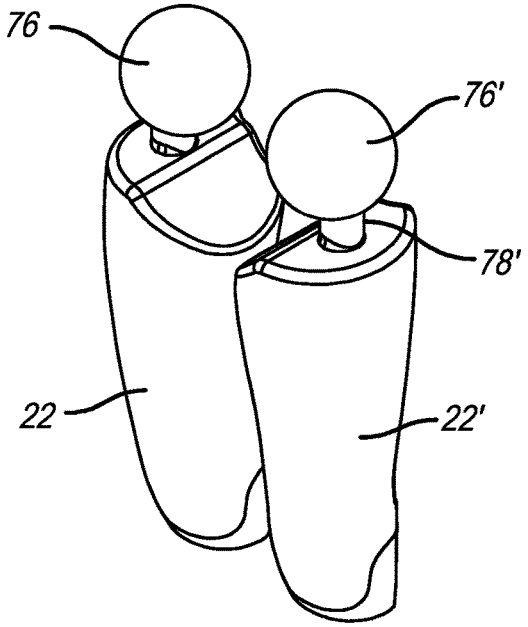
FIG. 9B is a perspective view illustrating the front, top and right sides of the pair of thighs of FIG. 9A.
Figure 9C:
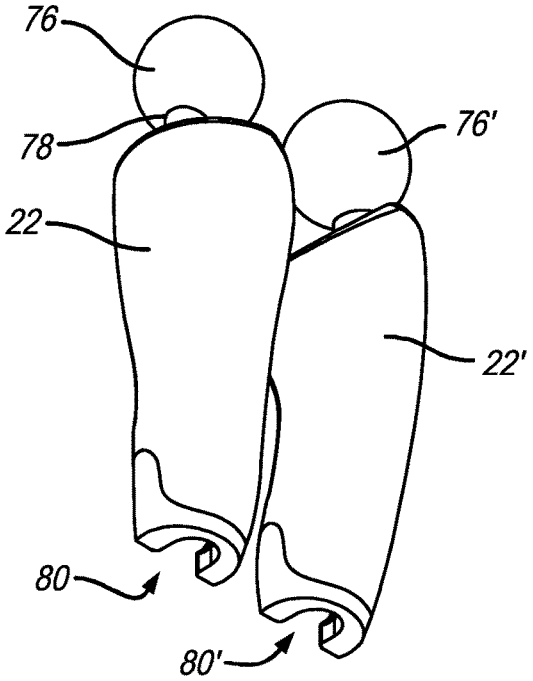
FIG. 9C is a perspective view illustrating the front, bottom and left sides of the pair of thighs of FIG. 9A.
Figure 9D:
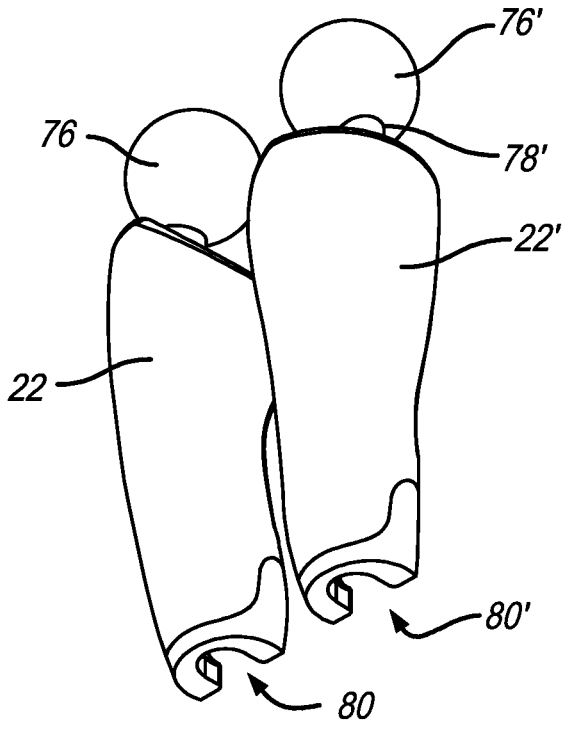
FIG. 9D is a perspective view illustrating the front, bottom and right sides of the pair of thighs of FIG. 9A.
Figure 9E:
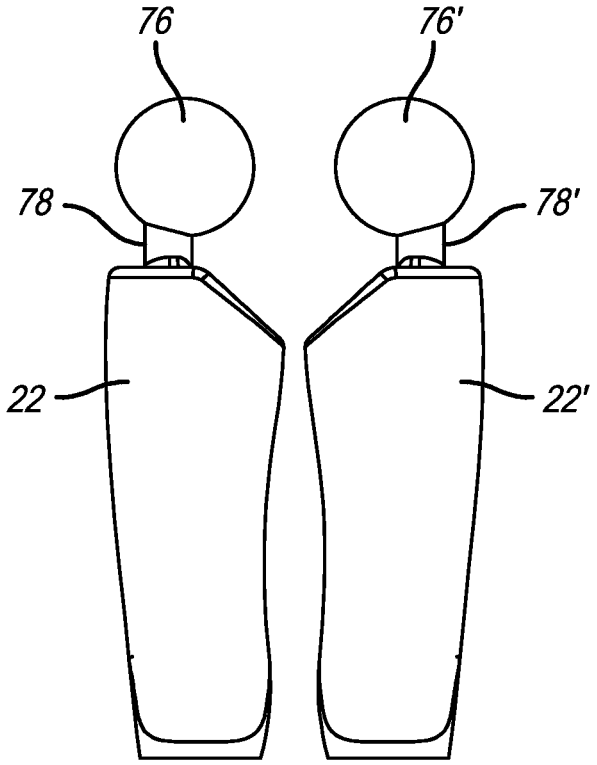
FIG. 9E is a front elevation view of the pair of thighs of FIGS. 9A-9D.
Figure 9F:
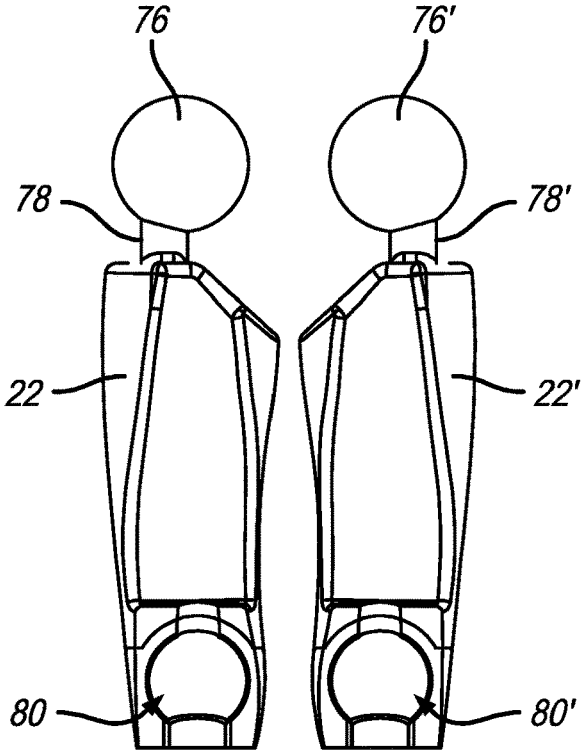
FIG. 9F is a rear elevation view of the pair of thighs of FIGS. 9A-9D.
Figure 9G:
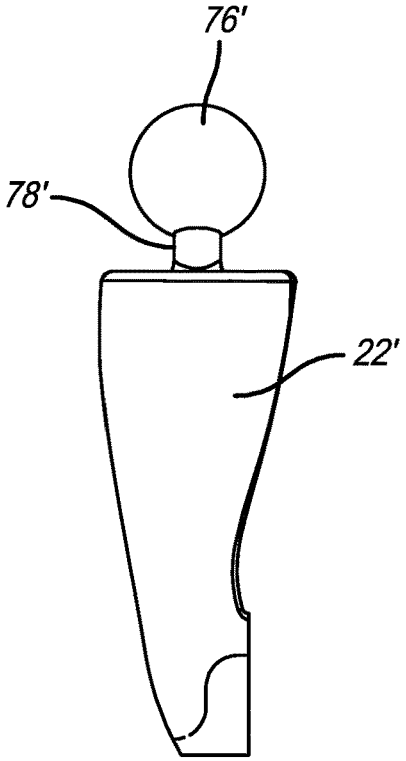
FIG. 9G is a right side elevation view of the pair of thighs of FIGS. 9A-9D.
Figure 9H:
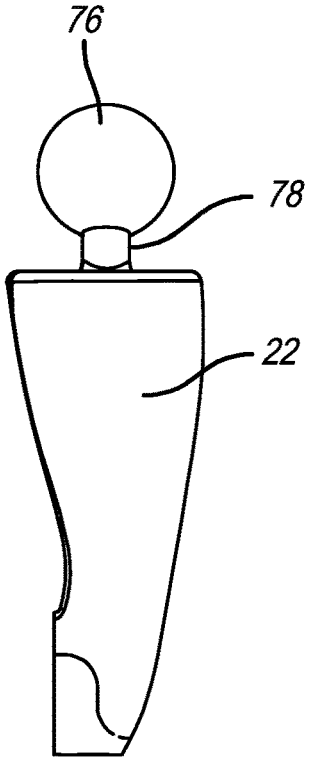
FIG. 9H is a left side elevation view of the pair of thighs of FIGS. 9A-9D.
Figure 10A:
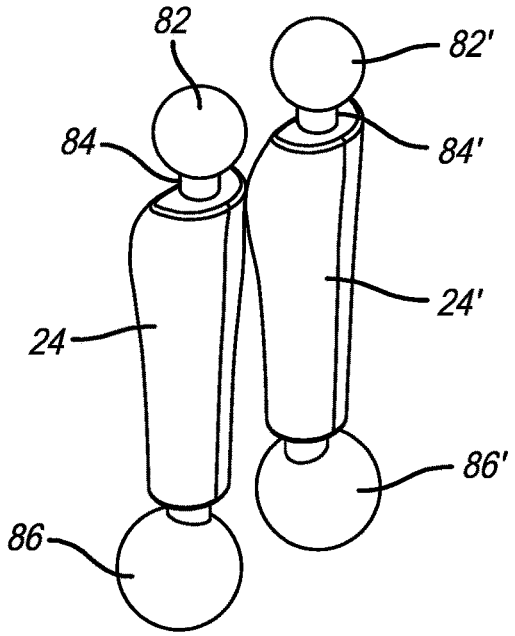
FIG. 10A is a perspective view of the front, top and left sides of one embodiment of a pair of shins of the animation puppet as disclosed herein.
Figure 10B:
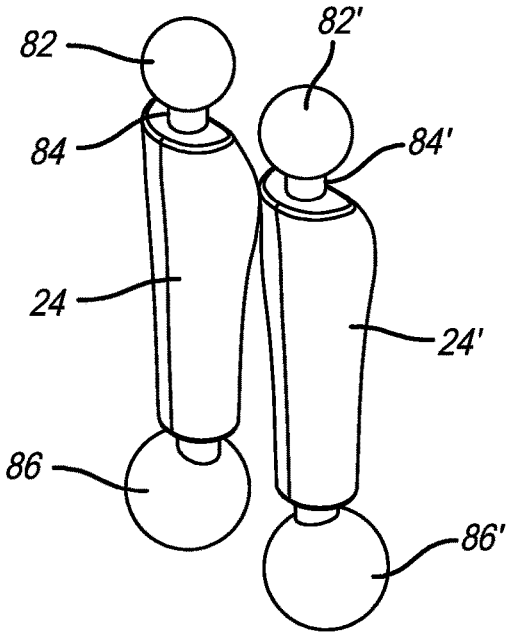
FIG. 10B is a perspective view illustrating the front, top and right sides of the pair of shins of FIG. 10A.
Figure 10C:
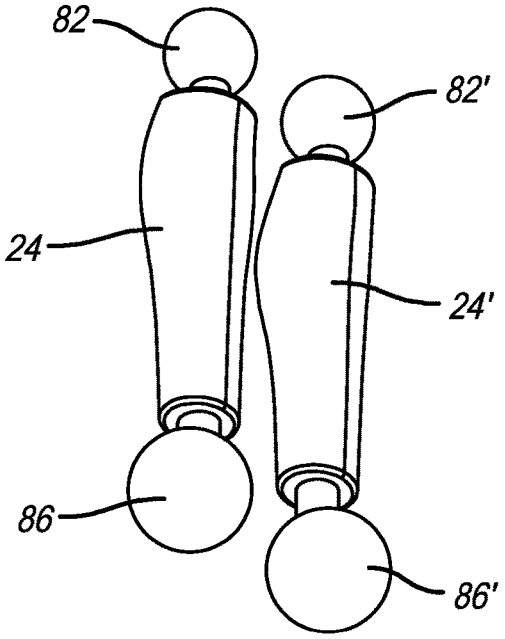
FIG. 10C is a perspective view illustrating the front, bottom and left sides of the pair of shins of FIG. 10A.
Figure 10D:
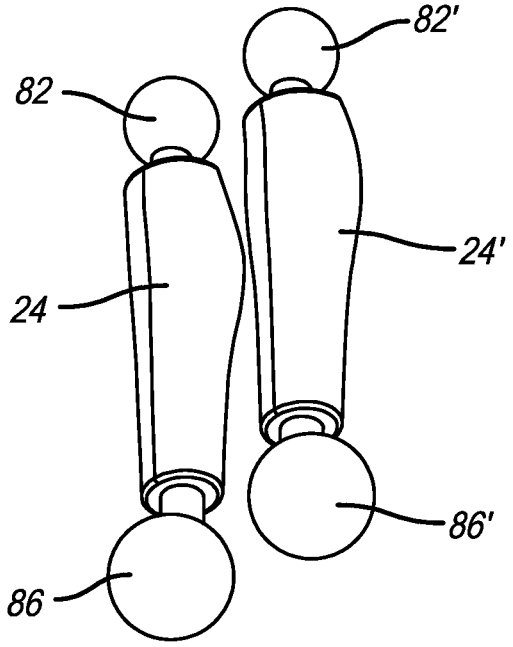
FIG. 10D is a perspective view illustrating the front, bottom and right sides of the pair of shins of FIG. 10A.
Figure 10E:
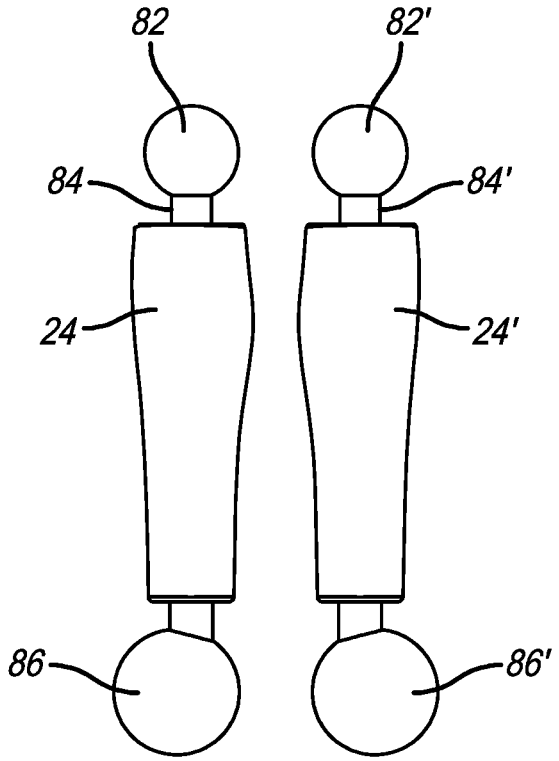
FIG. 10E is a front elevation view of the pair of shins of FIGS. 10A-10D.
Figure 10F:
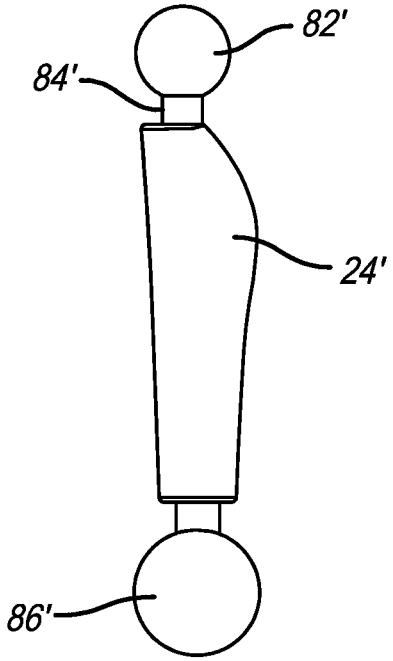
FIG. 10F is a right side elevation view of the pair of shins of FIGS. 10A-10D.
Figure 10G:
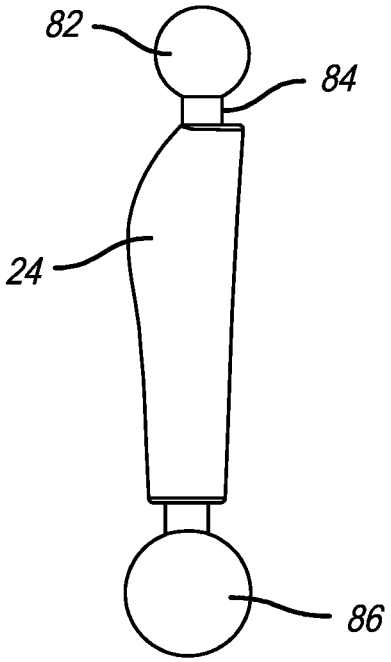
FIG. 10G is a left side elevation view of the pair of shins of FIGS. 10A-10D.
Figure 11A:
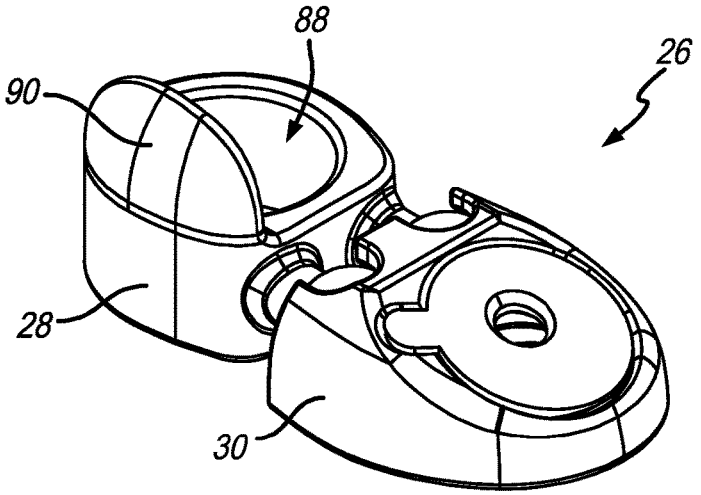
FIG. 11A is a perspective view of the front, top and left sides of one embodiment of a foot of the animation puppet as disclosed herein.
Figure 11B:
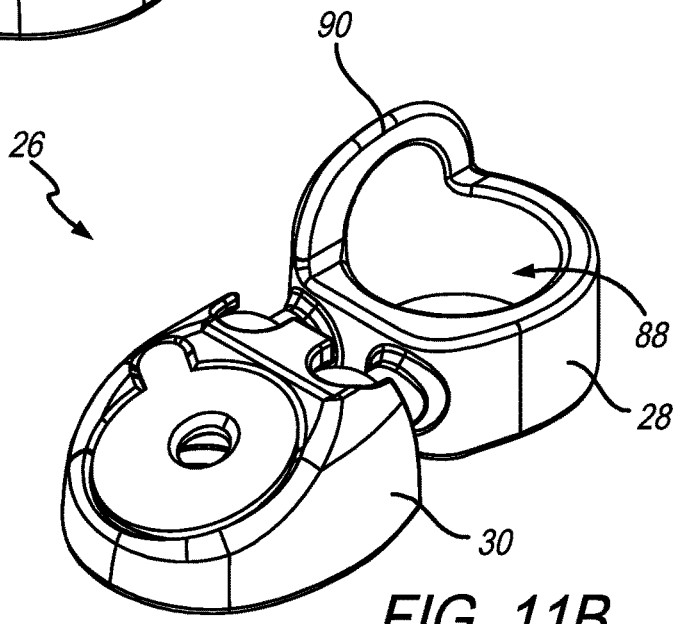
FIG. 11B is a perspective view illustrating the front, top and right sides of the foot of FIG. 11A.
Figure 11C:
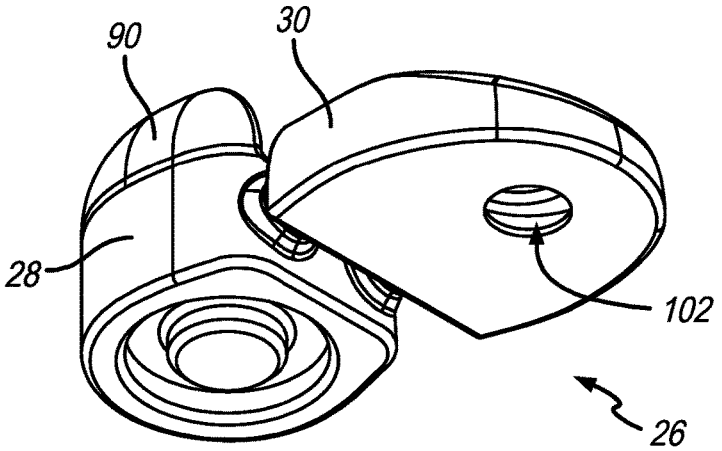
FIG. 11C is a perspective view illustrating the front, bottom and left sides of the foot of FIG. 11A.
Figure 11D:
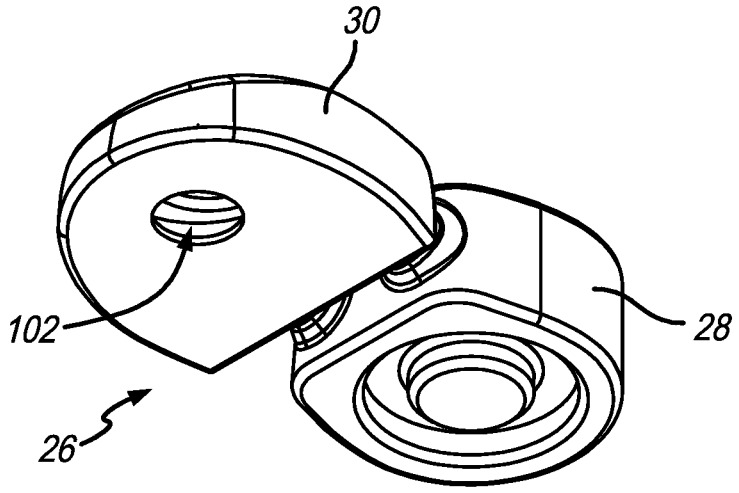
FIG. 11D is a perspective view illustrating the front, bottom and right sides of the foot of FIG. 11A.
Figure 11E:
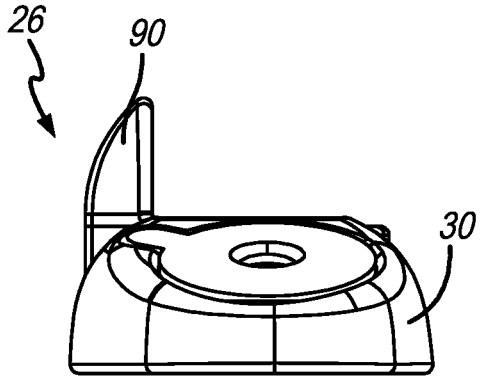
FIG. 11E is a front elevation view of the foot of FIGS. 11A-11D.
Figure 11F:
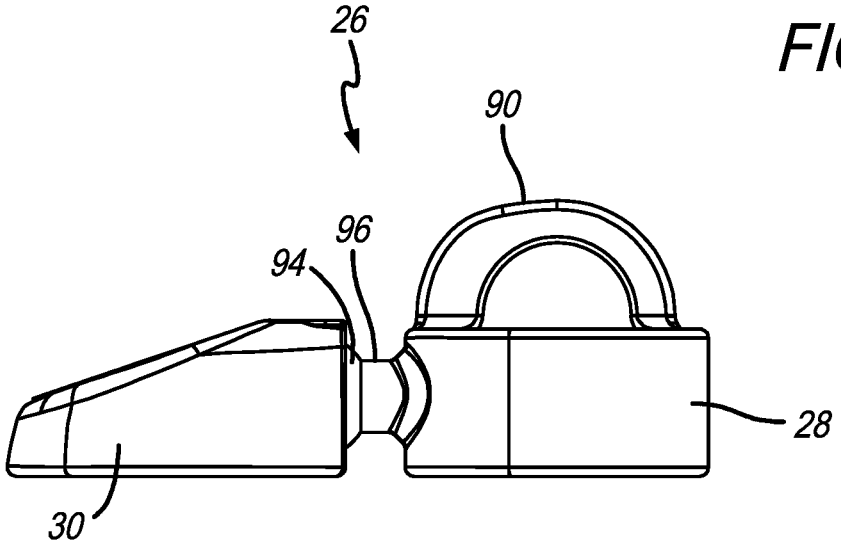
FIG. 11F is a right side elevation view of the foot of FIGS. 11A-11D.
Figure 11G:
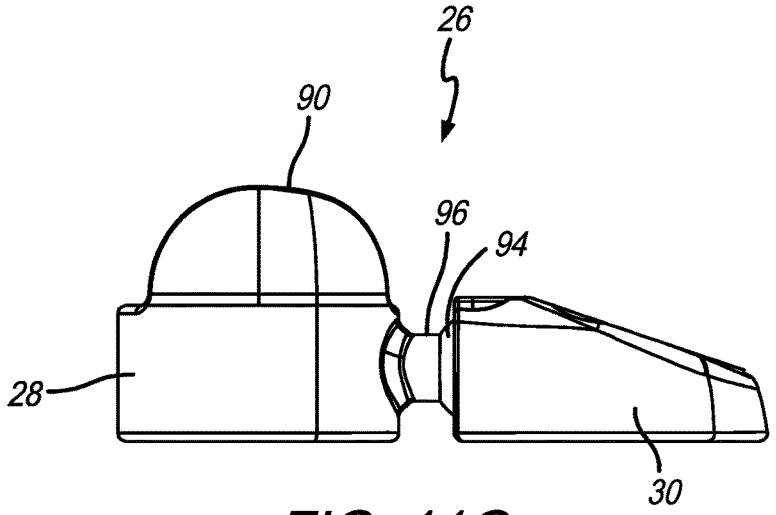
FIG. 11G is a left side elevation view of the foot of FIGS. 11A-11D.
Figure 11H:
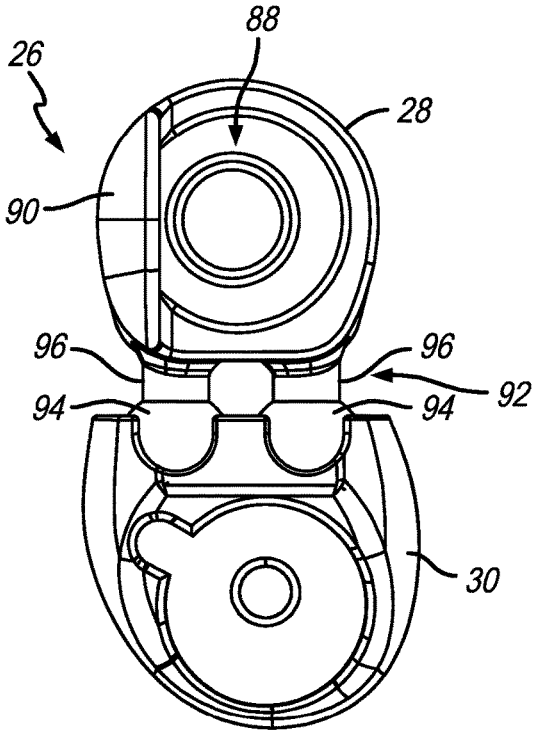
FIG. 11H is a top plan view of the foot of FIGS. 11A-11D.
Figure 11I:
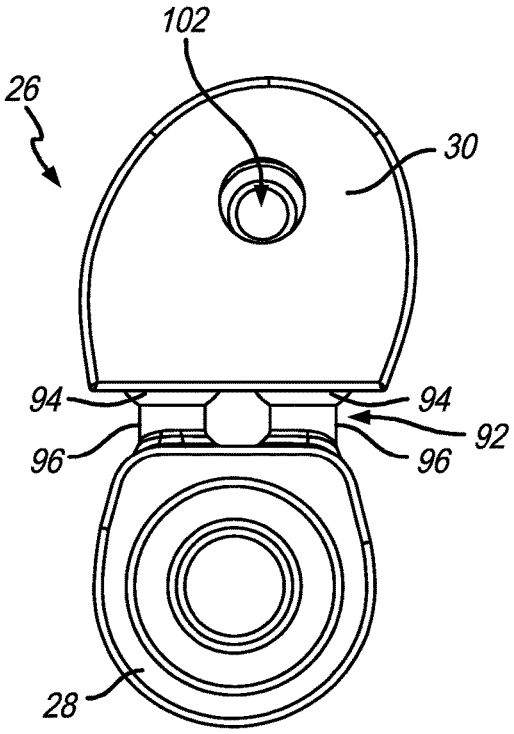
FIG. 11I is a bottom plan view of the foot of FIGS. 11A-11D.
Figure 12A:
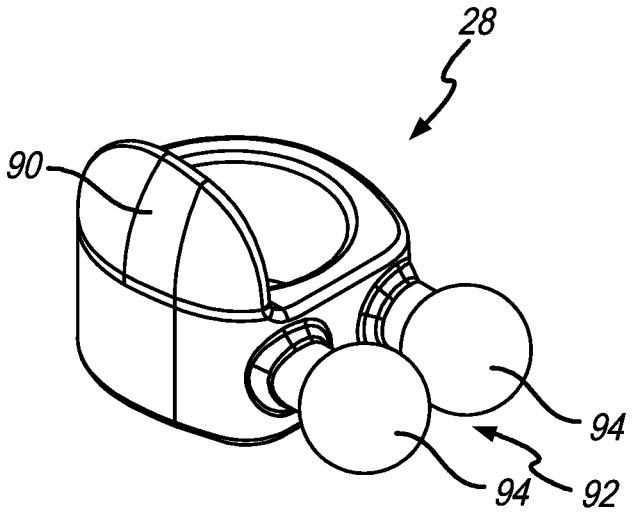
FIG. 12A is a perspective view of the front, top and left sides of one embodiment of a heel of the animation puppet as disclosed herein.
Figure 12B:
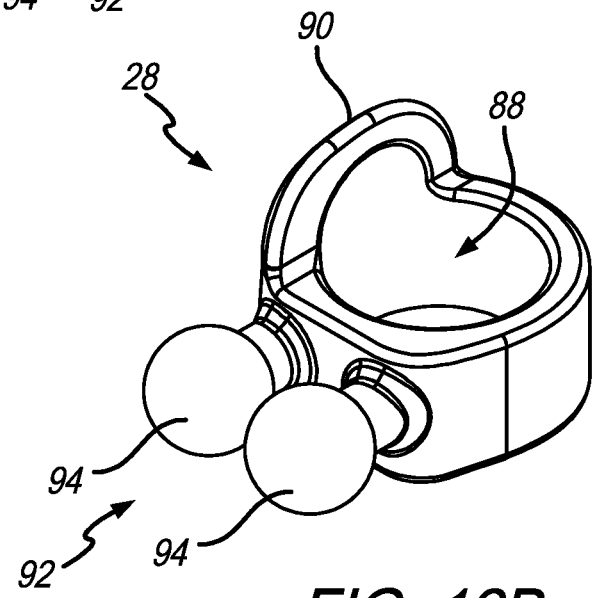
FIG. 12B is a perspective view illustrating the front, top and right sides of the heel of FIG. 12A.
Figure 12C:
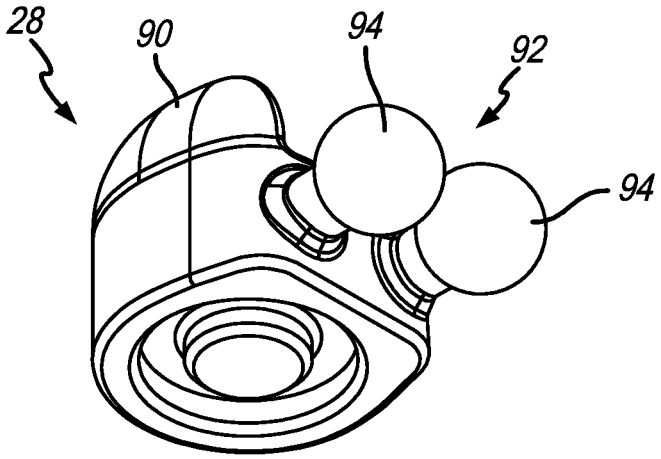
FIG. 12C is a perspective view illustrating the front, bottom and left sides of the heel of FIG. 12A.
Figure 12D:
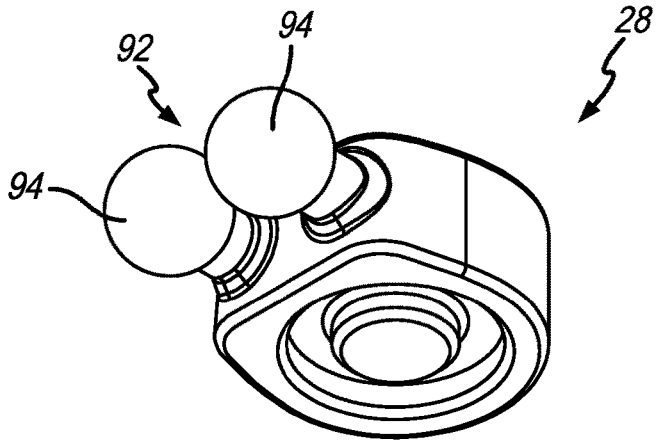
FIG. 12D is a perspective view illustrating the front, bottom and right sides of the heel of FIG. 12A.
Figure 12E:
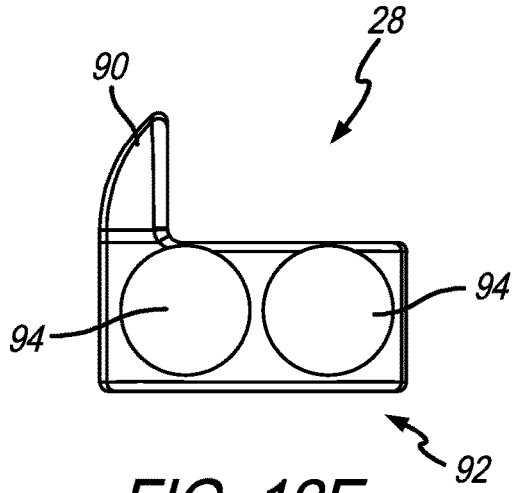
FIG. 12E is a front elevation view of the heel of FIGS. 12A-12D.
Figure 12F:
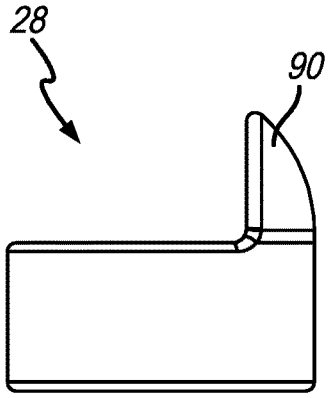
FIG. 12F is a rear elevation view of the heel of FIGS. 12A-12D.
Figure 12G:
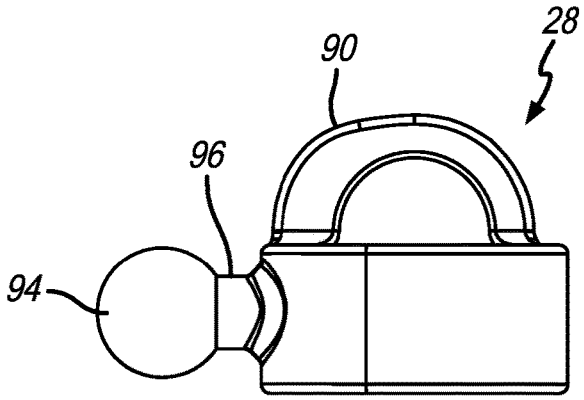
FIG. 12G is a right side elevation view of the heel of FIGS. 12A-12D.
Figure 12H:
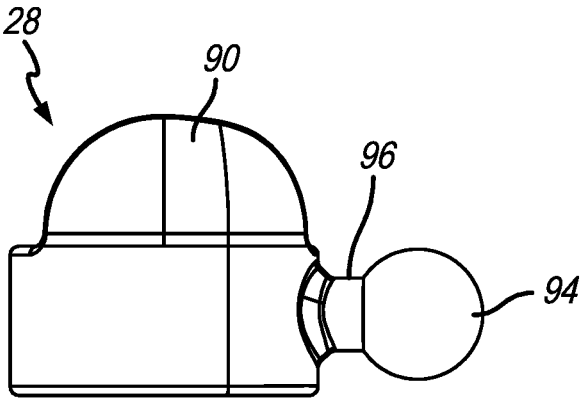
FIG. 12H is a left side elevation view of the heel of FIGS. 12A-12D.
Figure 12I:
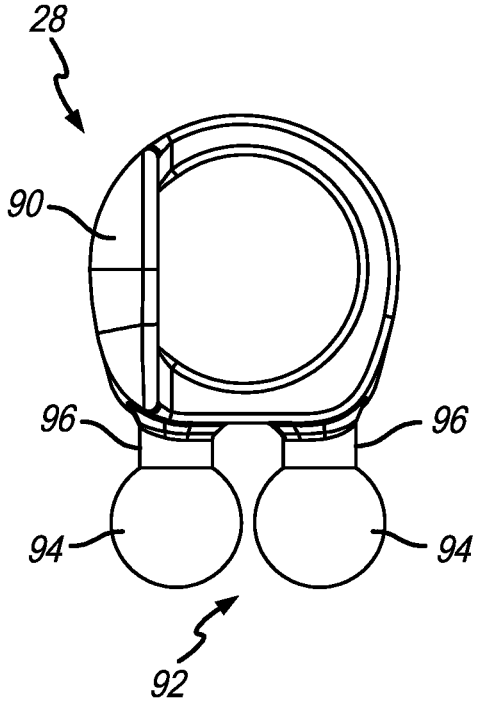
FIG. 12I is a top plan view of the heel of FIGS. 12A-12D.
Figure 12J:
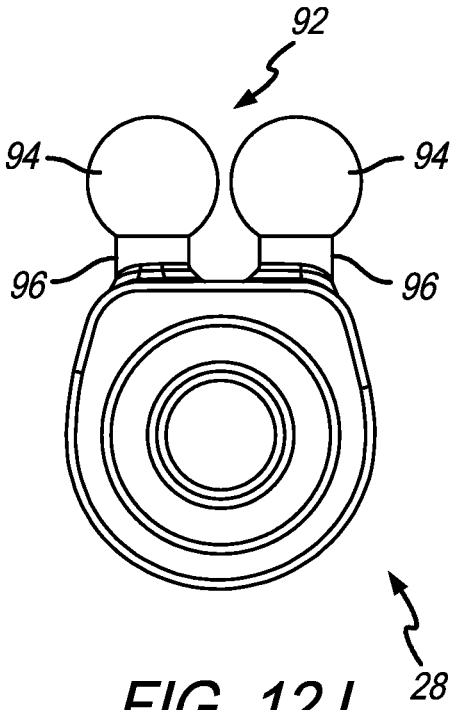
FIG. 12J is a bottom plan view of the heel of FIGS. 12A-12D.
Figure 13A:
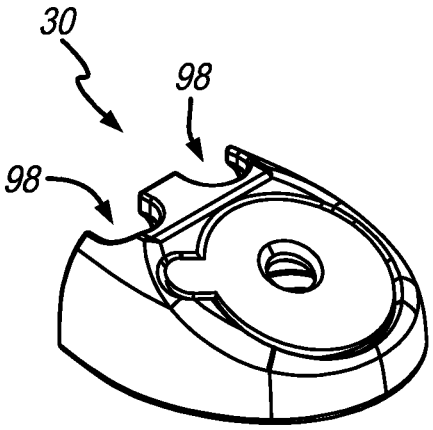
FIG. 13A is a perspective view of the front, top and left sides of one embodiment of a toe of the animation puppet as disclosed herein.
Figure 13B:
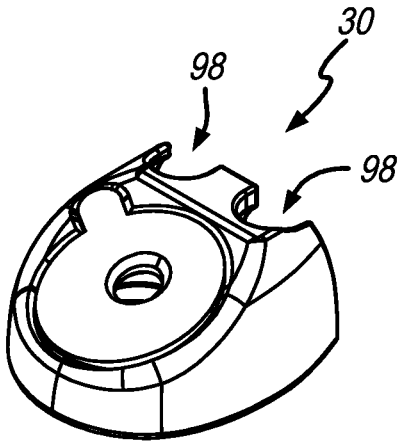
FIG. 13B is a perspective view illustrating the front, top and right sides of the toe of FIG. 13A.
Figure 13C:
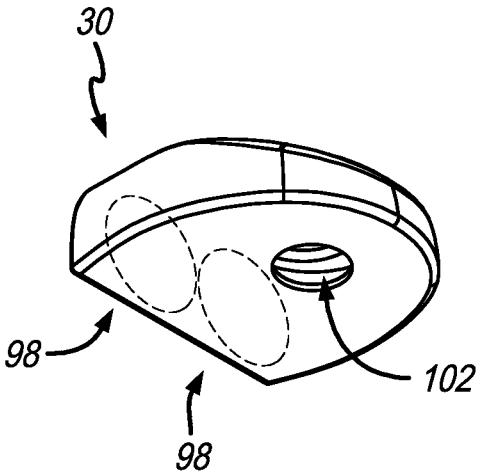
FIG. 13C is a perspective view illustrating the rear, top and left sides of the toe of FIG. 13A.
Figure 13D:
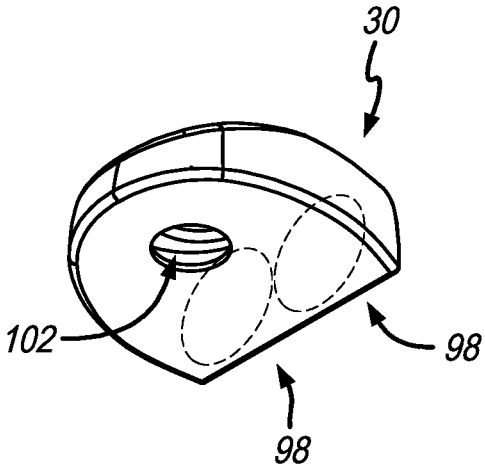
FIG. 13D is a perspective view illustrating the rear, top and right sides of the toe of FIG. 13A.
Figure 13E:
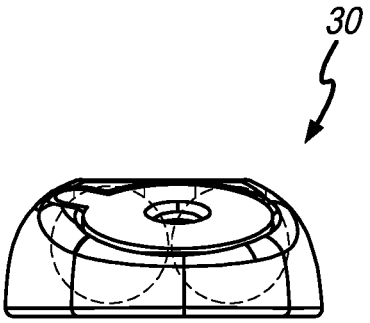
FIG. 13E is a front elevation view of the toe of FIGS. 13A-13D.
Figure 13F:
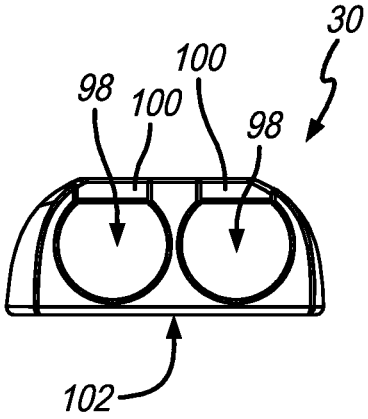
FIG. 13F is a rear elevation view of the toe of FIGS. 13A-13D.
Figure 13G:
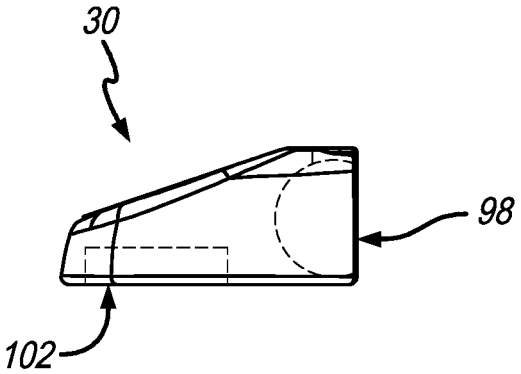
FIG. 13G is a right side elevation view of the toe of FIGS. 13A-13D.
Figure 13H:
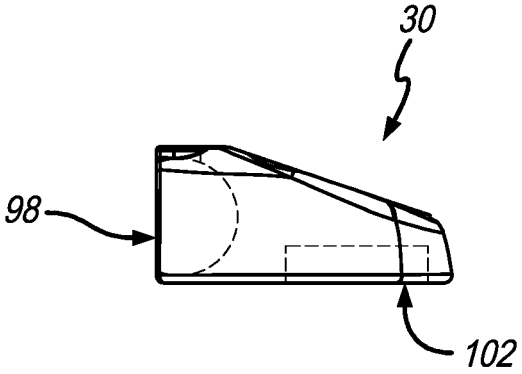
FIG. 13H is a left side elevation view of the toe of FIGS. 13A-13D.
Figure 13I:
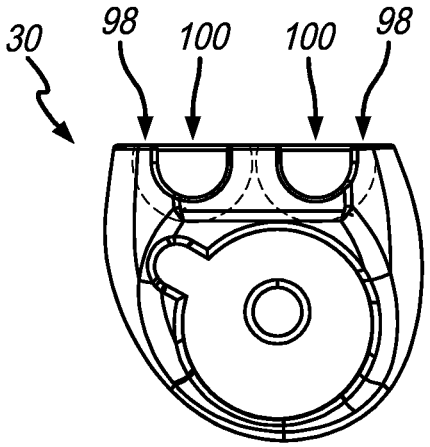
FIG. 13I is a top plan view of the toe of FIGS. 13A-13D.
Figure 13J:
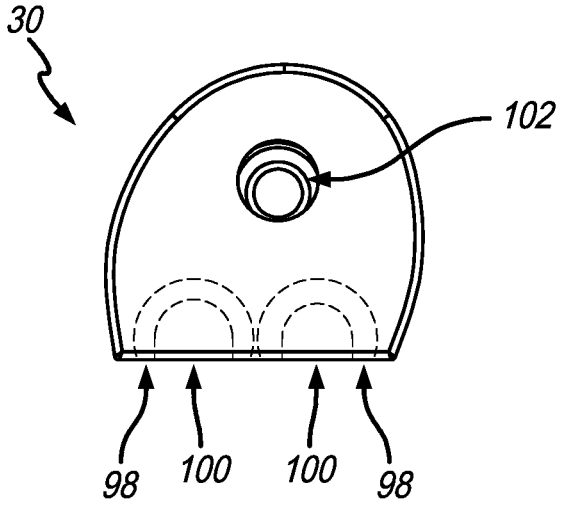
FIG. 13J is a bottom plan view of the toe of FIGS. 13A-13D.
Figure 14A:
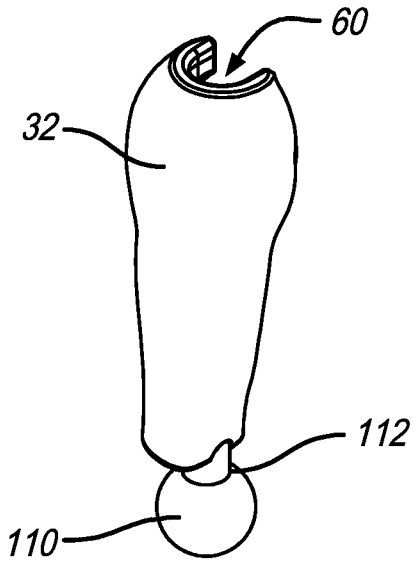
FIG. 14A is a perspective view of the front, top and left sides of one embodiment of a right arm of the animation puppet as disclosed herein.
Figure 14B:
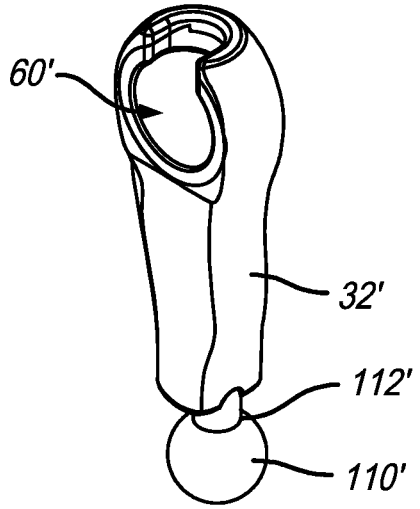
FIG. 14B is a perspective view of the front, top and left sides of one embodiment of a left arm of the animation puppet as disclosed herein.
Figure 14C:
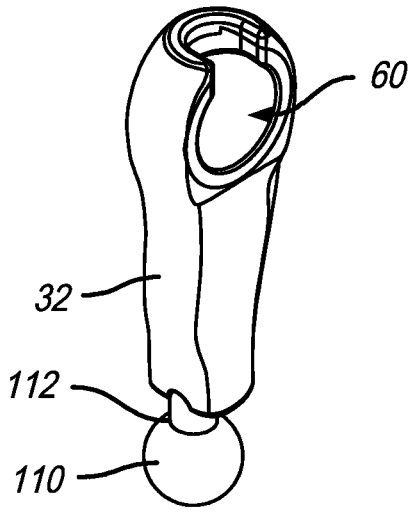
FIG. 14C is a perspective view of the front, top and right sides of the right arm as disclosed in FIG. 14A.
Figure 14D:
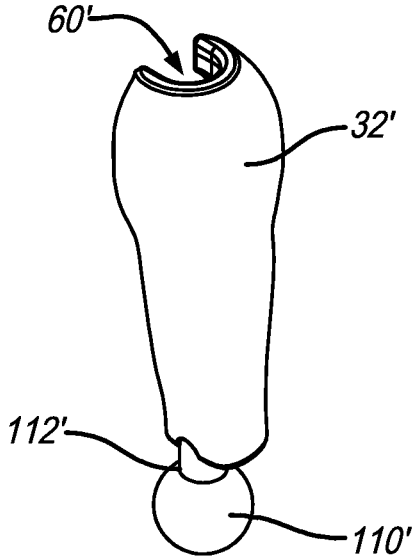
FIG. 14D is a perspective view of the front, top and right sides of the left arm as disclosed in FIG. 14B.
Figure 14E:
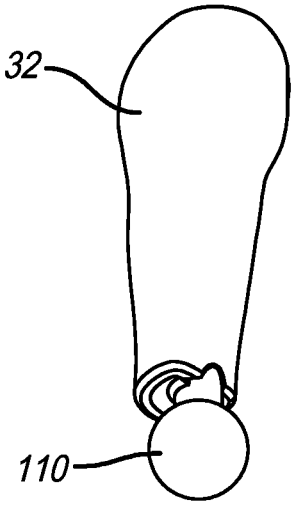
FIG. 14E is a perspective view of the front, bottom and left sides of the right arm as disclosed in FIGS. 14A and 14C.
Figure 14F:
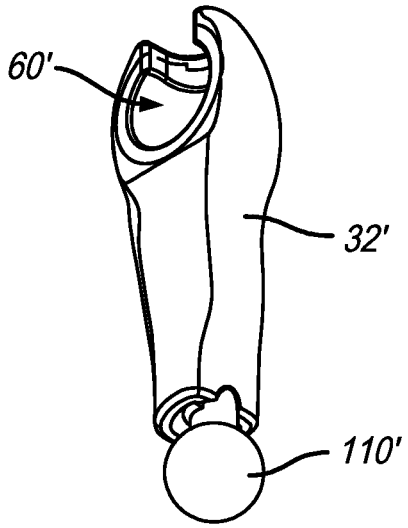
FIG. 14F is a perspective view of the front, bottom and left sides of the left arm as disclosed in FIGS. 14B and 14D.
Figure 14G:
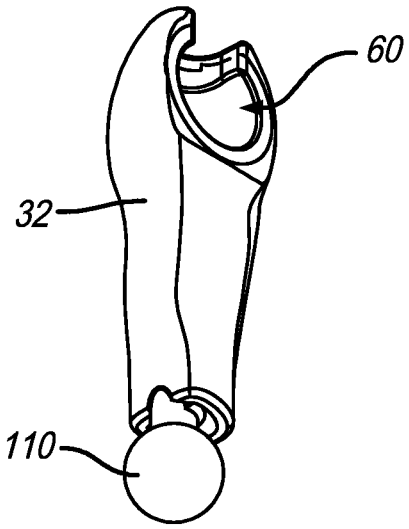
FIG. 14G is a perspective view of the front, bottom and right sides of the right arm as disclosed in FIGS. 14A, 14C, and 14E.
Figure 14H:
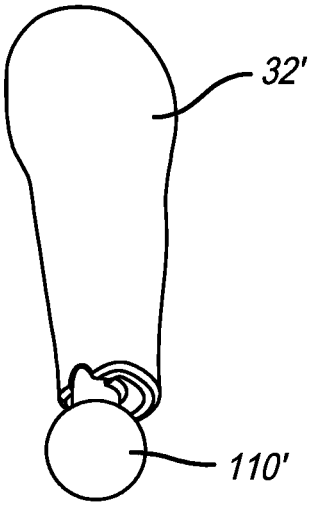
FIG. 14H is a perspective view of the front, bottom and right sides of the left arm as disclosed in FIGS. 14B, 14D, and 14F.
Figure 14I:
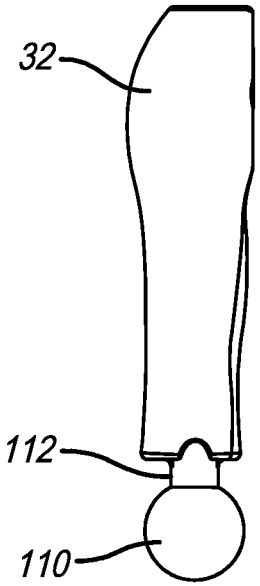
FIG. 14I is a front elevation view of the right arm of FIGS. 14A, 14C, 14E, and 14G.
Figure 14J:
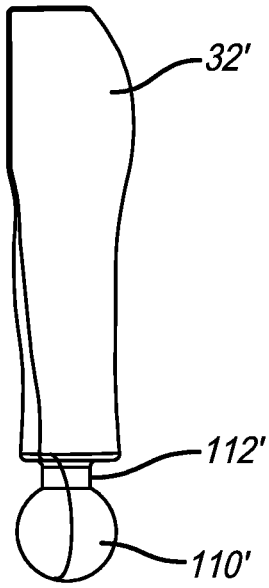
FIG. 14J is a front elevation view of the left arm of FIGS. 14B, 14D, 14F, and 14H.
Figure 14K:
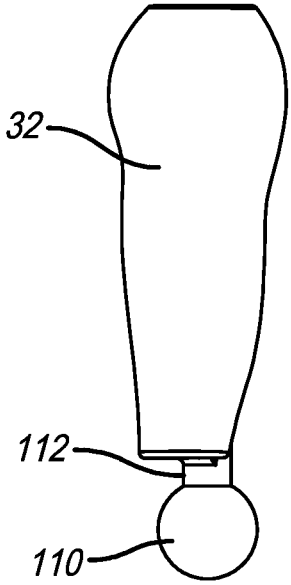
FIG. 14K is a left side elevation view of the right arm of FIGS. 14A, 14C, 14E, and 14G.
Figure 14L:
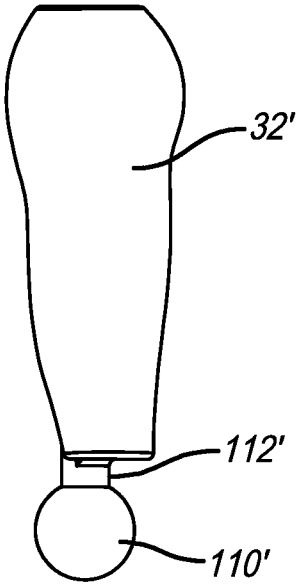

As shown best in FIG. 9F, the thighs 22, 22' both include respective knee sockets 80, 80' configured for similar snap-fit engagement with a respective set of knee ball grips 82, 82', which are best shown in FIGS. 10A-10G, thereby forming a knee joint. The knee joint is generally shown as a ball-and-socket joint, but it may also function as a hinge joint, but with the added freedom to rotate beyond a single hinge axis within a constrained range, which provides more flexibility to exaggerate natural human-like movement. Similar to the above, the knee ball grips 82, 82' are offset from the main body of the thighs 24, 24' by an extension 84, 84' similar to that of the extension 78, 78'. On a side opposite the knee ball grips 82, 82', the thighs 24, 24' also include a respective set of ankle ball grips 86, 86' configured for snap-fit engagement with a respective set of ankle sockets 88, 88' in the heels 28, 28' (FIGS. 11A, 11B and 11H). In this respect, the knee ball grips 82, 82' may be the same size or a different size relative to the ankle ball grips 86, 86'. In an embodiment wherein the knee ball grips 82, 82' are a different size than the ankle ball grips 86, 86', the shins 24, 24' can only be installed in one direction, i.e., the knee ball grips 82, 82' would only be sized for selective engagement with the knee sockets 80, 80' and the ankle ball grips 86, 86' would only be sized for selective engagement with the ankle sockets 88, 88'. Preferably, the knee joint formed by the interconnection of the knee ball grips 82, 82' with the respective set of knee sockets 80, 80' meets and exceeds the natural range of joint motion in flexion, extension, and internal rotation of the human knee, and therefore increases the range of motion and the positioning capacity of the animation puppet 10, relative to other stop-motion puppets and ball and socket toys. In this respect, the knee joint formed by the respective knee ball grips 82, 82' and the knee sockets 80, 80' provides for flexion of up to 130 degrees (allowing the shins 24, 24' to touch the thighs 22, 22'), extension up to 15 degrees (allowing the shins 24, 24' to be nearly linear with the thighs 22, 22'—i.e., straight legs 20, 20'), and internal rotation up to 10 degrees (allowing twisting of the shins 22, 22' relative to the midline).

The ankle sockets 88, 88' are more specifically illustrated with respect to a single foot 26 in FIGS. 11A-11I and a single heel 28 in FIGS. 12A-12I. Although, a person of ordinary skill in the art will readily recognize that the opposite hand foot 26' and heel 28' are merely a mirror image of the foot 26 and the heel 28. As shown, the ankle socket 88 is generally formed as a circular bore having a partial cut-out opening in the heel 28 of the foot 26—this partial cut-out forms a somewhat upwardly extending support cuff 90 that permits snap-in engagement of the ankle ball grip 86, while providing inner lateral support thereto. Accordingly, the ankle socket 88' would include a similar upwardly extending support cuff 90'. In a preferred embodiment, each of the ankle ball grips 86, 86' extend outwardly from each respective shin 24 by an extension (unnumbered) similar to the ball grips 76, 76' and the extensions 78, 78'. In other words, such extensions preferably do not extend through the center of each respective ball grip 86, 86', but rather through an angled offset position to help more accurately replicate the natural range of motion.

As shown best in FIGS. 12A-12J, the heel 28 further includes a double toe joint 92 having a pair of toe ball grips 94 extending outwardly therefrom as coupled to an extension 96. The double toe joint 92 increases the stability, strength, precision and articulation of the animation puppet 10, thereby enabling the animation puppet 10 to be positioned upright, freestanding, and on to one toe 30, while being able to hold the weight of the animation puppet 10 in that pose for an extended duration (and possibly indefinitely), e.g., as shown in FIGS. 18, 22, 23 and 27. The toe ball grips 94 similarly couple with a toe socket 98 formed from the toe 30, as illustrated best in FIGS. 13A-13J. The toe sockets 98 may further include an engagement channel 100 relatively smaller than the socket 98, to help facilitate select slide-in or snap-fit engagement of the toe ball grips 94 with the toe sockets 98. Furthermore, as also shown in FIGS. 12A-12J, the toe 30 may include a housing 102 for permanent or selective reception of a magnet 104 (FIG. 24). In the embodiment shown with respect to FIGS. 11C, 11D, 11I and 13A-13J, the housing 102 is formed generally from a bottom portion of the toe 30 and is generally open on one side. Although, other embodiments might include opening the housing 102 to the top of the toe 30 for drop-in reception of the magnet 104, or the magnet 104 could be fully enclosed within the toe 30. In another aspect of this embodiment, the toe 30 may be made from a metal or magnetized material to help facilitate retention of the magnet 104 within the housing 102. While the housing 102 is shown as being generally circular in construction, the housing 102 may be made from other sizes and shapes. For example, decreasing the size of the housing 102 may permit forming multiple housings in the toe 30 configured to selectively receive one or more of the magnets. This magnet 104 (optional) is preferred as it can be used to more accurately and permanently position the animation puppet 10, such as on a portable mount 106, preferably including a metal or magnetized mounting surface 108 (FIGS. 23-27).

The interconnection of the heel 28 with the toe 30 is designed to facilitate a natural range of motion of the human ankle, foot and toe. For instance, the interconnection of the ankle ball grips 86, 86' with the ankle ball sockets 88, 88' of the animation puppet 10 facilitates a natural range of supination and pronation rotation, which greatly increases range of motion. In this respect, the ankle joint formed by the respective ankle ball grips 86, 86' and the ankle ball sockets 88, 88' provides for flexion of up to 45 degrees (allowing the heels 28, 28' to bend so the toes 30, 30' can point up), extension up to 20 degrees (allowing the heel 28, 28' to bend so the toes 30, 30' can point down), pronation up to 30 degrees (allowing the heels 28, 28' to turn so the sole faces out), and supination up to 20 degrees (allowing the heels 28, 28' to turn so the sole faces in).

Moreover, the construction and shape of the arm 32, the forearm 34, the hand 36, and the fingers 38 are shown and described in more detail with respect to FIGS. 14A-14L, 15A-15L, and 16A-16H. In this respect, FIGS. 14A-14L illustrate the arm 32 including the aforementioned arm sockets 60, 60' coupled at one end thereof with an elbow ball grip 110, 110' extending out from the arm 32 by an extension 112, 112' at an opposite end thereof. The elbow ball grip 110, 110' is of a size and shape for selected snap-fit engagement with a corresponding elbow socket 114, 114', shown formed in the forearm 34, 34' in FIGS. 15A-15L, to form an elbow joint. The elbow joint is generally shown as a ball-and-socket joint, but it may also function as a hinge joint, but with the added freedom to rotate beyond a single hinge axis within a constrained range, which provides more flexibility to exaggerate natural human-like movement. Preferably, the elbow joint formed by the interconnection of the elbow ball grips 110, 110' with the respective set of elbow sockets 114, 114' meets and exceeds the natural range of joint motion in flexion, extension, supination, and pronation of the human elbow, and therefore increases the range of motion and the positioning capacity of the animation puppet 10, relative to other stop-motion puppets and ball and socket toys. In this respect, the elbow joint formed by the respective elbow ball grips 110, 110' and the elbow sockets 114, 114' provides for flexion of up to 150 degrees (allowing the forearm 34, 34' to touch the arm 32, 32'), extension up to 180 degrees (allowing the forearm 34, 34' to be nearly linear with the arm 32, 32'—i.e., straight arms), supination up to 90 degrees (allowing the forearm 34, 34' to be turned so the palms 120, 120' face up), and pronation up to 90 degrees (allowing the forearm 34, 34' to be turned so the palms 120, 120' face down).

The forearm 34 further includes a wrist socket 116, 116' at an end opposite the elbow socket 114, 114'. The wrist sockets 116, 116' are similarly configured for snap-fit reception of a corresponding wrist ball grip 118, 118' (thereby forming a wrist joint), as shown with respect to FIGS. 16A-16H. The wrist ball grips 118, 118' extend out from a respective palm 120, 120' of the hand 36, 36' by a similarly constructed extension 122, 122'. The wrist joints preferably meet or exceed the natural range of joint motion of the human wrist in flexion, extension, radial deviation, and ulnar deviation. This increased range of motion in the wrist joints of the animation puppet 10 facilitates positioning into more poses than traditional stop-motion puppets and ball-and-socket toys. In this respect, the wrist joint formed by the respective wrist sockets 116, 116' and the wrist ball grips 118, 118' provides for flexion between approximately 80 to 90 degrees (allowing the palms 120, 120' to bend toward the forearms 34, 34'), extension up to 70 degrees (allowing the palms 120, 120' to bend toward the forearms 34, 34' in an opposite direction), radial deviation up to 20 degrees (allowing the thumbs 132, 132' to bend toward the forearms 34, 34'), and ulnar deviation between approximately 30 and 50 degrees (allowing the pinky finger to bend toward the ulna).

The palms 120, 120' are preferably in the form of a human hand, as shown, and may further include a housing 124, 124' to selectively receive and retain a hand magnet 126, 126' (FIG. 23), similar to the housing 102 and the magnet 104 described above. In this respect, the hand magnet 126 in one or more of the hands 36, 36' may be used to selectively position and pose the animation puppet 10, as shown, e.g., in FIGS. 24-26 (e.g., a handstand supporting the weight of the animation puppet 10), on the mounting surface 108 of the mount 106.

The hand 36 may include a series of the fingers 38, such as a set of proximal phalanx 128 and/or a set of distal phalanx 130. In the preferred embodiment disclosed herein the fingers 38 and the thumbs 132, 132' have been simplified to have two joints instead of the three joints in the human hand. The base of the thumb joint uses the design and structure of the ankle joint to function with the widest range of motion. Although, off course, the animation puppet 10 may include a hand that includes a set of middle phalanx as well (not shown). Preferably, the proximal phalanx 128 connects to the palm 120 by way of a similar ball and socket design, whereby the proximal phalanx 128 are able to have a high degree of rotation (e.g., 360 degree rotation) relative to the palm 120. Similarly, the distal phalanx 130 connects to the proximal phalanx 128 by way of a similar ball and socket design (shown generally in FIGS. 16A-16H), whereby the distal phalanx 130 are able to have a high degree of rotation (e.g., 360 degree rotation) relative to the proximal phalanx 128. The ball/socket combination connecting the palm 120, the proximal phalanx 128, the optionally and not shown middle phalanx, and the distal phalanx 130 may be mixed and matched. For example, in one embodiment, the palm 120 may include a ball grip that fits into a socket in the proximal phalanx 128, or the palm 120 may include a socket that selectively receives for snap-fit reception therein a ball grip formed from the proximal phalanx 128. Similarly, the proximal phalanx 128 may include a ball grip that fits into a socket in the distal phalanx 130, or the proximal phalanx 128 may include a socket that selectively receives for snap-fit reception therein a ball grip formed from the distal phalanx 130. The hand 36 is also shown in FIGS. 16A-16H as having a thumb 132, including a lower phalange 134 and an upper phalange 136. The thumb 132 and related lower phalange 134 and/or the upper phalange 136 may interconnect byway of one or more of the aforementioned ball/socket combinations.

Further to the above, FIGS. 17-33 and 54 illustrate the wide range of positionable combinations of position-posing the animation puppet 10 as disclosed herein. As shown, the hip joint formed by coupling of the hip ball grips 76, 76' with the hip sockets 74, 74' provides a wide range of natural articulated movement, while providing the strength required to hold the animation puppet 10 in the positions shown, e.g., in FIGS. 17-33 and 54. In this respect, ankle ball grips 86, 86' are similarly selectively received within the respective ankle sockets 88, 88' (thereby forming an ankle joint) for providing a wide range of natural articulated movement (as shown in the drawings), while at the same time providing the strength required to hold the animation puppet 10 in the poses disclosed herein. Although, in general, the joints formed by the interconnection of the ball grips and sockets are designed to create an optimum range of motion (e.g., 360 degrees) and strength to enable the animation puppet 10 to be positioned into the most demanding, expressive, and gravity defying poses, while maintaining the ability to hold the animation puppet 10 in those poses for as long as the animator or artist needs. Preferably the ball grips seat substantially within their respective sockets (e.g., by snap-fit engagement or otherwise) such that the outer diameter of the ball grips are pre-tensioned to the inside diameter of the sockets to provide the desired resistance and the desired rotational movement (e.g., 360 degree rotation). This is generally accomplished by forming the various components of the animation puppet 10 from industrial strength materials that permit precision manufacturing to precise tolerances wherein the joints have enough friction to hold the animation puppet 10 on one hand, while providing for smooth motion when repositioning the animation puppet 10, on the other hand. This ball and socket combination is particularly preferred because it provides for a larger contact surface area about the area of rotation or pivoting during positioning movement. This, as a result, provides for more consistent resistance and gripping across all surface areas to provide optimum functionality of the joints.

In general, the aforementioned components of the animation puppet 10 are preferably made from materials having physical characteristics such as (a) high abrasion resistance, which provides increased longevity of the joint function and an added coefficient of friction between ball grips and sockets (which contributes to the proper out-of-the box tensioning of the joints); (b) specific gravity, where weight contributes to the functional balance of the animation puppet 10 during positioning with the hand; and (c) resilience or resistance to creep (i.e., the rate of deformation of solid material under long-term exposure to mechanical stress, such as the ball grips being compressed within the respective sockets). More specifically, the ball grips preferably include a rigid core over molded with an abrasion resistant, soft rubber-like material such as TPE, which increases longevity. The sockets are preferably made from a resilient industrial strength rigid plastic that provides an appropriate degree of flex in the joint.

Furthermore, the animation puppet 10 as disclosed herein may be made as part of a streamlined production process, effectively eliminating the need for an underlying metal skeletal structure (e.g., an armature). In this respect, the aforementioned components of the animation puppet 10 were designed in CAD and optimized for precision injection molding and mass production, thereby also reducing the manual machining and labor required to manufacture the animation puppet 10. As such, the animation puppet 10 provides an animation-ready, precision-positionable animation puppet at a much lower cost to the consumer.

In another aspect of the embodiments disclosed herein, the animation puppet 10 is illustrated in FIGS. 34-36 with respect to an alternative toe 138 that includes an upwardly facing magnet receiving chamber 140 having a size and shape for select drop-in reception and/or pull-out removal of a toe magnet 142. The alternative toe 138 may couple to the heel 28 or to an alternative heel 144, in accordance with the embodiments described above with respect to the toe 30 and the heel 28. As more specifically shown in FIG. 35, the alternative heel 144 may include an optional heel magnet 146 inset therein (e.g., permanently or selectively removable therefrom). The optional heel magnet 146 may permit magnetized coupling to a metal surface, in accordance with the embodiments disclosed herein, to provide additional flexibility and mounting options for the animation puppet 10.

More specifically with respect to the alternative toe 138, FIG. 34 illustrates the animation puppet 10 coupled to a mounting surface 148 by drop-in placement of the magnet toe 142 into the magnetic receiving chamber 140. In one embodiment, the magnet receiving chamber 140 is a bore having a first diameter formed into a top surface of the alternative toe 138 as best shown in FIG. 34. This permits the toe magnet 142 having a similar (e.g., slightly smaller) diameter to be selectively received therein or removed therefrom, as needed or desired. FIGS. 35 and 36 further illustrate that the magnet receiving chamber 140 may further include a relatively smaller diameter aperture 150 that passes through the thickness of the alternative toe 138. Here, the animation puppet 10 may be secured in position by threading a screw through the thickness of the alternative toe 138. In this respect, the relatively larger screw head would sit within the magnetic receiving chamber 140 while the threads and shank are allowed to pass therethrough by way of the aperture 150. This allows the animation puppet 10 to be secured by way of traditional tie-down.

The toe magnet 142 can be inserted into the magnetic receiving chamber 140 and placed in close enough proximity to the mounting surface 148 that the toe magnet 142 snaps into magnetic attachment thereto. This allows for further structural manipulation of the animation puppet 10 relative to a single point (or multiple points if both of the alternative toes 138, 138' are coupled to the mounting surface 148). This allows, e.g., as shown best in FIG. 34, for the alternative toe 138 to be bent relative to the alternative heel 144, which may permit animating the puppet 10 to show, for example, that the animation puppet 10 is walking, running, etc. while keeping the animation puppet 10 secured to the mounting surface 148.

In another aspect of the embodiments disclosed herein, the animation puppet 10 is illustrated generally in FIGS. 37-44 coupled to an extension rig 152 that terminates in a base 154 capable of being magnetically attached to the mounting surface 148, similar to the alternative toe 138. The extension rig 152 is generally formed from a series of connecting members 156 each having a generally elongated cylindrical rod 158 that terminates at each end in a respective pair of ball connectors 160 configured for snap-fit engagement with a ball connector socket 162 formed in an adapter 164. The base 154 includes its own vertical rod 166 that terminates in a base ball connector 168 similarly configured to couple with the ball connector socket 162 of the adapter 164. The ball connectors 160 preferably couple to the ball connector sockets 162 of the adapters 164 in a manner that permits 360 degree movement or near 360 degree movement relative thereto.

To form the extension rig 152 shown with respect to FIGS. 37, 43, and 44, one of the ball connector sockets 162 of the adapter 164 is snapped into engagement with the base ball connector 168 at the end of the vertical rod 166 upwardly projecting from the base 154. The other of the ball connector sockets 162 of the adapter 164 is then snapped into engagement with one of the ball connectors 160 of the connecting member 156. In turn, the other of the ball connectors 160 is snap-fit engaged with the ball connector socket 162' of another adapter 164'. Similarly, the other of the ball connector socket 162' is snap-fit engaged with the ball connector 160' of another connecting member 156'. The other of the ball connector 160' of the connecting member 156' couples for snap-fit engagement with the ball connector socket 162" of the adapter 164". Lastly, the other of the ball connector socket 162" couples to a pelvis ball connector 170 extending from the pelvis 18 by way of a rod 172. While the embodiment shown with respect to FIGS. 37, 43, and 44 illustrates the extension rig 152 having two of the connecting members 156, 156' and three of the related adapters 164, 164', 164", the number of the connecting members 156 and/or the adapters 164 may change. For example, there may be as few of none of the connecting members 156. In this embodiment, there may be one adapter 164 that couples to the base ball connector 168 and the pelvis ball connector 170. In alterative embodiments, one or more of the connecting members 156 may be added to increase the length of the extension rig 152. Each additional connecting member 156 requires an additional adapter 164 for coupling thereto. To this end, adding more of the connecting members 156 provides more points of movement relative to the base 154, thus increasing the degree of precision movement of the animation puppet 10.

FIGS. 38-42 more specifically illustrate the process for attaching and/or detaching the base 154 from a magnetized surface, such as the mounting surface 148. To start, FIG. 38 illustrates placing the base 154 flush on the mounting surface 148. The base 154 includes a plurality of magnet receiving chambers 174, which may be substantially similar in size and shape as the magnet receiving chamber 140 of the alternative toe 138. In this respect, the process for attaching and/or detaching the base 154 to the mounting surface 148 is substantially the same for both the magnet receiving chambers 140, 174.

FIG. 39 illustrates an installation tool 176 that generally includes two sections, a first insertion section 178 having a relatively smaller diameter than a second removal section 180. To attach the base 154 to the mounting surface 148, the insertion section 178 is placed near a magnetic disk 182 as shown in FIG. 40. The installation tool 176 is preferably made from a metal material so the magnetic disk 182 becomes attached thereto as shown, e.g., in FIG. 40. The magnetic disk 182 can then be placed in any one of the magnet receiving chambers 174 through drop-in reception, as shown in FIG. 41. In one embodiment, the magnetic attraction between the magnetic disk 182 and the mounting surface 148 may be relatively stronger or otherwise exceed the magnetic force between the magnetic disk 182 and the insertion section 178. In this embodiment, the magnetic disk 182 magnetically attracts to the mounting surface 148, as opposed to the insertion section 178 of the installation tool 176. Alternatively, the installation tool 176, and specifically the insertion section 178 with the magnetic disk 182 thereon could be tilted to one side to disengage the relatively flat circular cross-section from the magnetic disk 182. This results in breaking the magnetic attractive force between the insertion section 178 and the magnetic disk 182 so the magnetic disk 182 remains within the magnetic receiving chamber 174 after removal of the installation tool 176 therefrom. The base 154 is shown in FIGS. 37-38 and 41-44 having three of the magnetic receiving chambers 174 that selectively receive and retain a respective magnetic disk 182 therein.

Disengagement of the base 154 from the mounting surface 148 may be just a matter of turning around the installation tool 176 and inserting the removal section 180 into the magnetic receiving chamber 174. Here, the relatively larger circular cross-section surface area of the removal section 180 increases the surface area attraction between the installation tool 176 and the magnetic disk 182 (relative to the insertion section 178). Importantly, the magnetic attractive forces between the removal section 180 and the magnetic disk 182 may be larger than the attractive forces between the magnetic disk 182 and the mounting surface 148. As such, withdrawing the installation tool 176 out from within the magnetic receiving chamber 174 causes withdrawal of the magnetic disk 182, as the magnetic disk 182 remains attached to the removal section 180, as generally shown in FIG. 42. This quick-attachment/quick-release system can also be used with respect to the toe magnet 142 and the magnet receiving chamber 140.

FIGS. 45-50 further illustrate the extension rig 152 and the base 154. In FIGS. 45-58, the extension rig 152 includes two of the connecting members 156, 156' and is shown attached to the base 154 via the vertical rod 166 and the base ball connector 168. Each of the connecting members 156, 156' includes respective rods 158, 158', the pair of ball connectors 160, 160' (each respectively secured within the ball connector sockets 162, 162'), and the adapters 164, 164'. The extension rig 152 terminates with the pelvis ball connector 170 and the rod 172, which secure the animation puppet 10 to the extension rig 152 and the base 154. Each of the magnetic disks 182 are configured for drop-in reception into a magnetic receiving chamber 174 in the base 154, thus causing the base 154 to engage any adjacent magnetically-receptive mounting surface 148. FIG. 46 is a side elevation view of the extension rig 152 and the base 154, illustrating each of the magnetic disks 182 in exploded relation relative to the respective magnetic receiving chamber 174. FIG. 47 is a perspective view further illustrating the magnetic disks 182 in exploded relation relative to the respective magnetic receiving chambers 174. The base 154 may be formed as a convex polyhedral shape, or as a truncated ellipsoid, and preferably includes at least one magnetic receiving chamber 174. FIGS. 48 and 49 more specifically illustrate the bottom of the base, and FIG. 50 is a top view of the extension rig 152 and the base 154.

FIGS. 51A-51J more specifically illustrate the alternative toe 138, including the aforementioned magnet receiving chamber 140, a magnet retention lip 186, and the aperture 150, in place of the housing 102 shown in FIGS. 13A-J. The top-loaded magnet receiving chamber 140 allows the toe magnet 142 to be inserted into the alternative toe 138, while the magnet retention lip 186 prevents the toe magnet 142 from completely falling through the alternative toe 138 should the toe magnet 142 be selectively, rather than permanently, installed. The aperture 150 allows a screw, bolt, retention peg, etc. to pass through and secure the alternative toe 138 to a mounting surface, while using a corresponding fastener if necessary. The aperture 150 does not necessarily alter the use of the toe magnet 142 with respect to the magnet receiving chamber 140, and may allow for the combination of a stabilizing structure to protrude through the alternative toe 138 while simultaneously using the toe magnet 142 installed in the magnet receiving chamber 140 for added stability.

FIGS. 52A-52J illustrate the alternative heel 144 that includes a bottom-loaded heel magnet recess 190 capable of selectively or permanently securing the heel magnet 146 for added stability when securing the animation puppet 10 to a mounting surface, such as the mounting surface 148. As shown in FIGS. 51C-51D, the heel magnet recess 190 is accessible from the bottom of the alternative heel 144, and is substantially ring-shaped. The heel magnet 146 may be similarly ring-shaped and of a size to fit therein. The heel magnetic recess 190 could also be cylindrical to selectively receive and retain a disk-shaped magnet, such as the toe magnet 142. Alternatively, the heel magnet recess 190 may be polyhedral or ellipsoid in shape, depending on the shape of the heel magnet 146 inserted therein.

FIGS. 53A-53J further illustrate the toe 30 having the toe sockets 98, the magnet receiving chamber 140, aperture 150 formed in the magnet retention lip 186, as discussed above in detail. In general, FIGS. 53A-53D illustrate the toe magnet 142 in exploded relation relative to the magnet receiving chamber 140 and positioned below a cap 192 that includes a keyed extension 194 that selectively engages a keyed recess 196 formed from a portion of the magnet receiving chamber 140. In one embodiment, the cap 192 may be a two-way snap and/or press-to-friction-fit cap. Here, the cap 192 may be made from a relatively grippy rubber or a thermoplastic elastomer ("TPE") material to provide sufficient friction-related engagement with the magnet receiving chamber 140 to keep the toe magnet 142 in place therein, while allowing removal when desired. This may allow an animator to switch out magnets having different magnet pull strength, depending on the desired application. This can make creating animation and poses easier, especially when precise and/or delicate foot placement is required (e.g., animated walk cycles and other poses/animations that require the foot to be positioned just above the ground plane/surface without being pulled down to the near-contact surface due to the pull-force of the magnet). Further as part of this feature, the toe magnet 142 could be removed in its entirety if no magnetic force is needed and/or desired. In this respect, the cap 192 may further include an aperture 198 sized to selectively receive the insertion section 178 of the installation tool 16 for pass-through engagement with the underlying toe magnet 142. The cap 192 may have a geometry that tracks the general geometry of the toe 30 as shown, wherein keyed reception of the keyed extension 194 into the keyed recess 196 ensures the correct orientation of the cap 192 into the magnet receiving chamber 140.

Moreover, another feature of the animation puppet 10 as disclosed herein is a connector 200 (FIG. 35) configured for engagement with the extension rig 152 (FIGS. 37 and 43-48). The connector 200 is shown in FIG. 35 formed from the pelvis 18, but the connector 200 could be formed from one or more other parts, such as the abdomen chest 14 or the abdomen 16. The connector 200 could be a socket as disclosed herein for friction fit engagement with a ball grip. Alternatively, the connector 200 could be a threaded channel for select threaded engagement with the extension rig 152, such as with the rod 172.

Although several embodiments have been described in detail for purposes of illustration, various modifications may be made without departing from the scope and spirit of the invention. Accordingly, the invention is not to be limited, except as by the appended claims.

What is claimed is:

1. An extension rig for an animation puppet, comprising:

a base having a mounting surface for upright positioning of the extension rig;

a rod coupled to and at least partially extending up and away from the base; and a ball grip coupled an upper end of the rod and opposite the base, the ball grip including a first articulable surface configured for friction-fit engagement with a second articulable surface of a puppet socket, wherein friction-fit engagement of the ball grip with the puppet socket forms a base joint wherein a surface interface pre-tension between the first and second articulable surfaces has a coefficient of friction relatively greater than the weight of the animation puppet when attached to the extension rig such that the base joint independently supports the weight of the animation puppet while simultaneously permitting relative independent position posing of the animation puppet for stop-motion animation.

2. The extension rig of claim 1, including an adapter having a pair of adapter sockets, wherein at least one of the pair of adapter sockets is configured for friction-fit engagement with the ball grip.

3. The extension rig of claim 2, including at least one connecting member comprising a rod with a pair of ball connectors at opposite ends, wherein one of the pair of ball connectors is configured for friction-fit engagement with the adapter socket and the other of the pair of ball connectors is configured for friction-fit engagement with the puppet socket.

4. The extension rig of claim 3, wherein friction-fit connection of the ball connectors with the adapter socket and/or the puppet socket permits 360 degree rotation relative thereto.

5. The extension rig of claim 1, wherein the mounting surface including a magnetic surface.

6. The extension rig of claim 1, wherein the base includes one or more magnet receiving chambers for selectively receiving and retaining a magnet therein.

7. The extension rig of claim 6, including an installation rod having an insertion section with an insertion head sized for insertion into one of the one or more magnet receiving chambers in the base of the extension rig with the magnet selectively coupled thereto, the installation rod further including removal section having a removal head relatively larger than any of the one or more magnet receiving chambers in the base of the extension rig.

8. The extension rig of claim 7, wherein the insertion section comprises a first cylinder and the removal section comprises a second cylinder, the first cylinder having a diameter relatively smaller than the second cylinder.

9. The extension rig of claim 7, wherein magnetic attraction between the magnet and the mounting surface is relatively stronger than between the magnet and the insertion head, while magnetic attraction between the magnet and the mounting surface is relatively weaker than between the magnet and the removal head.

* * * * *